US009280950B2

(12) United States Patent
Arai et al.

(10) Patent No.: US 9,280,950 B2
(45) Date of Patent: Mar. 8, 2016

(54) DISPLAY DEVICE, METHOD FOR DRIVING DISPLAY DEVICE, AND ELECTRONIC APPARATUS

(71) Applicant: SEIKO EPSON CORPORATION, Tokyo (JP)

(72) Inventors: Yoshio Arai, Shiojiri (JP); Akira Nakajima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 498 days.

(21) Appl. No.: 13/690,433

(22) Filed: Nov. 30, 2012

(65) Prior Publication Data

US 2013/0088534 A1 Apr. 11, 2013

Related U.S. Application Data

(62) Division of application No. 12/099,549, filed on Apr. 8, 2008, now abandoned.

(30) Foreign Application Priority Data

| | | |
|---|---|---|
| Apr. 17, 2007 | (JP) | 2007-107798 |
| Apr. 17, 2007 | (JP) | 2007-107799 |
| Apr. 17, 2007 | (JP) | 2007-107800 |
| Apr. 17, 2007 | (JP) | 2007-107801 |

(51) Int. Cl.
*G09G 5/10* (2006.01)
*G09G 3/34* (2006.01)
(Continued)

(52) U.S. Cl.
CPC ..... *G09G 5/10* (2013.01); *G09G 3/3413* (2013.01); *G09G 3/3426* (2013.01); *G09G 3/3607* (2013.01); *G09G 3/3611* (2013.01); *G09G 3/2003* (2013.01); *G09G 3/36* (2013.01); *G09G 2310/024* (2013.01); *G09G 2310/0235* (2013.01); *G09G 2310/061* (2013.01);
(Continued)

(58) Field of Classification Search
CPC ..... G09G 2310/0235; G09G 2310/024; G09G 2310/061; G09G 2310/08; G09G 2320/0242; G09G 2320/0247; G09G 2320/0626; G09G 2320/066; G09G 2330/021; G09G 2340/06; G09G 2360/16; G09G 3/2003; G09G 3/3413; G09G 3/3426; G09G 3/36; G09G 3/3607; G09G 3/3611; G09G 5/10
See application file for complete search history.

(56) References Cited

U.S. PATENT DOCUMENTS 6,115,016 A * 9/2000 Yoshihara ..... G09G 3/3413 345/102
6,256,425 B1 7/2001 Kunzman
(Continued)

FOREIGN PATENT DOCUMENTS

JP A-9-33886 2/1997
JP A-11-102170 4/1999
(Continued)

*Primary Examiner* — Latanya Bibbins
(74) *Attorney, Agent, or Firm* — Oliff PLC

(57) ABSTRACT

A display device includes an illumination unit that delivers a first light, a second light and a third light. The display also includes a driving circuit that supplies a pixel with a first data signal for displaying a first image by illuminating the first light, the driving circuit supplying the pixel with a second data signal for displaying a second image by illuminating the second light, the driving circuit supplying the pixel with a third data signal for displaying a third image by illuminating the third light.

19 Claims, 31 Drawing Sheets

(51) Int. Cl.
*G09G 3/36* (2006.01)
*G09G 3/20* (2006.01)

(52) U.S. Cl.
CPC .... *G09G2310/08* (2013.01); *G09G 2320/0242* (2013.01); *G09G 2320/0247* (2013.01); *G09G 2320/066* (2013.01); *G09G 2320/0626* (2013.01); *G09G 2330/021* (2013.01); *G09G 2340/06* (2013.01); *G09G 2360/16* (2013.01)

(56) References Cited

U.S. PATENT DOCUMENTS

| | | | | |
|---|---|---|---|---|
| 6,392,656 | B1 | 5/2002 | Someya et al. | |
| 6,825,823 | B1 | 11/2004 | Taira et al. | |
| 6,972,777 | B2 | 12/2005 | Shigeta | |
| 7,042,527 | B2 | 5/2006 | Imai | |
| 7,046,221 | B1 | 5/2006 | Malzbender | |
| 7,079,098 | B2 | 7/2006 | Taira et al. | |
| 7,176,879 | B1 | 2/2007 | Yoshihara et al. | |
| 7,248,244 | B2 * | 7/2007 | Akiyama | G09G 3/3413 345/102 |
| 7,755,594 | B2 | 7/2010 | Yoshihara et al. | |
| 2003/0214725 | A1 * | 11/2003 | Akiyama | G09G 3/3413 359/640 |
| 2007/0086098 | A1 | 4/2007 | Sekiguchi et al. | |

FOREIGN PATENT DOCUMENTS

| | | | |
|---|---|---|---|
| JP | A-11-287977 | | 10/1999 |
| JP | A-2000-180825 | | 6/2000 |
| JP | A-2002-72980 | | 3/2002 |
| JP | A-2002-82652 | | 3/2002 |
| JP | A-2002-169515 | | 6/2002 |
| JP | A-2004-191836 | | 7/2004 |
| JP | A-2004-233555 | | 8/2004 |
| JP | A-2004-286963 | | 10/2004 |
| JP | WO-2005-101090 | A1 | 10/2005 |
| JP | A-2005-316092 | | 11/2005 |
| JP | A-2006-243223 | | 9/2006 |
| KR | 2008093875 | A * | 10/2008 |

* cited by examiner

DISPLAY DEVICE, METHOD FOR DRIVING DISPLAY DEVICE, AND ELECTRONIC APPARATUS

This is a Division of application Ser. No. 12/099,549 filed Apr. 8, 2008. The disclosure of the prior application is hereby incorporated by reference herein in its entirety.

BACKGROUND

1. Technical Field

The present invention relates to a technique for displaying an image in a field-sequential scheme.

2. Related Art

In the technical field of a field-sequential display device, an image problem of the separate perception of a plurality of primary color components (e.g., a red color component, a green color component, and a blue color component) at an edge portion of a moving image arises. When such an image problem occurs, the moving image is represented in mixed colors that are obtained as a result of the mixture of the plurality of these primary color components. The field-sequential display device displays a single-color image of each of these primary color components in a time-divided sequential manner so as to enable an observer to perceive a color image. The above-identified image problem due to primary-color-component separation is hereafter referred to as a "color breakup".

In an attempt to address such a technical problem, JP-A-2002-169515 discloses a technique that reduces a color breakup by displaying a single-color image of each of a white component and a plurality of color components, both of which are extracted from a plurality of primary color components, in a sequential manner. As another related art, JP-A-2005-316092 discloses a technique that reduces a color breakup by displaying single-color images of colors different from one another in three regions of an image display area. In the above-identified JP-A-2005-316092, these three regions are divided at the interval of predetermined number of rows out of the image display area.

As still another related art, JP-A-2006-243223 teaches a technique that decreases display brightness as the percentage of the number of pixels (i.e., window size) for which high gradation is specified relative to an entire display image increases. In the related art of JP-A-2006-243223, if the gradation of a display image is high when viewed as a whole, the brightness of a display device is decreased so as to reduce power consumption. On the other hand, according to the related technique described in JP-A-2006-243223, the brightness of a display device is increased for an image in which minute high-gradation picture elements are interspersed against a low-gradation background, for example, when an image of a firework is displayed. Since the brightness of the display device is increased when displaying such a type of an image, each of the minute picture elements is displayed in a clear manner.

SUMMARY

In the aforementioned related art described in JP-A-2002-169515, the gradation of the single-color image of the white component is significantly higher (which means a significantly higher brightness) than that of the single-color images of other color components especially if the display color of an image is close to white. As a consequence thereof, an observer perceives conspicuous flickers, which is an image problem, because a plurality of single-color images having gradations different from one another are displayed in a sequential manner. In order to address the above-identified problem without any limitation thereto, the invention aims, as a first aspect thereof, to provide a technical solution to the image problem of flickers that are attributable to the displaying of a single-color image of a white component performed by a field-sequential display device.

The invention provides, as the first aspect thereof, a display device that includes: a separating section that generates a separation image signal, which specifies the gradations of a plurality of color components (which is a broad generic concept that means either primary color components or a combination of primary color components and mixed color components) and the gradations of a plurality of white components, from an input image signal, which specifies the gradations of a plurality of primary color components for each of a plurality of pixels; and a displaying section that displays a single-color image corresponding to one of the color components and the white components sequentially on the basis of the generated separation image signal in each of a plurality of subfields allocated in a frame in such a manner that subfields corresponding to each of the plurality of the white components are distanced from each other or one another on a time axis. In the configuration of a display device according to the first aspect of the invention described above, it is preferable that the displaying section should have a liquid crystal device, where the liquid crystal device has an OCB mode liquid crystal that is sealed in a gap formed between a first substrate and a second substrate thereof.

In the configuration of a display device according to the first aspect of the invention described above, since the single-color images of a plurality of white components are displayed in split subfields that are distanced from each other or one another on a time axis, in comparison with a configuration in which a single-color image of a white component is displayed in only one subfield, it is possible to achieve a more suppressed gradation (i.e., brightness) for each of the single-color images of the white components. Therefore, it is possible to reduce flickers due to the displaying of a single-color image of a white component.

In a specific configuration of a display device according to the first aspect of the invention described above, the order of displaying the single-color images of color components and white components is not restrictively specified herein. For example, it is preferable that the displaying section should display a single-color image of a white component in each of subfields that are allocated before and after a plurality of subfields during which single-color images of the plurality of the color components are displayed. As another example thereof, it is preferable that the displaying section should display a single-color image of a white component in a subfield that is interposed at a gap allocated in a plurality of subfields during which single-color images of the plurality of the color components are displayed. With such a preferred configuration, it is possible to make harder for an observer to perceive a color breakup image problem.

In a specific configuration of a display device according to the first aspect of the invention described above, it is preferable that a black image should be displayed during a predetermined time period allocated in a frame. With such a preferred configuration, a color breakup is reduced because it shortens a time period during which single-color images of color components are displayed. In addition thereto, a moving-picture blur is also reduced because it shortens a time period during which single-color images of color components and single-color images of white components are displayed. Herein, "a black image should be displayed" means that the displaying of a color image is suspended. For example, assuming that the displaying section is made up of an illumination device and a liquid display device, a black-image display state refers to an operating condition in which at least one of the following two are executed: the emission of light from the illumination device is suspended (i.e., light off) and/or the transmission factor of each pixel of the liquid crystal device is reduced to the minimum value. In the preferred configuration described above, it is further preferable that a black image should be displayed during the last time period allocated in a frame.

In a specific configuration of a display device according to the first aspect of the invention described above, the displaying section displays a single-color image of at least one white component among the plurality of white components in a subfield that has a sub-field time period longer than that of each of subfields during which the single-color images of the color components are displayed. With the above-described configuration, since a sufficient time period for the displaying of single-color images of color components and single-color images of white components is secured, it is possible to effectively reduce flickers.

In a specific configuration of a display device according to the first aspect of the invention described above, the separating section generates the separation image signal in such a manner that the plurality of color components include but not limited to a mixed color component formed as a result of the mixture of two of the plurality of primary color components with each other. With the above-described configuration, in comparison with a configuration in which single-color images of primary color components are displayed in a successive manner, it becomes harder for a user who observes the display screen thereof to perceive the color-breakup image problem. In a further preferred configuration thereof, a mixed-color-component subfield(s) during which a single-color image of a mixed color component is displayed is interposed between primary-color-component subfields during which single-color images of primary color components are displayed.

The invention provides, as the first aspect thereof, a method for driving a display device, the driving method including: generating a separation image signal, which specifies the gradations of a plurality of color components and the gradations of a plurality of white components, from an input image signal, which specifies the gradations of a plurality of primary color components for each of a plurality of pixels; and commanding the display device to display a single-color image corresponding to one of the color components and the white components sequentially on the basis of the generated separation image signal in each of a plurality of subfields allocated in a frame in such a manner that subfields corresponding to each of the plurality of the white components are distanced from each other or one another on a time axis. The above-described method for driving a display device offers the same advantageous effects as those offered by a display device according to the first aspect of the invention described above.

In the aforementioned related art described in JP-A-2005-316092, three regions that constitute the divided portions of an image display area are arrayed along the column orientation (i.e., vertical direction) only. With such a configuration, it is practically impossible or at best difficult to prevent the occurrence of a color breakup if a visual point of a user who observes the display screen thereof moves in row orientation (i.e., horizontal direction). In order to address the above-identified problem without any limitation thereto, the invention aims, as a second aspect thereof, to provide a technical solution to the image problem of a color breakup that is attributable to the movement of a visual point of an observer during display performed by a field-sequential display device.

The invention provides, as the second aspect thereof, a display device that includes: a displaying section that has an array of a plurality of unit display areas along a first direction and a second direction that intersect with each other; and a controlling section that performs control so that a single-color image of each of a plurality of colors should be displayed sequentially in each of the above-mentioned more than one unit display areas in such a manner that single-color images of the plurality of colors are displayed in each of the unit display areas in a frame. In the configuration of a display device according to the second aspect of the invention described above, since a plurality of unit display areas in each of which a single-color image of each of a plurality of colors is displayed sequentially are arrayed along a first direction and a second direction that intersect with each other, it is possible to prevent the occurrence of a color breakup even when a visual point of an observer moves across a border (or borders) between the unit display areas in either the first direction or the second direction. In the configuration of a display device according to the second aspect of the invention described above, it is preferable that the displaying section should have a liquid crystal device, where the liquid crystal device has an OCB mode liquid crystal that is sealed in a gap formed between a first substrate and a second substrate thereof.

In a specific configuration of a display device according to the second aspect of the invention described above, the plurality of unit display areas make up a rectangular display area as a whole; and the dimension of each of the unit display areas measured along at least one of the first direction and the second direction is not greater than the length of the base of an isosceles triangle that has the vertex angle of 10 degrees and further has the height equal to the length of a short side of the rectangular display area multiplied by six. As a more preferable modified configuration of the above, the dimension of each of the unit display areas measured along at least one of the first direction and the second direction should not be greater than the length of the base of an isosceles triangle that has the vertex angle of 10 degrees and further has the height equal to the length of a short side of the rectangular display area multiplied by three. With either one of these configurations, it is possible to prevent the occurrence of a color breakup due to the movement of a visual point of an observer from one unit display area. In the configuration of a display device according to the second aspect of the invention described above, it is preferable that the number of the unit display areas (and the dimension of each unit display area) should be determined in such a manner that the cycle of single-color image display in the plurality of unit display areas equals a cycle corresponding to a predetermined frame frequency.

In a specific configuration thereof, it is preferable that a display device according to the second aspect of the invention described above should further include an image processing section that generates a separation image signal that specifies the gradation of a white component and the gradations of a plurality of color components from an input image signal that specifies the gradations of a plurality of primary color components for each of a plurality of pixels, wherein the controlling section commands the displaying section to display a single-color image of the white component and a single-color-image of each of the plurality of color components on the basis of the generated separation image signal. With such a preferred configuration, since a single-color image of a white component that is extracted from the display color of a pixel is displayed, it becomes harder for a user who observes the display screen thereof to perceive a color breakup image problem in comparison with a configuration in which single-color images of primary color components only are displayed. Since no color breakup occurs in a white component, considering from the viewpoint of color-breakup reduction only, it is not necessary at all to display a single-color image of a white component in the unit display areas in a sequential manner. Therefore, it is preferable to adopt a configuration in which the controlling section performs control so that a single-color image of each of the plurality of color components should be displayed sequentially in each of the above-mentioned more than one unit display areas whereas a single-color image of the white component should be displayed concurrently in the unit display areas.

In a specific configuration of a display device according to the second aspect of the invention described above, it is preferable that a plurality of white components should be extracted from the display color of a pixel. In such a preferred configuration of a display device according to the second aspect of the invention described above, since the single-color images of a plurality of white components are displayed in split subfields that are distanced from each other or one another on a time axis, in comparison with a configuration in which a single-color image of a white component is displayed in only one subfield, it is possible to achieve a more suppressed gradation (i.e., brightness) for each of the single-color images of the white components. Therefore, it is possible to reduce flickers due to the displaying of a single-color image of a white component.

In the preferred configuration of a display device according to the second aspect of the invention described above, the order of displaying the single-color images of color components and white components is not restrictively specified herein. For example, in a specific configuration of a display device according to the second aspect of the invention described above, it is preferable that the displaying section should display a single-color image of a white component in each of subfields that are allocated before and after a plurality of subfields during which single-color images of the plurality of the color components are displayed. As another example thereof, it is preferable that the displaying section should display a single-color image of a white component in a subfield that is interposed at a gap allocated in a plurality of subfields during which single-color images of the plurality of the color components are displayed. With such a preferred configuration, it is possible to make harder for an observer to perceive a color breakup image problem.

In a specific configuration of a display device according to the second aspect of the invention described above, the displaying section displays a single-color image of at least one white component among the plurality of white components in a subfield that has a sub-field time period longer than that of each of subfields during which the single-color images of the color components are displayed. With the above-described configuration, since a sufficient time period for the displaying of single-color images of color components and single-color images of white components is secured, it is possible to effectively reduce flickers.

In a specific configuration of a display device according to the second aspect of the invention described above, it is preferable that a black image should be displayed, or in other words, display should be suspended, during a predetermined time period allocated in a frame. With such a preferred configuration, a color breakup is reduced because it shortens a time period during which single-color images of color components are displayed. In addition thereto, a moving-picture blur is also reduced because it shortens a time period during which single-color images of color components and single-color images of white components are displayed. In the preferred configuration described above, it is further preferable that a black image should be displayed during the last time period allocated in a frame.

In a specific configuration of a display device according to the second aspect of the invention described above, the image processing section generates the separation image signal in such a manner that the plurality of color components include but not limited to a mixed color component formed as a result of the mixture of two of the plurality of primary color components with each other. With the above-described configuration, in comparison with a configuration in which single-color images of primary color components are displayed in a successive manner, it becomes harder for a user who observes the display screen thereof to perceive the color-breakup image problem. In a further preferred configuration thereof, a mixed-color-component subfield(s) during which a single-color image of a mixed color component is displayed is interposed between primary-color-component subfields during which single-color images of primary color components are displayed.

The invention provides, as the second aspect thereof, a method for driving a display device that has an array of a plurality of unit display areas along a first direction and a second direction that intersect with each other, the driving method including: performing control so that a single-color image of each of a plurality of colors should be displayed sequentially in each of the above-mentioned more than one unit display areas in such a manner that single-color images of the plurality of colors are displayed in each of the unit display areas in a frame. The above-described method for driving a display device offers the same advantageous effects as those offered by a display device according to the second aspect of the invention described above.

In the aforementioned related art described in JP-A-2005-316092, display is suspended in other areas during a time period in which a single-color image is displayed in one area. This means that a time period during which a single-color image is displayed in one area does not overlap a time period during which a single-color image is displayed in another area. Therefore, there is a problem that is not addressed by the above-identified patent publication of JP-A-2005-316092 in that it is practically impossible or at best difficult to ensure a sufficient color brightness (i.e., luminosity) of an output image in the image display area viewed as a whole. In order to address the above-identified problem without any limitation thereto, the invention aims, as a third aspect thereof, to provide a technical solution to the image problem of reduced luminosity (i.e., color brightness) in an output image when the image is displayed in each of the regions of the image display area of a field-sequential display device.

The invention provides, as a third aspect thereof, a display device that includes: a displaying section that has a first unit display area and a second unit display area; and a controlling section that performs control so that a single-color image of each of a plurality of colors should be displayed concurrently in the first unit display area and the second unit display area in each of a plurality of subfields allocated in a frame sequentially in such a manner that a single-color image displayed in the first display area and a single-color image displayed in the second display area correspond to colors different from each other in each subfield. In the configuration of a display device according to the third aspect of the invention described above, since the single-color images of colors different from each other are displayed concurrently in the first unit display area and the second unit display area, in comparison with a configuration in which a single-color image is displayed sequentially in each of the display areas, it is possible to ensure the improved luminosity of an output image easily. In the configuration of a display device according to the third aspect of the invention described above, it is preferable that the displaying section should have a liquid crystal device, where the liquid crystal device has an OCB mode liquid crystal that is sealed in a gap formed between a first substrate and a second substrate thereof.

In a specific configuration thereof, it is preferable that a display device according to the third aspect of the invention described above should further include an image processing section that generates a separation image signal that specifies the gradation of a white component and the gradations of a plurality of color components from an input image signal that specifies the gradations of a plurality of primary color components for each of a plurality of pixels, wherein the controlling section commands the displaying section to display a single-color image of the white component and a single-color-image of each of the plurality of color components (i.e., a primary color component and/or a mixed color component obtained as a result of the mixture of the primary color components) on the basis of the generated separation image signal. With the above-described configuration, it is possible to effectively reduce a color breakup because, in addition to the fact that no color breakup occurs in the single-color images of white components, the gradations of color components, which could cause the color-breakup image problem, are decreased as a result of the extraction of the white components.

In a specific configuration thereof, it is preferable that a display device according to the third aspect of the invention described above should further include an image processing section that generates a separation image signal that specifies the gradation of a white component and the gradations of a plurality of color components from an input image signal that specifies the gradations of a plurality of primary color components for each of a plurality of pixels, wherein the controlling section performs control so that, for each of the plurality of color components, a single-color image of one color for the first display area and a single-color image of another color different from the above-mentioned one color for the second display area should be displayed in each subfield on the basis of the generated separation image signal whereas, for the white component, a single-color image of the white component should be displayed concurrently in the first unit display area and the second unit display area in the same subfield on the basis of the generated separation image signal. In another specific configuration thereof, it is preferable that a display device according to the third aspect of the invention described above should further include an image processing section that generates a separation image signal that specifies the gradation of a white component and the gradations of a plurality of color components from an input image signal that specifies the gradations of a plurality of primary color components for each of a plurality of pixels, wherein the controlling section performs control so that a single-color image of each of the plurality of colors that include the white component and the plurality of color components should be displayed in each subfield on the basis of the generated separation image signal in such a manner that a single-color image displayed in the first display area and a single-color image displayed in the second display area correspond to colors different from each other.

It is preferable that a plurality of white components should be extracted from the display color of a pixel, though not limited thereto. In such a preferred configuration of a display device according to the third aspect of the invention described above, since the single-color images of a plurality of white components are displayed in split subfields that are distanced from each other or one another on a time axis, in comparison with a configuration in which a single-color image of a white component is displayed in only one subfield, it is possible to achieve a more suppressed gradation (i.e., brightness) for each of the single-color images of the white components. Therefore, it is possible to reduce flickers due to the displaying of a single-color image of a white component.

In a specific configuration of a display device according to the third aspect of the invention described above, the displaying section displays a single-color image of at least one white component among the plurality of white components in a subfield that has a sub-field time period longer than that of each of subfields during which the single-color images of the color components are displayed. With the above-described configuration, since a sufficient time period for the displaying of single-color images of color components and single-color images of white components is secured, it is possible to effectively reduce flickers.

In a preferred configuration of a display device according to the third aspect of the invention described above, it is preferable that a black image should be displayed, or in other words, display should be suspended, during a predetermined time period allocated in a frame. With such a preferred configuration, a color breakup is reduced because it shortens a time period during which single-color images of color components are displayed. In addition thereto, a moving-picture blur is also reduced because it shortens a time period during which single-color images of color components and single-color images of white components are displayed. In the preferred configuration described above, it is further preferable that a black image should be displayed during the last time period allocated in a frame.

In a specific configuration of a display device according to the third aspect of the invention described above, the image processing section generates the separation image signal in such a manner that the plurality of color components include but not limited to a mixed color component formed as a result of the mixture of two of the plurality of primary color components with each other. With the above-described configuration, in comparison with a configuration in which single-color images of primary color components are displayed in a successive manner, it becomes harder for a user who observes the display screen thereof to perceive the color-breakup image problem. In a further preferred configuration thereof, a mixed-color-component subfield(s) during which a single-color image of a mixed color component is displayed is interposed between primary-color-component subfields during which single-color images of primary color components are displayed.

In a specific configuration of a display device according to the third aspect of the invention described above, the displaying section has a rectangular display area that is made up of an array of a plurality of unit display areas along a first direction and a second direction that intersect with each other, the plurality of unit display areas including the first unit display area and the second unit display area; and the dimension of each of the unit display areas measured along at least one of the first direction and the second direction is not greater than the length of the base of an isosceles triangle that has the vertex angle of 10 degrees and further has the height equal to the length of a short side of the rectangular display area multiplied by six. As a more preferable modified configuration of the above, the dimension of each of the unit display areas measured along at least one of the first direction and the second direction should not be greater than the length of the base of an isosceles triangle that has the vertex angle of 10 degrees and further has the height equal to the length of a short side of the rectangular display area multiplied by three. With either one of these configurations, it is possible to prevent the occurrence of a color breakup due to the movement of a visual point of an observer from one unit display area.

The invention provides, as the third aspect thereof, a method for driving a display device that has a first unit display area and a second unit display area, the driving method including: performing control so that a single-color image of each of a plurality of colors should be displayed concurrently in the first unit display area and the second unit display area in each of a plurality of subfields allocated in a frame sequentially in such a manner that a single-color image displayed in the first display area and a single-color image displayed in the second display area correspond to colors different from each other in each subfield. The above-described method for driving a display device offers the same advantageous effects as those offered by a display device according to the third aspect of the invention described above.

When a field-sequential display device is applied to the aforementioned related art described in JP-A-2006-243223 according to which the brightness of a display device is controlled in accordance with the lightness/darkness of a display image, an image problem arises when the brightness of the display device is high. That is, the aforementioned color breakup becomes very conspicuous in such a case. In order to address the above-identified problem without any limitation thereto, the invention aims, as a fourth aspect thereof, to provide a technical solution to the image problem of the aforementioned color breakup that occurs when the brightness of the related-art field sequential display device is controlled in accordance with the lightness/darkness of a display image.

The invention provides, as a fourth aspect thereof, a display device that includes: a displaying section that displays an image; an image processing section that generates a separation image signal that specifies the gradation of a white component and the gradations of a plurality of color components from an input image signal that specifies the gradations of a plurality of primary color components for each of a plurality of pixels; a driving section that commands the displaying section to display a single-color image of each of the white component and the plurality of color components in a plurality of subfields allocated in a frame sequentially; and a brightness controlling section that decreases the brightness of display performed by the displaying section as the number of pixels for which high gradation is specified increases in a display image in a frame. In the configuration of a display device according to the fourth aspect of the invention described above, the brightness controlling section controls display brightness. Therefore, it is possible to achieve high-contrast display with reduced power consumption. In addition thereto, since a single-color image of a white component is displayed in the configuration of a display device according to the fourth aspect of the invention described above, it is possible to reduce a color breakup.

In the configuration of a display device according to the fourth aspect of the invention described above, it is preferable that the image processing section should generate the separation image signal that specifies the gradations of the plurality of color components and the gradations of a plurality of white components; and the driving section should command the displaying section to display a single-color image of each of the plurality of color components and the plurality of white components in the plurality of subfields sequentially in such a manner that subfields corresponding to each of the plurality of the white components are distanced from each other or one another on a time axis. In the configuration of a display device according to the fourth aspect of the invention described above, since the single-color images of the plurality of white components are displayed in split subfields that are distanced from each other or one another on a time axis, in comparison with a configuration in which a single-color image of a white component is displayed in only one subfield, it is possible to achieve a more suppressed gradation (i.e., brightness) for each of the single-color images of the white components. Therefore, it is possible to reduce flickers due to the displaying of a single-color image of a white component.

The invention provides, as another specific configuration of the fourth aspect thereof, a display device that includes: a displaying section that has an array of a plurality of unit display areas; a controlling section that performs control so that a single-color image of each of a plurality of colors should be displayed sequentially in each of the above-mentioned more than one unit display areas in such a manner that single-color images of the plurality of colors are displayed in each of the unit display areas in a frame; and a brightness controlling section that decreases the brightness of display performed by the displaying section as the number of pixels for which high gradation is specified increases in a display image in a frame. With the above-described configuration, it is possible to achieve high-contrast display with reduced power consumption because the brightness controlling section controls display brightness. Since a single-color image of each of a plurality of colors is displayed sequentially in each of the unit display areas, it is possible to prevent the occurrence of a color breakup even when a visual point of an observer moves across a border (or borders) between the unit display areas.

The invention provides, as another specific configuration of the fourth aspect thereof, a display device that includes: a displaying section that has an array of a plurality of unit display areas including a first unit display area and a second unit display area; a driving section that performs control so that a single-color image of each of a plurality of colors should be displayed concurrently in the first unit display area and the second unit display area in each of a plurality of subfields allocated in a frame sequentially in such a manner that a single-color image displayed in the first display area and a single-color image displayed in the second display area correspond to colors different from each other in each subfield; and a brightness controlling section that decreases the brightness of display performed by the displaying section as the number of pixels for which high gradation is specified increases in a display image in a frame. With the above-described configuration, it is possible to achieve high-contrast display with reduced power consumption because the brightness controlling section controls display brightness. Moreover, since the single-color images of colors different from each other are displayed concurrently in the first unit display area and the second unit display area, in comparison with a configuration in which a single-color image is displayed sequentially in each of the display areas, it is possible to ensure the improved luminosity of an output image easily and also to reduce the aforementioned color breakup image problem in an effective manner.

Note that, in the configuration of a display device having the above-described brightness controlling section, judgment-target pixels that are used when making a judgment as to whether the brightness controlling section should decrease display brightness or not may be all pixels of a display image or, alternatively, some pixels thereof that are arrayed in a certain area. Or, in other words, all pixels of a display image may be subjected to a judgment as to whether high gradation is specified for them or not; or alternatively, some thereof that are arrayed in a predetermined area only may be used for such a judgment. It is preferable that the displaying section according to the first, second, and third modes thereof described above should have a liquid crystal device, where the liquid crystal device has an OCB mode liquid crystal that is sealed in a gap formed between a first substrate and a second substrate thereof.

In the configuration of a display device according to the above-described specific examples of the fourth aspect of the invention, it is preferable that the brightness controlling section should control the brightness of display for each of the plurality of unit display areas in such a manner that, as the number of pixels for which high gradation is specified increases in each of the unit display areas, the brightness of display in the unit display area is decreased. With such a configuration, advantageously, it is possible to satisfy both of a reduction in power consumption and enhancement in contrast in a compatible manner depending on the content of an image that is displayed in each of the unit display areas.

In a specific configuration of a display device according to the fourth aspect of the invention described above, the displaying section has a rectangular display area that is made up of an array of a plurality of unit display areas along a first direction and a second direction that intersect with each other; and the dimension of each of the unit display areas measured along at least one of the first direction and the second direction is not greater than the length of the base of an isosceles triangle that has the vertex angle of 10 degrees and further has the height equal to the length of a short side of the rectangular display area multiplied by six. As a more preferable modified configuration of the above, the dimension of each of the unit display areas measured along at least one of the first direction and the second direction should not be greater than the length of the base of an isosceles triangle that has the vertex angle of 10 degrees and further has the height equal to the length of a short side of the rectangular display area multiplied by three. With either one of these configurations, it is possible to prevent the occurrence of a color breakup due to the movement of a visual point of an observer from one unit display area.

Pixels of each of the above-described aspects of the invention are embodied as, for example, electro-optical elements (i.e., electro-optic devices), which change their optical characteristics such as a transmission factor and brightness, though not limited thereto, as a result of a certain electric action, which includes but not limited to the application of an electric field thereto or the supply of an electric current thereto. A typical example of such an electro-optical element is a liquid crystal element, which has liquid crystal sealed between a pair of electrodes thereof. A display device according to any of the above-described aspects of the invention can be applied to a variety of electronic apparatuses.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
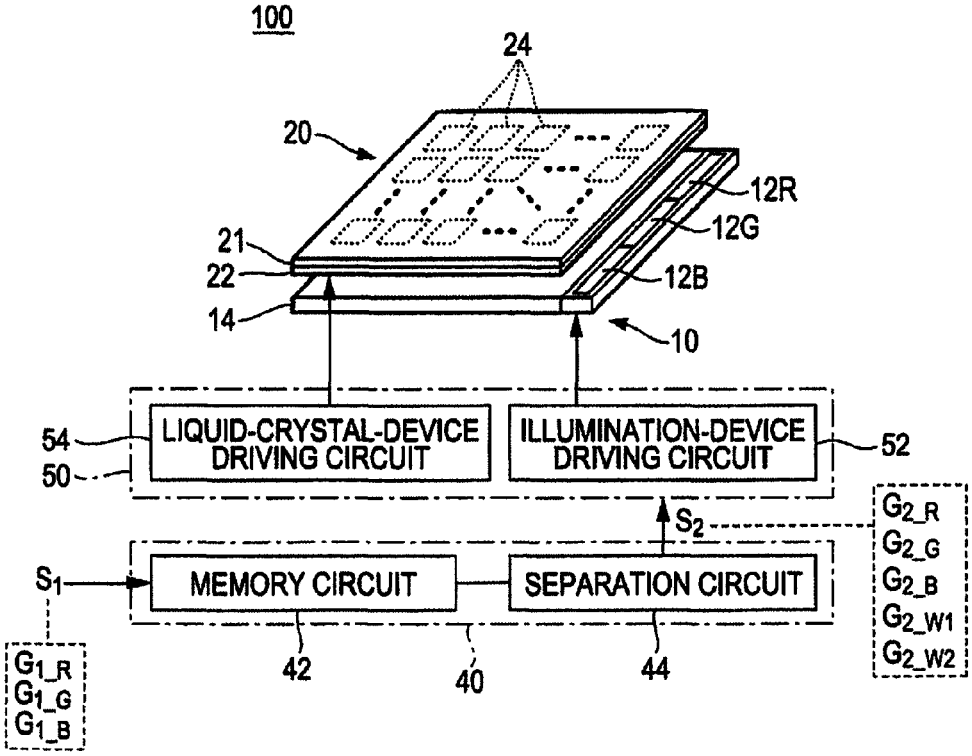
FIG. 1 is a diagram that schematically illustrates an example of the configuration of a display device according to an exemplary embodiment A1 of the invention.

With reference to the accompanying drawings, exemplary embodiments of the invention are explained below. In the following description, unless otherwise specified, it should be understood that each of the constituent elements of a display device according to an exemplary embodiment of the invention which appears more than one time in this specification has the same operation and function as long as the same reference numeral are consistently assigned thereto.

Embodiment A1

FIG. 1 is a diagram that schematically illustrates an example of the configuration of a display device according to an exemplary embodiment A1 of the invention. As illustrated in FIG. 1, an image display device 100 is provided with an illumination device 10, a liquid crystal device 20, an image-processing unit 40, and a controlling unit 50. The image-processing unit 40 and the controlling unit 50 may be provided in a single integrated circuit (IC). Or, the image-processing unit 40 may be embodied as a circuit component of one integrated circuit whereas the controlling unit 50 may be embodied as a circuit component of another integrated circuit in a discrete manner.

The illumination device 10 is provided at the back of the liquid crystal device 20. The illumination device 10 illuminates the liquid crystal device 20. The illumination device 10 has a plurality of light-emitting elements 12 and a light-guiding plate 14, the latter of which is configured as an optical waveguide board. The plurality of light-emitting elements 12 is made up of a red light-emitting element 12R, a green light-emitting element 12G, and a blue light-emitting element 12B, which correspond to three primary colors of R (red), G (green), and B (blue), respectively. The optical waveguide board 14 guides light that has been emitted thereto from each of the red light-emitting element 12R, the green light-emitting element 12G, and the blue light-emitting element 12B toward the liquid crystal device 20. The red light-emitting element 12R emits red light, that is, light having a wavelength that corresponds to a red color component. The green light-emitting element 12G outputs green light, that is, light having a wavelength that corresponds to a green color component. The blue light-emitting element 12R outputs blue light, which is light having a wavelength that corresponds to a blue color component. In actual implementation of the invention, a light-reflecting plate and a light-scattering plate are adhered to the light-guiding plate 14 of the image display device 100. In order to simplify explanation, however, these light-reflecting plate and light-scattering plate are omitted from the drawing.

The liquid crystal device 20 has a pair of a first substrate 21 and a second substrate 22. The first substrate 21 and the second substrate 22 are provided so as to face each other. Liquid crystal is sealed in a gap formed between the first substrate 21 and the second substrate 22 that are provided opposite to each other. It should be noted that the liquid crystal is not illustrated in the drawing. It is preferable to adopt a quick-responsive liquid crystal that operates in an OCB (Optically Compensated Bend) mode, though not limited thereto. A plurality of pixel electrodes 24 is arrayed in a matrix pattern on a liquid-crystal-side surface of the second substrate 22. Each of the plurality of pixel electrode 24 corresponds to a pixel of an image. The orientation, that is, alignment, of the liquid crystal that is sandwiched between the first substrate 21 and the second substrate 22 changes in accordance with an electric potential difference (i.e., voltage difference) between each of the pixel electrodes 24 and a counter electrode, the latter of which is provided on a liquid-crystal-side surface of the first substrate 21. Note that the counter electrode is not illustrated in the drawing. With such a configuration, the ratio of the amount of light that is transmitted to the monitoring side of the image display device 100, which is an image display side thereof, to the entire amount of light that is emitted from the illumination device is controlled on a pixel-by-pixel basis. In other words, the transmission factor of each of the plurality of pixel electrodes 24 is individually controlled.

Figure 2:
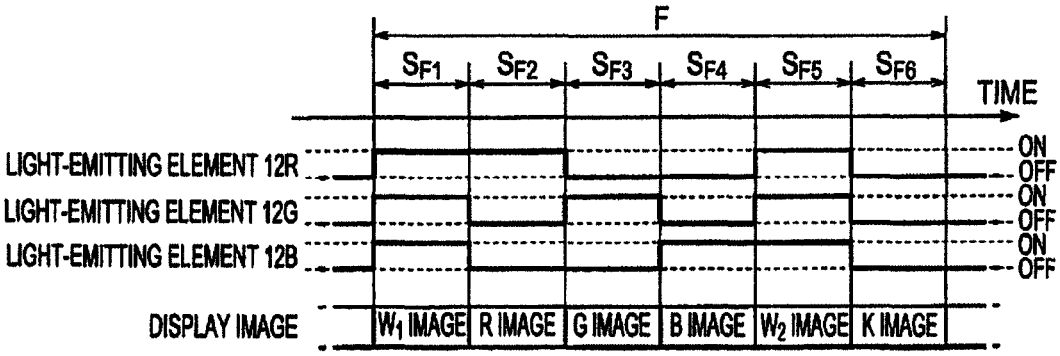
FIG. 2 is a timing chart that schematically illustrates an example of the timing operation of a display device according to the exemplary embodiment A1 of the invention.

The illumination device 10 and the liquid crystal device 20 function in cooperation with each other so as to display a color image. FIG. 2 is a timing chart that schematically illustrates an example of the timing operations of the illumination device 10 and the liquid crystal device 20 according to an exemplary embodiment of the invention. A frame F that is shown in FIG. 2 is a unit time period (i.e., unitary time period) that is used for displaying one color image (e.g., full-color image). As illustrated in FIG. 2, the frame F is time-divided into a plurality of sub-fields (i.e., subfields) (hereafter may be abbreviated as SF). In the illustrated embodiment of the invention, one frame F is time-divided into six sub-fields (i.e., sub-frames), which are denoted as SF1, SF2, SF3, SF4, SF5, and SF6. The illumination device 10 and the liquid crystal device 20 sequentially display a plurality of images each of which corresponds to an individual single color component displayed in corresponding one of sub-fields SF. That is, the illumination device 10 and the liquid crystal device 20 perform so-called field sequential (FS) display. In the following description, the above-described image that corresponds to an individual single color component displayed in each of sub-fields SF is referred to as a "single-color image". Herein, the term "single-color" is used in the meaning of "unicolor" or the like. A user who observes the display screen of the image display device 100 views these single-color images displayed in the respective sub-fields SF in a sequential manner. As a result thereof, they (i.e., the user) visually perceive a color image that is formed as a mixture of these individual single color components. For this reason, it is not necessary to provide any coloration layer such as a color filter or the like in the configuration of the liquid crystal device 20.

The image-processing unit 40 illustrated in FIG. 1 processes an input image signal S1 that is supplied thereto from an external device that is not shown in the drawing. The input image signal S1 is a signal that specifies the display color of each of a plurality of pixels that makes up an image. The input image signal S1 individually specifies a gradation value for each of three primary color components, that is, a red color component, a green color component, and a blue color component, which make up the display color of a pixel. That is, the input image signal S1 individually specifies the gradation G1_R of the red component (hereafter may be referred to as "R color component" (R component)), the gradation G1_G of the green component (hereafter may be referred to as "G color component" (G component)), and the gradation G1_B of the blue component (hereafter may be referred to as "B color component" (B component)) for each of the plurality of pixels.

As illustrated in FIG. 1, the image-processing unit 40 is provided with a memory circuit 42 and a separation circuit 44. Hereafter, the term "color separation" is used with no intention to limit the scope of the invention. The memory circuit 42 is configured as a frame memory that stores the input image signal S1 for each of the pixels that make up an image that is displayed in a frame F. The color separation circuit 44 generates a color separation image signal S2 from the input image signal S1 that has been memorized in the memory circuit 42 and then outputs the generated color separation image signal S2. The color separation image signal S2 individually specifies, for each of the plurality of pixels, a gradation value for each of separated components, which are obtained in the form of a plurality of primary-color components and a plurality of white components as a result of the color separation of a display color that is specified by the input image signal S1. As illustrated in FIG. 1, the color separation image signal S2 according to the present embodiment of the invention specifies the gradation G2_W1 of a first white component and the gradation G2_W2 of a second white component in addition to the gradation G2_R of the R color component, the gradation G2_G of the G color component, and the gradation G2_B of the B color component. In the following description, the first white component may be referred to as "W1 component", whereas the second white component may be referred to as "W2 component".

Figure 3:
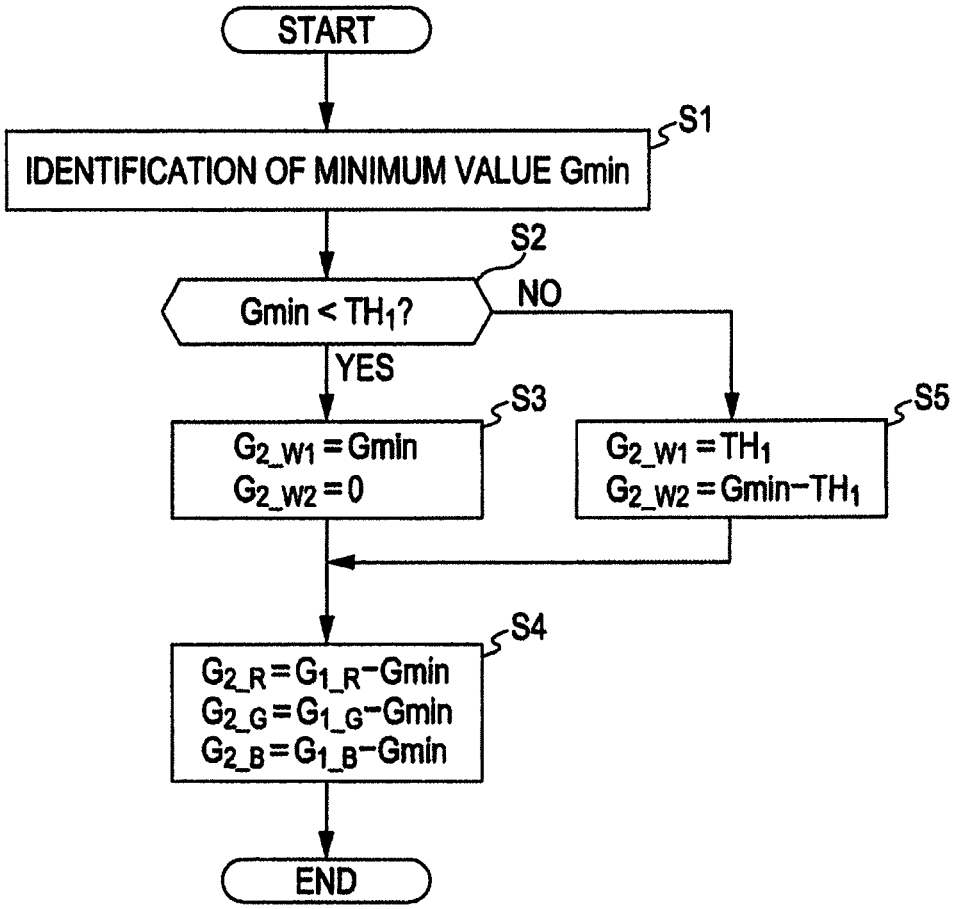
FIG. 3 is a flowchart that illustrates an example of processing for generation of a separation image signal according to the exemplary embodiment A1 of the invention.

FIG. 3 is a flowchart that illustrates an example of the "color-separating" operations of the color separation circuit 44 of the image-processing unit 40 according to an exemplary embodiment of the invention. It should be noted that the procedure illustrated in FIG. 3 is executed for each of pixels that make up an image. As a first step thereof, the image-processing unit 40 identifies the minimum value Gmin among the inputted gradation values of three primary color components, that is, the gradation G1_R of the R component, the gradation G1_G of the G component, and the gradation G1_B of the B component, which are individually specified for each of the plurality of pixels by the input image signal S1 (step S1). In the next step, the image-processing unit 40 makes a judgment as to whether the minimum value Gmin, which was identified as the smallest in the preceding step S1, is not greater than a threshold value TH1 or not (step S2). In a typical configuration, the threshold value TH1 is a preset fixed value. Notwithstanding the foregoing, the threshold value TH1 may be configured as a variable value that is, for example, set in accordance with a setting instruction given by a user or issued from a higher-level master device.

Figure 4:
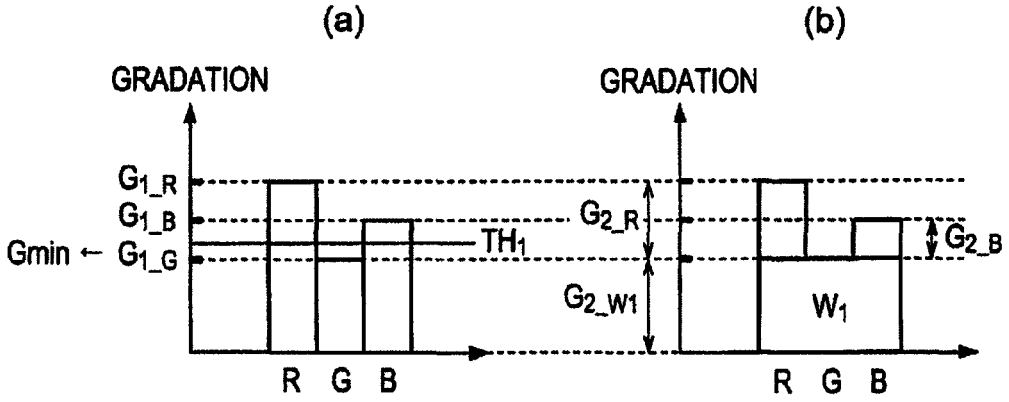
FIG. 4 is a diagram that schematically illustrates a specific example of the generation of a separation image signal according to the exemplary embodiment A1 of the invention.
Figure 5:
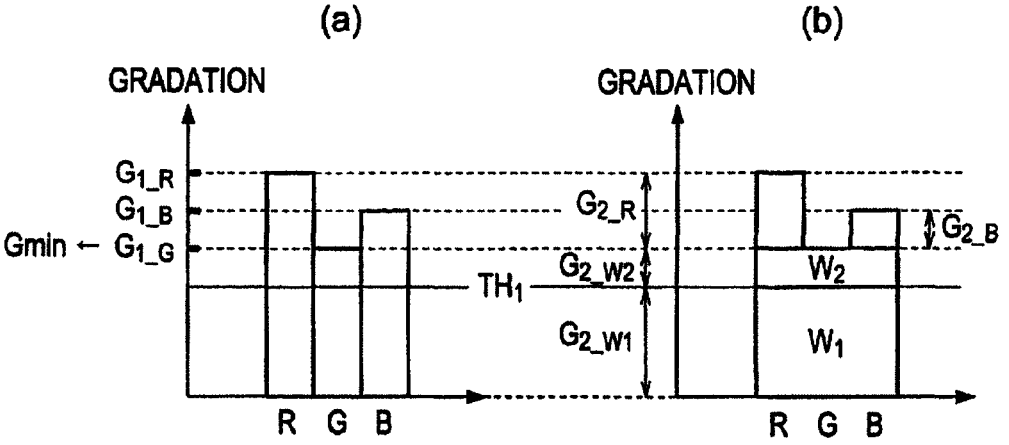
FIG. 5 is a diagram that schematically illustrates a specific example of the generation of a separation image signal according to the exemplary embodiment A1 of the invention.

A non-limiting example of the inputted gradation values of three primary color components, that is, the gradation G1_R of the R component, the gradation G1_G of the G component, and the gradation G1_B of the B component, which are individually specified by the input image signal S1, is illustrated in each of the left "gradation bar-chart" portion (a) of FIG. 4 and the left portion (a) of FIG. 5. In a first example of a display color that is illustrated in the left portion (a) of FIG. 4, the gradation G1_G of the G component is the smallest among the inputted gradation values of three primary color components. In this example, the minimum value Gmin (i.e., G1_G) is smaller than the threshold value TH1. In a case where the minimum value Gmin is smaller than the threshold value TH1, an example of which is illustrated in the left portion (a) of FIG. 4, the image-processing unit 40 generates a color separation image signal S2 that sets the minimum value Gmin identified in the previous step S1 as the gradation G2_W1 of the first white component W1 and further sets zero as the gradation G2_W2 of the second white component W2 (step S3). Then, the image-processing unit 40 subtracts the minimum value Gmin from each of the inputted gradation values of three primary color components, that is, the gradation G1_R of the R component, the gradation G1_G of the G component, and the gradation G1_B of the B component. Then, the result of subtraction is specified in the color separation image signal S2 as the separated gradation values of three primary color components, that is, the gradation G2_R of the R component, the gradation G2_G of the G component, and the gradation G2_B of the B component (step S4).

In the first example of a display color that is illustrated in the left portion (a) of FIG. 4, the image-processing unit 40 generates the color separation image signal S2 that sets the gradation G1_G of the G component specified by the input image signal S1, which is the minimum value Gmin among the inputted gradation values of three primary color components, as the gradation G2_W1 of the first white component W1 as illustrated in the right portion (b) of FIG. 4. Then, the image-processing unit 40 calculates a difference value between the gradation G1_R of the R component of the inputted gradation values of three primary color components and the minimum value Gmin so as to set the calculated difference value as the gradation G2_R of the R component of the separated gradation values of three primary color components. Similarly, the image-processing unit 40 calculates a difference value between the gradation G1_B of the B component of the inputted gradation values of three primary color components and the minimum value Gmin so as to set the calculated difference value as the gradation G2_B of the B component of the separated gradation values of three primary color components. It should be particularly noted that the gradation G2_G of the G component specified in the color separation image signal S2 is zero because a difference value between the gradation G1_G of the G component of the inputted gradation values of three primary color components and the minimum value Gmin is zero, which is mathematically expressed as: $G2_G=G1_G-Gmin=0$.

In a second example of a display color that is illustrated in the left portion (a) of FIG. 5, the gradation G1_G of the G component is the smallest among the inputted gradation values of three primary color components. Unlike the foregoing first example illustrated in the left portion (a) of FIG. 4, however, in this example, the minimum value Gmin (i.e., G1_G) is larger than the threshold value TH1. If the result of a judgment made in the step S2 is NO (an example of such a case is illustrated in the left portion (a) of FIG. 5), the image-processing unit 40 generates a color separation image signal S2 that sets the threshold TH1 as the gradation G2_W1 of the first white component W1 and further sets a difference value between the minimum value Gmin (i.e., G1_G) and the threshold value TH1 as the gradation G2_W2 of the second white component W2 (step S5). Then, the image-processing unit 40 subtracts the minimum value Gmin from each of the inputted gradation values of three primary color components, that is, the gradation G1_R of the R component, the gradation G1_G of the G component, and the gradation G1_B of the B component. Then, the result of subtraction is specified in the color separation image signal S2 as the separated gradation values of three primary color components, that is, the gradation G2_R of the R component, the gradation G2_G of the G component, and the gradation G2_B of the B component (step S4). Note that the minimum value Gmin can be expressed as, in this second example, a value obtained as a result of the addition of the gradation G2_W2 of the second white component W2 to the gradation G2_W1 of the first white component W1, or in other words, a result of the addition of the gradation G2_W2 of the second white component W2 to the threshold value TH1.

In the second example of a display color that is illustrated in the left gradation graph of FIG. 5, the image-processing unit 40 generates the color separation image signal S2 that sets the threshold TH1 as the gradation G2_W1 of the first white component W1 and further sets a difference value between the gradation G1_G of the G component specified by the input image signal S1, which is the minimum value Gmin among the inputted gradation values of three primary color components, and the threshold value TH1 as the gradation G2_W2 of the second white component W2 as illustrated in the right portion (b) of FIG. 5. Then, the image-processing unit 40 calculates a difference value between the gradation G1_R of the R component of the inputted gradation values of three primary color components and the minimum value Gmin so as to set the calculated difference value as the gradation G2_R of the R component of the separated gradation values of three primary color components. Similarly, the image-processing unit 40 calculates a difference value between the gradation G1_B of the B component of the inputted gradation values of three primary color components and the minimum value Gmin so as to set the calculated difference value as the gradation G2_B of the B component of the separated gradation values of three primary color components. Note that the gradation G2_G of the G component specified in the color separation image signal S2 is zero because a difference value between the gradation G1_G of the G component of the inputted gradation values of three primary color components and the minimum value Gmin is zero. As explained above, if the combined gradation of the pre-separation "white" component (corresponding to W1+W2), or in other words, the minimum value Gmin, contained in a display color specified by the input image signal S1 is greater than the threshold value TH1, the pre-separation white components is split into the first actual white component W1 and the second actual white component W2 at the boundary of the threshold value TH1 in the "color separation" process (i.e., white extraction process).

The controlling unit 50 illustrated in FIG. 1 is a circuit that controls the operations of the image display device 10 and the liquid crystal device 20. The controlling unit 50 is provided with an illumination-device driving circuit 52, which drives the illumination device 10, and a liquid-crystal-device driving circuit 54, which drives the liquid crystal device 20. The circuit mount configuration of the controlling unit 50 is not restrictively specified herein. For example, the illumination-device driving circuit 52 may be provided not on the controlling unit 50 but on the illumination device 10, whereas the liquid-crystal-device driving circuit 54 may be provided not on the controlling unit 50 but on the liquid crystal device 20. As another non-limiting configuration example thereof, the illumination-device driving circuit 52 and the liquid-crystal-device driving circuit 54 may be mounted on a single integrated circuit.

As illustrated in FIG. 2, the illumination-device driving circuit 52 controls the ON/OFF state of each of the plurality of light-emitting elements 12, that is, the red light-emitting element 12R, the green light-emitting element 12G, and the blue light-emitting element 12B, in each of the aforementioned sub-fields SF. Specifically, for example, the illumination-device driving circuit 52 performs light-emission control so that the red light-emitting element 12R only should emit light during the second sub-field SF2. The illumination-device driving circuit 52 performs light-emission control so that the green light-emitting element 12G only should emit light during the third sub-field SF3. The illumination-device driving circuit 52 performs light-emission control so that the blue light-emitting element 12B only should emit light during the fourth sub-field SF4. In addition thereto, the illumination-device driving circuit 52 controls all of the red light-emitting element 12R, the green light-emitting element 12G, and the blue light-emitting element 12B to emit light during the first sub-field SF1 and the fifth sub-field SF5. On the other hand, the illumination-device driving circuit 52 controls all of the red light-emitting element 12R, the green light-emitting element 12G, and the blue light-emitting element 12B not to emit light during the sixth sub-field SF6. As a result of light-emission control that is performed by the illumination-device driving circuit 52 as described above, light of one of three primary color components is irradiated onto the liquid crystal device 20 in each of the sub-fields SF2, SF3, and SF4 in a sequential manner. In addition, white light is irradiated onto the liquid crystal device 20 in the sub-fields SF1 and SF5. On the other hand, no light is irradiated onto the liquid crystal device 20 in the sub-field SF6.

The liquid-crystal-device driving circuit 54 controls the transmission factor of liquid crystal corresponding to each of the pixel electrodes 24 in each of the sub-fields SF in accordance with a gradation value specified by a color separation image signal S2 for each of the pixels. That is, the liquid-crystal-device driving circuit 54 supplies an electric potential (i.e., a voltage) that is in accordance with a gradation value specified by a color separation image signal S2 for each of the pixels (hereafter referred to as "data electric potential") at the beginning of each of the sub-fields SF to each of the pixel electrodes 24 corresponding to the pixel. In each of the sub-fields SF during which the illumination device 10 emits light that corresponds to any one of a plurality of (i.e., three) primary color components or any one of a plurality of white components, a data electric potential is set in accordance with a gradation value specified by a color separation image signal S2 for the above-mentioned (corresponding) one of the plurality of primary color components or the above-mentioned one of the plurality of white components.

To be more specific, in the second sub-field SF2 during which red light is irradiated onto the liquid crystal device 20, the liquid-crystal-device driving circuit 54 supplies a data electric potential that corresponds to the gradation G2_R of the R component of each pixel to the corresponding one of the pixel electrodes 24. In like manner, in the third sub-field SF3 during which green light is irradiated onto the liquid crystal device 20, the liquid-crystal-device driving circuit 54 supplies a data electric potential that corresponds to the gradation G2_G of the G component to each pixel electrode 24, whereas, in the fourth sub-field SF4 during which blue light is irradiated onto the liquid crystal device 20, the liquid-crystal-device driving circuit 54 supplies a data electric potential that corresponds to the gradation G2_B of the B component to each pixel electrode 24. On the other hand, in the first sub-field SF1 during which white light is irradiated onto the liquid crystal device 20, the liquid-crystal-device driving circuit 54 supplies a data electric potential that corresponds to the gradation G2_W1 of the W1 component to each pixel electrode 24. In like manner, in the fifth sub-field SF5 during which white light is irradiated onto the liquid crystal device 20, the liquid-crystal-device driving circuit 54 supplies a data electric potential that corresponds to the gradation G2_W2 of the W2 component to each pixel electrode 24. In the sixth sub-field SF6 during which the illumination device 10 switches light off so that no light should be irradiated onto the liquid crystal device 20, the liquid-crystal-device driving circuit 54 supplies, to each pixel electrode 24, a data electric potential that reduces the transmission factor of liquid crystal to the minimum value (e.g., zero). As a result of data-electric-potential control that is performed by the liquid-crystal-device driving circuit 54 as described above, a single-color image corresponding to each component, which is either one of a plurality of primary color components (R, and B) or one of a plurality of white components (W1 and W2), is displayed in the corresponding one of the sub-fields SF. Therefore, as illustrated in FIG. 2, single-color images that respectively correspond to these field-assigned components of R, G, B, W1, and W2 are displayed in a field-sequential manner, specifically, in a sequential order of W1, R, B, and W2 in the illustrated embodiment of the invention. It should be particularly noted that the sub-fields SF2, SF3, and SF4 during which single-color images that correspond to three primary color components of R, G, and B, respectively are displayed are interposed between the sub-field SF1 during which a single-color image that corresponds to the first white component W1 is displayed and the sub-field SF5 during which a single-color image that corresponds to the second white component W2 is displayed. This means that, because of the presence of a block of the R-component subfield SF2, the G-component subfield SF3, and the B-component subfield SF4 that is interposed therebetween, the W1-component subfield SF1 and the W2-component subfield SF5 are separated (i.e., distanced) from each other on a time axis. In the last sub-field SF6, a black (K) image is displayed in each pixel.

As explained above, in the configuration of the image display device 100 according to the present embodiment of the invention, single-color images that correspond to white components (W1 and W2) as well as single-color images that correspond to primary color components (R, G, and B) are displayed. Therefore, in comparison with a case where single-color images that correspond to primary color components (R, and B) only are displayed, which means that no single-color images that correspond to white components (W1 and W2) are displayed, the image display device 100 according to the present embodiment of the invention makes it possible to achieve a greater reduction in the aforementioned color-breakup phenomenon in an image visually perceived by a user who observes the display screen thereof. A detailed explanation as to how the image display device 100 according to the present embodiment of the invention reduces the occurrence of the color-breakup image problem is given below.

Figure 6:
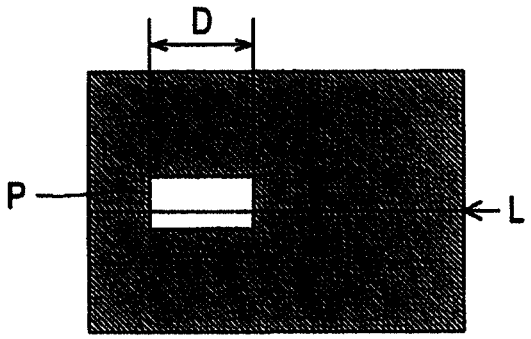
FIG. 6 is a diagram that schematically illustrates an example of the display of a display device according to the exemplary embodiment A1 of the invention.
Figure 7:
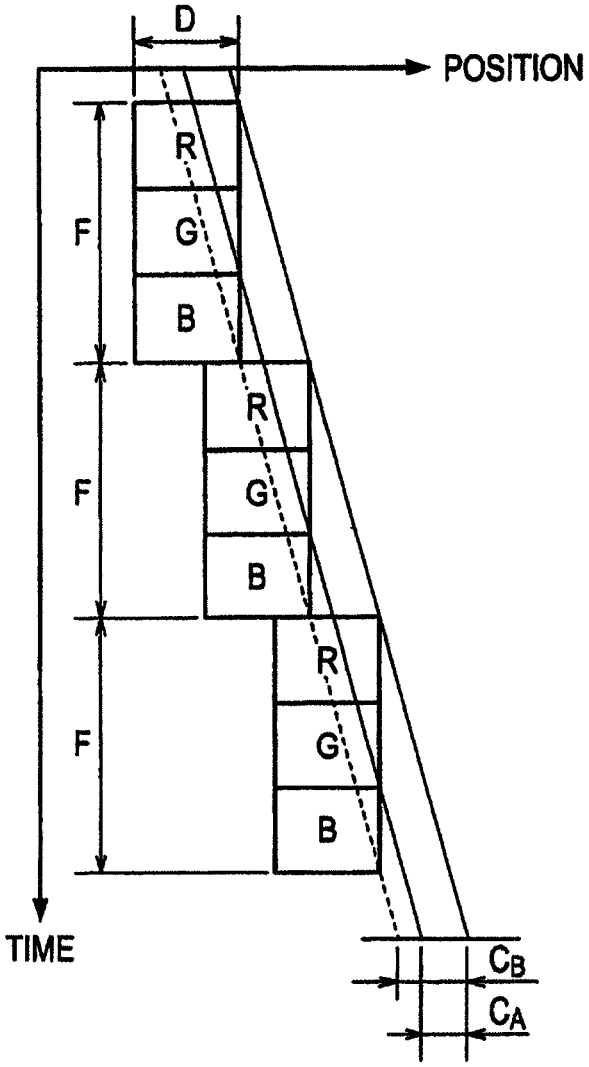
FIG. 7 is a diagram that schematically illustrates an example of the widths of a color breakup and a moving-picture blur that occur when a display device of a related art is adopted.
Figure 8:
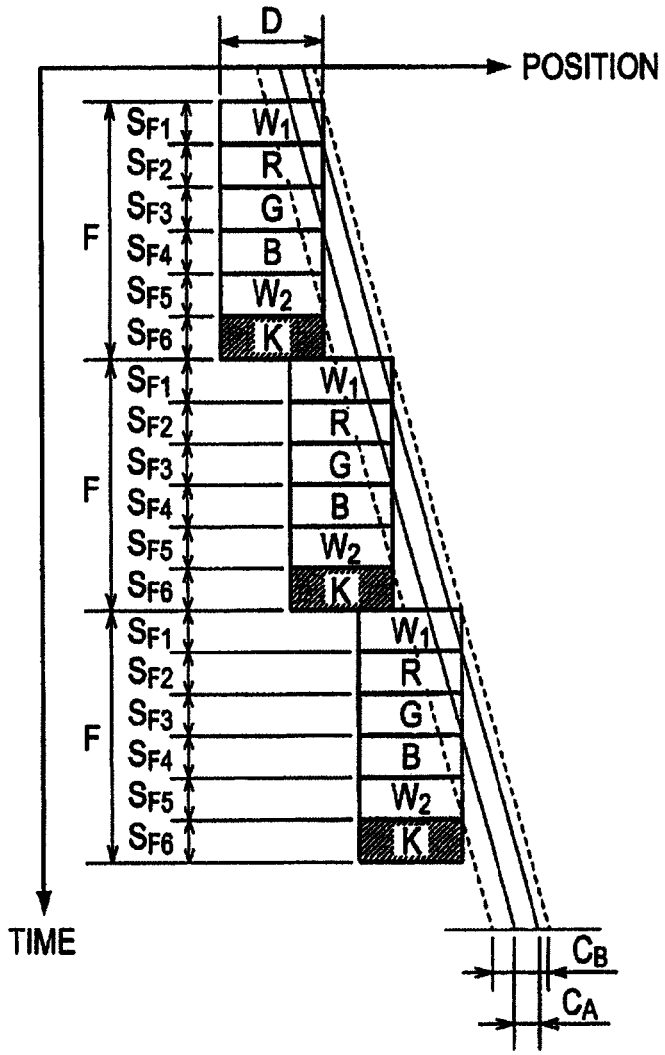
FIG. 8 is a diagram that schematically illustrates an example of the widths of a color breakup and a moving-picture blur that occur when a display device according to the exemplary embodiment A1 of the invention is adopted.

As illustrated in FIG. 6, it is assumed here that a subject image P that has a rectangular shape moves to the right at a substantially constant moving speed against a black background. The imaging-target object P has a horizontal dimension of D. It is further assumed here that subject image P moves straight along a line L. Under these assumptions, a change in the display color thereof that is observed on the line L as time elapses is studied below. FIG. 7 is a diagram that illustrates an example of a display color change that is observed when a configuration of the related art in which single-color images that correspond to primary color components R, G, and B only are displayed is adopted. FIG. 8 is a diagram that illustrates an example of a display color change that is observed when the configuration of the image display device 100 according to the present embodiment of the invention in which single-color images that correspond to white components W1 and W2 as well as single-color images that correspond to primary color components R, G, and B are displayed is adopted. In each of FIGS. 7 and 8, the vertical axis represents time. The horizontal axis represents a transverse position, that is, a position measured in a horizontal direction.

As illustrated in Each of FIGS. 7 and 8, the imaging-target object P moves to the right at each point in time of a change from one frame F to another frame F. In other words, the position of the subject image P does not change during one frame F. In contrast, a visual point of a user who observes the display screen thereof, or simply said, observer's eyes, moves to the right at a substantially constant moving speed in order to follow the movement of the subject image P. As explained above, the actual movement of the subject image P differs from the movement of a visual point of an observer. Therefore, a user perceives a color breakup in the proximity of the left edge and the right edge of the moving subject image P. The width CA shown in each of FIGS. 7 and 8 indicates a range in which a color breakup is perceived at one edge of the subject image P. In the following description, this is referred to as a "color breakup width".

The color breakup width CA increases as a time period during which single-color images of primary color components are displayed becomes longer. In comparison with the related-art configuration illustrated in FIG. 7 in which single-color images that correspond to primary color components R, G, and B only are displayed, in the configuration of the image display device 100 according to the present embodiment of the invention in which single-color images that correspond to white components W1 and W2 as well as single-color images that correspond to primary color components R, and B are displayed, the length of time period for displaying primary-color-component single-color images becomes shorter by the length of time period for displaying white-component single-color images. For this reason, if the configuration of the image display device 100 according to the present embodiment of the invention is adopted, as illustrated in FIG. 8, the color breakup width CA indicating a range in which a user perceives a color breakup becomes smaller in comparison with the related-art color breakup width CA illustrated in FIG. 7.

In addition to the above-described color breakup, since the actual movement of the subject image P differs from the movement of a visual point of a user, the user perceives a blurred outline of the moving subject image P. In the following description, this obscure contour phenomenon is referred to as a "moving-picture blur". The width CB shown in each of FIGS. 7 and 8 indicates a range in which a moving-picture blur is perceived at one edge of the subject image P. This is a dimension indicating a range in which a user perceives a blurred outline of the moving subject image P. In the following description, this is referred to as a "moving-picture blur width". The moving-picture blur width CB increases as a time period during which single-color images of primary color components or single-color images of white components are displayed becomes longer. In connection with the above fact, in the configuration of the image display device 100 according to the present embodiment of the invention, the sub-field SF6 during which a black image is displayed is allocated in each frame F in addition to the sub-fields SF2, SF3, and SF4 during which single-color images that correspond to three primary color components of R, G, and B respectively are displayed and the sub-fields SF1 and SF5 during which single-color images that correspond to the first white component W1 and the second white component W2 respectively are displayed. The sub-field SF6 is a non-image-display sub-field to which a reference numeral K is assigned in the accompanying drawings. In comparison with the related-art configuration illustrated in FIG. 7 in which single-color images that correspond to primary color components R, G, and B only are displayed, in the configuration of the image display device 100 according to the present embodiment of the invention in which the sub-field SF6 during which no single-color image is displayed is allocated in each frame F, the length of time period for displaying primary-color-component single-color images and white-component single-color images becomes shorter by the length of time period of the sub-field SF6. For this reason, if the configuration of the image display device 100 according to the present embodiment of the invention is adopted, as illustrated in FIG. 8, the moving-picture blur width CB indicating a range in which a user perceives a moving-picture blur becomes smaller in comparison with the related-art moving-picture blur width CB illustrated in FIG. 7.

In the aforementioned related art described in JP-A-2002-169515 according to which a single-color image of a white component that is extracted from a display color specified by an input image signal S1 is displayed in only one sub-field SF unlike the present embodiment of the invention, the gradation of the single-color image of the white component is significantly higher than that of the single-color images of other color components especially if the display color of an image is close to white. For this reason, in the aforementioned related art described in JP-A-2002-169515, an observer perceives conspicuous flickers because single-color images of primary color components each having a low gradation and a single-color image of a white component having a high gradation are displayed in a field-sequential manner. In contrast, in the configuration of the image display device 100 according to the present embodiment of the invention, as has already been explained earlier, if the combined gradation of the pre-separation "white" component (corresponding to W1+W2), or in other words, the minimum value Gmin, contained in a display color specified by the input image signal S1 is greater than the threshold value TH1, the pre-separation white component is split into the first actual white component W1 and the second actual white component W2 at the boundary of the threshold value TH1 in the white extraction process. Then, these split white components are respectively displayed in separate sub-fields SF that are "time-isolated" from each other; specifically, the first white component W1 is displayed in the first sub-field SF1 whereas the second white component W2 is displayed in the fifth sub-field SF5 in the illustrated configuration thereof according to the present embodiment of the invention. Therefore, it is possible to ensure that the gradation (i.e., brightness, or in other words, luminance) of a single-color image of each split white component never exceeds the threshold value TH1. This means that a difference between the gradations of primary-color-component single-color images and the gradations of white-component single-color images is made smaller. Therefore, even in a case where an image having a display color close to white is displayed, the image display device 100 according to the present embodiment of the invention can make flickers substantially less conspicuous in comparison with the aforementioned related art described in JP-A-2002-169515, which is a non-limiting advantage offered by the present embodiment of the invention.

In addition to the above-described factor, how much a user perceives flickers depends also on the cycles of emission of light to the monitoring side (i.e., observer's side) and on the time percentage of the emission of light to the monitoring side in the entire time length of one frame F. In the following description, the frequency of emission of light to the monitoring side is referred to as a "light-emission frequency", whereas the ratio of the time length of the emission of light to the monitoring side to the entire time length of one frame F is referred to as a "light-emission duty". As a light-emission frequency and/or a light-emission duty increase, flickers decrease. If the black-image subfield SF6 is inserted in each frame F in order to provide a technical solution to the problem of a motion-picture blur explained above while referring to FIGS. 7 and 8, a light-emission duty becomes lower in comparison with a case where the black-image subfield SF6 is not inserted in each frame F. Accordingly, from this particular viewpoint, the insertion of the black-image subfield SF6 in each frame F acts unfavorably to increase flickers. On the other hand, the display of split white components in separate sub-fields SF, specifically, in the W1-component subfield SF1 and the W2-component subfield SF5 (in the illustrated configuration of the image display device 100 according to the present embodiment of the invention), which are distanced from each other on a time axis, is technically equivalent to the increasing of a light-emission frequency, which acts favorably to decrease flickers. To sum up, in the configuration of the image display device 100 according to the present embodiment of the invention, it is possible to offset an increase in flickers due to the insertion of a black-image display by a decrease therein achieved by the time-separated (i.e., "time-distanced") display of split white components.

Embodiment A2

Next, an exemplary embodiment A2 of the invention is explained below. In the foregoing exemplary embodiment A1 of the invention, it is explained that a display color specified by the input image signal S1 is separated into a plurality of primary color components and a plurality of white components. In contrast, the image-processing unit 40 of the image display device 100 according to the present embodiment of the invention generates a color separation image signal S2 as a result of the separation of a display color specified by the input image signal S1 into a complementary color component that is formed as a result of the mixture of two primary color components, a plurality of white components, and a primary color component that remains after the mixture of two primary color components. In the following description, the above-described complementary color component that is formed as a result of the mixture of two primary color components is referred to as a "mixed color component".

In addition to the gradation G2_W1 of the first white component W1 and the gradation G2_W2 of the second white component W2 as well as the gradation G2_R of the R component, the gradation G2_G of the G component, and the gradation G2_B of the B component, which are the same as those specified by the color separation image signal S2 generated by the image-processing unit 40 according to the foregoing embodiment A1 of the invention, the color separation image signal S2 generated by the image-processing unit 40 according to the present embodiment A2 of the invention further specifies the gradation G2_Y of a yellow (Y) component, the gradation G2_C of a cyan (C) component, and the gradation G2_M of a magenta (M) component. Hereafter, the yellow component, the cyan component, and the magenta component may be referred to as a "Y component", a "C component", and an "M component", respectively. The yellow component is the mixed color component obtained as a result of the mixture of the red component and the green component. The cyan component is the mixed color component obtained as a result of the mixture of the green component and the blue component. The magenta component is the mixed color component obtained as a result of the mixture of the blue component and the red component.

Figure 9:
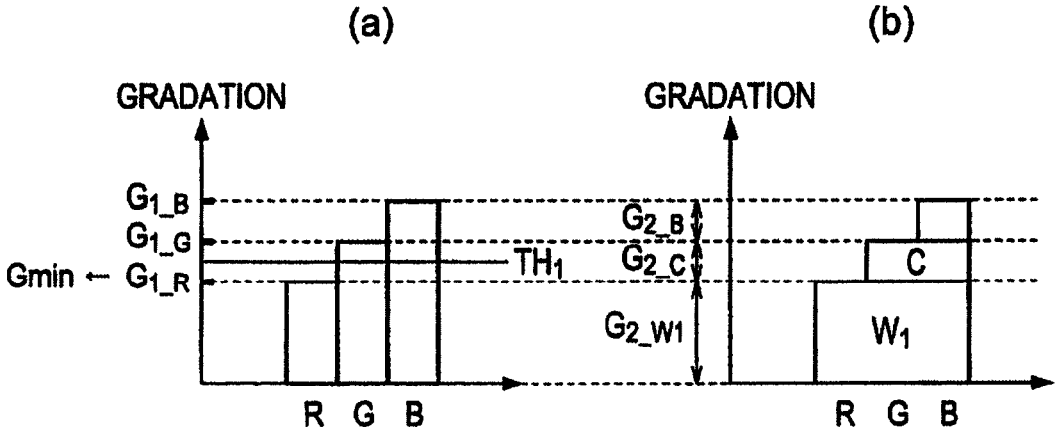
FIG. 9 is a diagram that schematically illustrates a specific example of the generation of a separation image signal according to an exemplary embodiment A2 of the invention.
Figure 10:
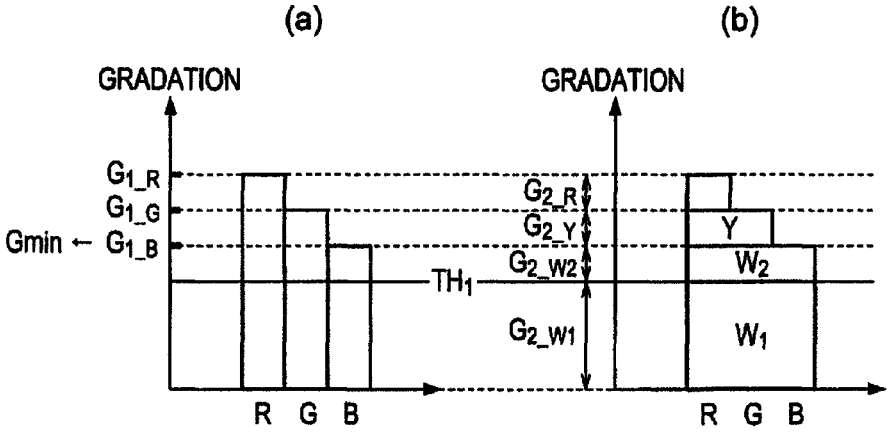
FIG. 10 is a diagram that schematically illustrates a specific example of the generation of a separation image signal according to an exemplary embodiment A2 of the invention.

A non-limiting example of the inputted gradation values of three primary color components, that is, the gradation G1_R of the R component, the gradation G1_G of the G component, and the gradation G1_B of the B component, which are individually specified by the input image signal S1, is illustrated in each of the left portion (a) of FIG. 9 and the left portion (a) of FIG. 10. In a first example of a display color that is illustrated in the left portion (a) of FIG. 9, the gradation G1_R of the R component is the smallest among the inputted gradation values of three primary color components. In this example, the minimum value Gmin (i.e., G1_R) is smaller than the threshold value TH1. As done in the foregoing exemplary embodiment A1, in a case where the minimum value Gmin is smaller than the threshold value TH1, an example of which is illustrated in the left portion (a) of FIG. 9, the image-processing unit 40 generates a color separation image signal S2 that sets the minimum value Gmin identified in the previous step S1 as the gradation G2_W1 of the first white component W1 and further sets zero as the gradation G2_W2 of the second white component W2.

Then, the image-processing unit 40 sets a gradation value for a mixed color component that is formed as a result of the mixture of two primary color components among all three thereof, where the above-mentioned two primary color components are selected so as not to include the remaining one thereof that has the minimum inputted gradation value Gmin. For example, in a case where the gradation G1_R of the R component is identified as the minimum value Gmin, an example of which is illustrated in the left portion (a) of FIG. 9, the image-processing unit 40 sets a gradation value G2_C for a mixed color component of cyan (C) on the basis of the gradation G1_G of the G component and the gradation G1_B of the B component as illustrated in the right portion (b) of FIG. 9. As understood from the right portion (b) of FIG. 9, the gradation G2_C of the C component is calculated as a value obtained after the subtraction of the minimum value Gmin from the smaller one of the gradation G1_G of the G component and the gradation G1_B of the B component. In the illustrated example, since the gradation G1_G of the G component is smaller than the gradation G1_B of the B component, the gradation G2_C of the C component is calculated by subtracting the minimum value Gmin from the gradation G1_G of the G component. It should be noted that the gradation G2_C of the C component is equal to the result of the subtraction of the gradation G2_W1 of the first white component W1 from the smaller one of the gradation G1_G of the G component and the gradation G1_B of the B component, which is, the former in this example. Next, the image-processing unit 40 sets a gradation value for a primary color component that remains after the separation, that is, after the subtraction, of the first white component W1 and the mixed color component (i.e., the C component in the first example illustrated in FIG. 9). For example, the gradation G2_B of the B component that remains after the separation of the first white component W1 and the mixed color component C is set at a value that is calculated as the result of subtracting both the gradation G2_C of the C component and the minimum value Gmin (i.e., the gradation G2_W1 of the first white component W1) from the pre-separation gradation G1_B of the B component. The remaining gradation G2_B of the B component after the separation is shown in the right portion (b) of FIG. 9. It should be particularly noted that the gradations of primary color components that do not remain after the separation of a mixed color component and the first white component W1 are specified as zero. In addition, it should be further noted that the gradations of mixed color components that contain the smallest primary color component whose inputted gradation value constitutes the minimum value Gmin are also specified as zero. For example, in the first example shown in FIG. 9, since the gradations of the R component and the G component do not remain after the separation of the mixed color component C and the first white component W1, each of the gradation G2_R of the R component and the gradation G2_G of the G component is set as zero. Similarly, each of the gradation G2_Y of the mixed color component Y and the gradation G2_M of the mixed color component M that contain the smallest primary color component R whose inputted gradation value constitutes the minimum value Gmin is set as zero.

On the other hand, in a second example of a display color that is illustrated in the left portion (a) of FIG. 10, the gradation G1_B of the B component is the smallest among the inputted gradation values of three primary color components. Unlike the foregoing first example illustrated in the left portion (a) of FIG. 9, however, in this example, the minimum value Gmin (i.e., G1_B) is larger than the threshold value TH1. As done in the foregoing exemplary embodiment A1, in a case where the minimum value Gmin is larger than the threshold value TH1, an example of which is illustrated in the left portion (a) of FIG. 10, the image-processing unit 40 generates a color separation image signal S2 that sets the threshold TH1 as the gradation G2_W1 of the first white component W1 and further sets a difference value between the minimum value Gmin (i.e., G1_B) and the threshold value TH1 as the gradation G2_W2 of the second white component W2.

Then, as done in the foregoing first example illustrated in FIG. 9, the image-processing unit 40 sets a gradation value for a mixed color component that is formed as a result of the mixture of two primary color components among all three thereof, where the above-mentioned two primary color components are selected so as not to include the remaining one thereof that has the minimum inputted gradation value Gmin. Specifically, in a case where the gradation G1_B of the B component is identified as the minimum value Gmin, an example of which is illustrated in the left portion (a) of FIG. 10, the image-processing unit 40 sets a gradation value G2_Y for a mixed color component of yellow (Y) on the basis of the gradation G1_R of the R component and the gradation G1_G of the G component as illustrated in the right portion (b) of FIG. 10. As understood from the right portion (b) of FIG. 10, the gradation G2_Y of the Y component is calculated as a value obtained after the subtraction of the minimum value Gmin from the smaller one of the gradation G1_R of the R component and the gradation G1_G of the G component. In the illustrated example, since the gradation G1_G of the G component is smaller than the gradation G1_R of the R component, the gradation G2_Y of the Y component is calculated by subtracting the minimum value Gmin from the gradation G1_G of the G component. It should be noted that the gradation G2_Y of the Y component is equal to the result of the subtraction of a combined white component value (a value calculated as a result of addition of the gradation G2_W2 of the second white component W2 to the gradation G2_W1 of the first white component W1) from the smaller one of the gradation G1_R of the R component and the gradation G1_G of the G component, which is, the latter in this example. Then, the image-processing unit 40 sets the gradation G2_R of the R component that remains after the separation of the first white component W1, the second white component W2, and the mixed color component Y at a value that is calculated as the result of subtracting both the gradation G2_Y of the Y component and the minimum value Gmin from the pre-separation gradation G1_R of the R component. It should be particularly noted that the gradations of primary color components that do not remain after the separation of a mixed color component, the first white component W1, and the second white component W2 are specified as zero. In addition, it should be further noted that the gradations of mixed color components that contain the smallest primary color component whose inputted gradation value constitutes the minimum value Gmin are also specified as zero. For example, in the second example shown in FIG. 10, since the gradations of the G component and the B component do not remain after the separation of the mixed color component Y, the first white component W1, and the second white component W2, each of the gradation G2_G of the G component and the gradation G2_B of the B component is set as zero. Similarly, each of the gradation G2_C of the mixed color component C and the gradation G2_M of the mixed color component M that contain the smallest primary color component B whose inputted gradation value constitutes the minimum value Gmin is set as zero.

Figure 11:
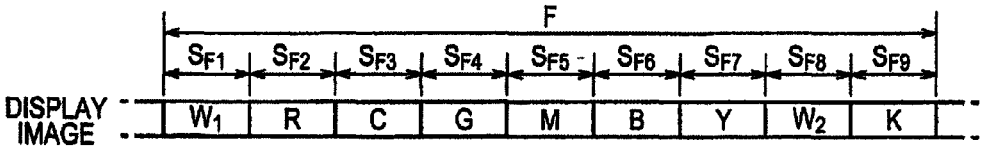
FIG. 11 is a timing chart that schematically illustrates an example of the timing operation of a display device according to the exemplary embodiment A2 of the invention.

As illustrated in FIG. 11, each frame F is time-divided into a plurality of sub-fields. In the illustrated embodiment of the invention, one frame F is time-divided into nine sub-fields, which are denoted as SF1, SF2, SF3, SF4, SF5, SF6, SF7, SF8, and SF9. The controlling unit 50 controls the illumination device 10 and the liquid crystal device 20 so that the illumination device 10 and the liquid crystal device 20 should display a plurality of images each of which corresponds to an individual single color component (a primary color component, a mixed color component, or a white component) whose gradation is specified by the color separation image signal S2 in corresponding one of the sub-fields SF1 through SF8 in a field sequential manner.

The mixed-color subfields SF during which single-color images of mixed color components are displayed and the primary-color subfields SF during which single-color images of primary color components are displayed are arrayed in an alternate order. Specifically, as illustrated in FIG. 11, the single-color images of the primary color components R, G, and B are displayed in the sub-fields SF2, SF4, and SF6, respectively, whereas the single-color images of the mixed color components C, M, and Y are displayed in the sub-fields SF3, SF5, and SF7, respectively so as to provide a sequential display as a whole. It should be noted that, in the mixed-color subfields SF3, SF5, and SF7 during which the single-color images of the mixed color components C, M, and Y are displayed, respectively, the illumination-device driving circuit 52 controls all of the red light-emitting element 12R, the green light-emitting element 12G, and the blue light-emitting element 12B so that the corresponding two of the light-emitting elements 12R, 120, and 12B that form a desired mixed color should emit light in each of these mixed-color subfields SF. For example, in the third sub-field SF3, the illumination-device driving circuit 52 commands the light-emitting elements 12G and 12B to concurrently emit light so as to irradiate mixed light of the C component onto the liquid crystal device 20.

The single-color images of a plurality of white components, that is, the first white component W1 and the second white component W2 in this embodiment of the invention, are displayed in the first sub-field SF1 that is allocated immediately before the color-component subfields SF2 through SF7 during which the single-color images of the primary color components and the mixed color components are displayed and in the eighth sub-field SF8 that is allocated immediately thereafter. In the last sub-field SF9 of each frame F, as done in the foregoing exemplary embodiment A1, a black image K is displayed in all of pixels. In other words, display is suspended in the last sub-field SF9.

The same advantageous effects as those offered by the configuration of the image display device 100 according to the foregoing exemplary embodiment A1 of the invention are offered with the configuration of the image display device 100 according to the present embodiment A2 of the invention. The aforementioned problem of a color breakup is conspicuous especially if the single-color images of a plurality of primary color components are displayed successively on a time axis. In the sub-field configuration of the image display device 100 according to the present embodiment A2 of the invention, as has already been explained above, a mixed-color subfield SF during which the single-color image of a mixed color component is displayed is interposed each between "otherwise adjacent" two primary-color subfields SF during each of which the single-color image of a primary color component is displayed. Therefore, in comparison with the sub-field configuration of the image display device 100 according to the foregoing exemplary embodiment A1 of the invention in which the primary-color subfields SF during each of which the single-color image of a primary color component is displayed are arrayed actually adjacent to each other on a time axis (i.e., follows one after another in a successive manner), it is possible to achieve a further greater reduction in the aforementioned color-breakup phenomenon in an image visually perceived by a user who observes the display screen thereof.

Figure 12:
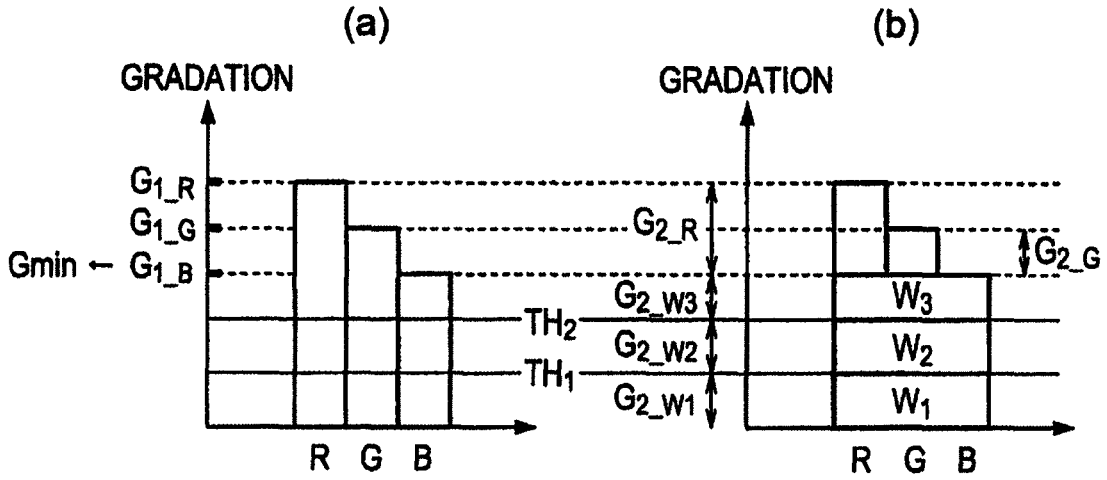
FIG. 12 is a diagram that schematically illustrates an example of the generation of a separation image signal according to a variation example of the exemplary embodiments A1 and A2 of the invention.

In each of the foregoing exemplary embodiments A1 and A2 of the invention, in order to simplify explanation, it is assumed that the first white component W1 and the second white component W2, that is, two white components only, are extracted from an inputted display color. However, the scope of the invention is not limited to such an exemplary configuration. That is, the number of white components split after the extraction (i.e., separation) thereof may be arbitrary modified. For example, three white components W1, W2, and W3 may be extracted from a display color specified by an input image signal S1. Specifically, if an inputted image signal S1 specifies an inputted display color that is illustrated in the left portion (a) of FIG. 12, the image-processing unit 40 generates a color separation image signal S2 that sets the threshold TH1 as the gradation G2_W1 of the first white component W1 and further sets a difference value between the threshold value TH2 and the threshold value TH1 as the gradation G2_W2 of the second white component W2 where the threshold value TH2 is preset as a value larger than the threshold value TH1. In addition, in the generated color separation image signal S2, the image-processing unit further sets a difference value between the minimum value Gmin (which is G1_B in the illustrated example of FIG. 12) and the threshold value TH2 as the gradation G2_W3 of the third white component W3.

Figure 13:
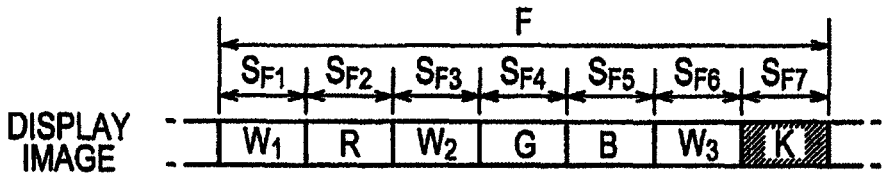
FIG. 13 is a timing chart that schematically illustrates an example of the timing operation of a display device according to a variation example of the exemplary embodiments A1 and A2 of the invention.
Figure 14:
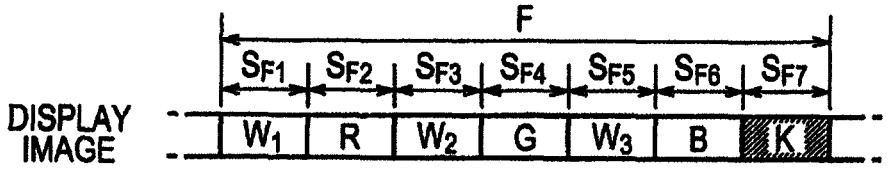
FIG. 14 is a timing chart that schematically illustrates an example of the timing operation of a display device according to a variation example of the exemplary embodiments A1 and A2 of the invention.

As illustrated in FIG. 13, each frame F is time-divided into seven sub-fields, which are denoted as SF1, SF2, SF3, SF4, SF5, SF6, and SF7. The single-color images of the primary color components R, G, and B are displayed in the sub-fields SF2, SF4, and SF5, respectively, whereas the single-color images of the first, second, and third white components W1, W2, and W3 are displayed in the sub-fields SF1, SF3, and SF6, respectively so as to provide a sequential display as a whole. It should be noted that the display order, that is, sub-field arrangement order, of the single-color images of these primary color components and white components is not restrictively specified herein. As a non-limiting modification example thereof, as illustrated in FIG. 14, the single-color images of the primary color components R, G, and B may be displayed in even sub-fields of SF2, SF4, and SF6, respectively, whereas the single-color images of the first, second, and third white components W1, W2, and W3 may be displayed in odd sub-fields of SF1, SF3, and SF5, respectively so as to provide a sequential display as a whole. Although a modification example of the foregoing exemplary embodiment A1 of the invention is explained above, needless to say, the same modification, that is, the increased split number of white components after or in the course of color-separation/white-extraction) may be applied to the foregoing exemplary embodiment A2 of the invention.

Embodiment B1

Figure 15:
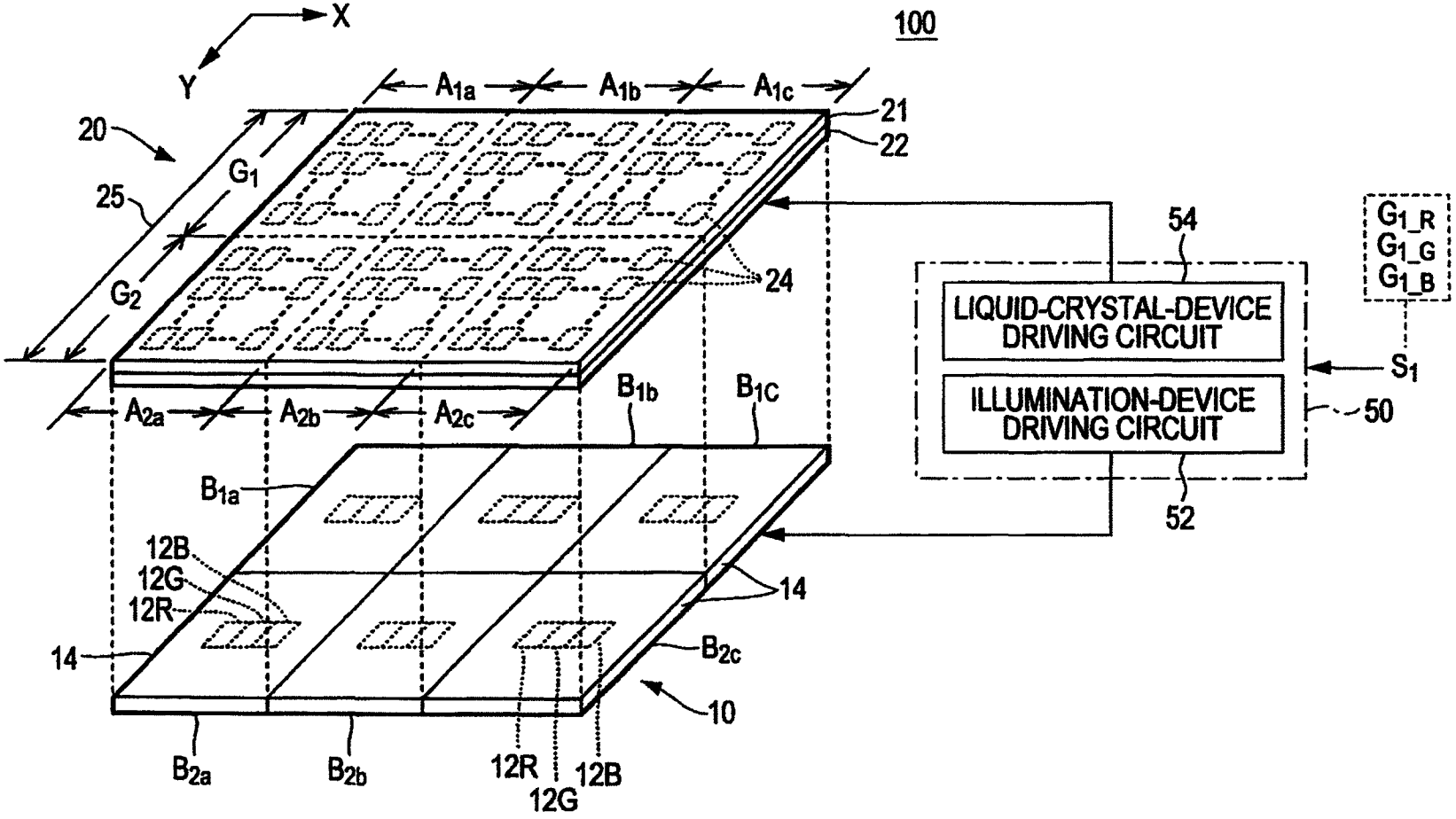
FIG. 15 is a diagram that schematically illustrates an example of the configuration of a display device according to an exemplary embodiment B1 of the invention.

FIG. 15 is a diagram that schematically illustrates an example of the configuration of a display device according to an exemplary embodiment B1 of the invention. As illustrated in FIG. 15, an image display device 100 is provided with an illumination device 10, a liquid crystal device 20, and a controlling unit 50. For the purpose of illustration, a distance is provided between the illumination device 10 and the liquid crystal device 20 in FIG. 15. However, needless to say, the illumination device 10 and the liquid crystal device 20 are provided close to each other in the actual implementation of the invention.

As shown in FIG. 15, a rectangular image display area 25 of the liquid crystal device 20 in which images are displayed is made up of two image display sub-areas G1 and G2. These image display sub-areas G1 and G2 are demarcated adjacent to each other as viewed in the Y direction. A plurality of pixel electrodes 24 is arrayed in the image display area 25. The first-mentioned image display sub-area G1 is subdivided into three of unit display areas A1*a*, A1*b*, and A1*c*. These unit display areas A1*a*, A1*b*, and A1*c* are arrayed along the X direction. In the denomination (i.e., naming) of "unit display area", the term "unit" is used in the meaning of "unitary" or the like. Accordingly, the term "unit display area" may be reworded as "unitary display area" in the following description. In like manner, the second-mentioned image display sub-area G2 is subdivided into three of unit display areas A2*a*, A2*b*, and A2*c*. These unit display areas A2*a*, A2*b*, and A2*c* are also arrayed along the X direction. That is, the image display area 25 of the liquid crystal device 20 includes these six unit display areas A1*a*, A1*b*, A1*c*, A2*a*, A2*b*, and A2*c*, which are arrayed in an X-Y matrix pattern. In the following description, these six unit display areas A1*a*, A1*b*, A1*c*, A2*a*, A2*b*, and A2*c* are collectively referred to as "unit display areas A" (unitary display areas A). Each of the unit display areas A is a rectangular region that has the same dimension as those of others. The plurality of pixel electrodes 24 is arrayed in an X-Y matrix pattern in each of the unit display areas A.

The illumination device 10 illustrated in FIG. 15 is made up of six area illumination units B1*a*, B1*b*, B1*c*, B2*a*, B2*b*, and B2*c*, which correspond to the above-mentioned six unit display areas A1*a*, A1*b*, A1*c*, A2*a*, A2*b*, and A2*c*, respectively. In the denomination of "area illumination unit", the term "unit" is used in the meaning of "section", "portion", or the like. Accordingly, the term "area illumination unit" may be reworded as "area illumination section" in the following description. In addition, in the following description, these six area illumination units B1*a*, B1*b*, B1*c*, B2*a*, B2*b*, and B2*c* are collectively referred to as "area illumination units B" (area-illuminating sections B). As illustrated in FIG. 15, each of the area-illuminating sections (i.e., area illumination units) B and the corresponding one of the unitary display areas (i.e., unit display areas) A overlap each other as viewed in a direction perpendicular to the X-Y plane of the image display area 25, that is, in a plan view. For example, the unitary display area A1*a* and the area-illuminating section B1*a* overlap each other in a plan view. In like manner, the unitary display area A1*b* and the area-illuminating section B1*b* overlap each other in a plan view. The same holds true for the remaining four sets of the unit display areas A and the area illumination units B. Accordingly, as illustrated in FIG. 15, the above-mentioned six area illumination units B are arrayed in an X-Y matrix pattern.

Each of the area illumination units B of the illumination device 10 has three light-emitting elements 12 and a light-guiding plate 14, the latter of which is configured as an optical waveguide board. These three light-emitting elements 12 are made up of a red light-emitting element 12R, a green light-emitting element 12Q and a blue light-emitting element 12B, which correspond to three primary colors of R, G, and B, respectively. The optical waveguide board 14 guides light that has been emitted thereto from each of the red light-emitting element 12R, the green light-emitting element 120 and the blue light-emitting element 12B toward the unit display areas A of the liquid crystal device 20. The red light-emitting element 12R emits red light, that is, light having a wavelength that corresponds to a red color component. The green light-emitting element 12G outputs green light, that is, light having a wavelength that corresponds to a green color component. The blue light-emitting element 12R outputs blue light, which is light having a wavelength that corresponds to a blue color component. In actual implementation of the invention, a light-reflecting plate and a light-scattering plate are adhered to the light-guiding plate 14 of the image display device 100. In order to simplify explanation, however, these light-reflecting plate and light-scattering plate are omitted from the drawing.

Figure 16:
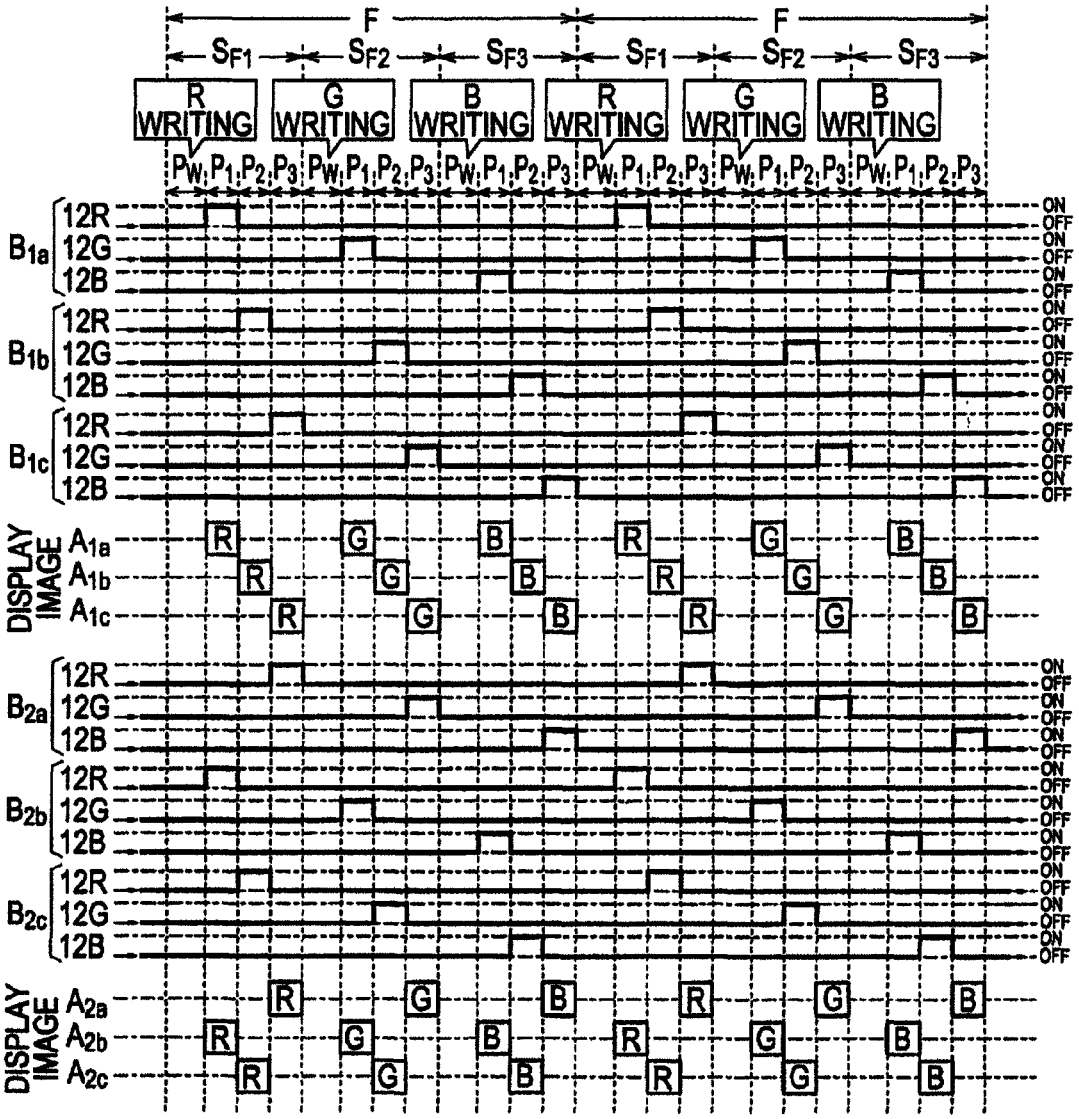
FIG. 16 is a timing chart that schematically illustrates an example of the timing operation of a display device according to the exemplary embodiment B1 of the invention.

The illumination device 10 and the liquid crystal device 20 function in cooperation with each other so as to display a color image. FIG. 16 is a timing chart that schematically illustrates an example of the timing operations of the illumination device 10 and the liquid crystal device 20 according to an exemplary embodiment of the invention. A frame F that is shown in FIG. 16 is a unitary time period that is used for displaying one color image (e.g., full-color image). The liquid crystal device 20 displays an image at a frame frequency of 120 Hz, which is double-speed display. Therefore, the time length of each frame F is 1/120 second.

In the illustrated embodiment of the invention, each frame F is time-divided into three sub-fields SF1, SF2, and SF3, which correspond to three primary color components without any redundancy nor duplication among them. The illumination device 10 and the liquid crystal device 20 sequentially display the single-color image of a corresponding primary color component in each of these three sub-fields SF1, SF2, and SF3 that are allocated in the frame F. That is, the illumination device 10 and the liquid crystal device 20 perform so-called field sequential display. A user who observes the display screen of the image display device 100 views these single-color images displayed in the respective sub-fields SF in a sequential manner. As a result thereof, they (i.e., the user) visually perceive a color image that is formed as a mixture of these individual single color components. For this reason, it is not necessary to provide any coloration layer such as a color filter or the like in the configuration of the liquid crystal device 20.

The controlling unit 50 illustrated in FIG. 15 is a circuit that controls the operations of the image display device 10 and the liquid crystal device 20. The controlling unit 50 is provided with an illumination-device driving circuit 52, which drives the illumination device 10, and a liquid-crystal-device driving circuit 54, which drives the liquid crystal device 20. As illustrated in FIG. 15, an input image signal S1 is supplied from an external device that is not shown in the drawing to the controlling unit 50. The input image signal S1 individually specifies a gradation value for each of three primary color components, that is, R color component (i.e., R component), G color component (i.e., G component), and B color component (i.e., B component), which make up the display color of a pixel.

As illustrated in FIG. 16, each sub-field SF is further time-divided into one writing time period PW and three display time periods P1, P2, and P3. The liquid-crystal-device driving circuit 54 sets the electric potential (i.e., voltage) of each of the pixel electrodes 24 at a data electric potential that is in accordance with a gradation value specified by an input image signal S1 for each one of three primary color components in the writing time period PW of the corresponding sub-field SF during which the single-color image of the above-mentioned each one primary color component is displayed.

To be more specific, for example, the liquid-crystal-device driving circuit 54 supplies, to each of the pixel electrodes 24, a data electric potential that is in accordance with a gradation value G1_R specified by an input image signal S1 for the R component of each pixel in the writing time period PW of the first sub-field SF1 during which a single-color image corresponding to the R component is displayed. This operation is called as "R writing". In like manner, the liquid-crystal-device driving circuit 54 supplies, to each of the pixel electrodes 24, a data electric potential that is in accordance with a gradation value G1_G specified by the input image signal S1 for the G component of each pixel in the writing time period PW of the second sub-field SF2 during which a single-color image corresponding to the G component is displayed. The liquid-crystal-device driving circuit 54 supplies, to each of the pixel electrodes 24, a data electric potential that is in accordance with a gradation value G1_B specified by the input image signal S1 for the B component of each pixel in the writing time period PW of the third sub-field SF3 during which a single-color image corresponding to the B component is displayed. These operations are called as "G writing" and "B writing", respectively. The transmission factors of liquid crystal that are set during the display time periods P1, P2, and P3 are determined in accordance with the respective data electric potentials that are set for the pixel electrodes 24 during the respective writing time periods PW.

The illumination-device driving circuit 52 illustrated in FIG. 15 controls the ON/OFF state of each of the plurality of light-emitting elements 12, that is, the red light-emitting element 12R, the green light-emitting element 12G, and the blue light-emitting element 12B of each of the aforementioned area illumination units B in a sequential manner. More specifically, in each of three sub-fields SF during which the single-color image of the corresponding one of three primary color components is displayed, the illumination-device driving circuit 52 commands the light-emitting elements 12 of the corresponding one of three primary color components (i.e., 12R, 12G, or 12B) provided in the above-mentioned three area illumination units B1*a*, B1*b*, and B1*c* that are arrayed opposite to the above-mentioned three unit display areas A1*a*, A1*b*, and A1*c* of the first-mentioned image display sub-area G1, respectively, to emit light in a sequential manner during the display time periods P1, P2, and P3, respectively. That is, in this operation, the illumination-device driving circuit 52 commands three light-emitting elements 12, which does not mean a set of 12R, 12Q and 12B but means a group of light-emitting elements 12 of the same primary color component (R, G, or B) that are separately provided on the above-mentioned three area illumination units B1*a*, B1*b*, and B1*c*, to emit light during the display time periods P1, P2, and P3 respectively in such a manner that light emission does not occur at the same timing among them. In like manner, in each of three sub-fields SF during which the single-color image of the corresponding one of three primary color components is displayed, the illumination-device driving circuit 52 commands the light-emitting elements 12 of the corresponding one of three primary color components provided in the above-mentioned three area illumination units B2*b*, B2*c*, and B2*a* that are arrayed opposite to the above-mentioned three unit display areas A2*b*, A2*c*, and Ata of the second-mentioned image display sub-area G2, respectively, to emit light in a sequential manner during the display time periods P1, P2, and P3, respectively. That is, in this operation, the illumination-device driving circuit 52 commands three light-emitting elements 12, which does not mean a set of 12R, 12G, and 12B but means a group of light-emitting elements 12 of the same primary color component that are separately provided on the above-mentioned three area illumination units B2*b*, B2*c*, and B2*a*, to emit light during the display time periods P1, P2, and P3 respectively in such a manner that light emission does not occur at the same timing among them. It should be noted that, in each of these display time periods P1, P2, and P3, one of three area illumination units B1 (which correspond to the first-mentioned image display sub-area G1) that is currently emitting light from the light-emitting element 12 thereof is not arrayed adjacent to one of three area illumination units B2 (which correspond to the second-mentioned image display sub-area G2) that is currently emitting light from the light-emitting element 12 thereof when viewed along the Y direction.

A more specific explanation of the above is given now while referring to FIG. 16. Firstly, an attention is focused on the first-mentioned three area illumination units B1, which correspond to the first-mentioned image display sub-area G1. In the first display period P1 of the first sub-field SF1 during which a single-color image corresponding to the R component is displayed, the light-emitting element 12R of the area illumination unit B1*a* thereof emits light. Thereafter, in the second display period P2 of the same first sub-field SF1, the light-emitting element 12R of the area illumination unit B1*b* thereof emits light. Next, in the third display period P3 subsequent to the second display period P2, the light-emitting element 12R of the area illumination unit B1*c* thereof emits light. That is, the light-emitting element 12R of the area illumination unit B1 emits light in the sequential order of B1*a*, B1*b*, and B1*c* in the first sub-field SF1 (i.e., B1*a*→B1*b*→B1*c*). Next, an attention is focused on the second-mentioned three area illumination units B2, which correspond to the second-mentioned image display sub-area G2. In the first display period P1 of the first sub-field SF1, the light-emitting element 12R of the area illumination unit B2*b* thereof emits light. Thereafter, in the second display period P2 of the same first sub-field SF1, the light-emitting element 12R of the area illumination unit B2*c* thereof emits light. Next, in the third display period P3 subsequent to the second display period P2, the light-emitting element 12R of the area illumination unit B2*a* thereof emits light. That is, the light-emitting element 12R of the area illumination unit B2 emits light in the sequential order of B2*b*, B2*c*, and B2*a* in the first sub-field SF1 (i.e., B2*b*→B2*c*→B2*a*). In like manner, the light-emitting element 12G of each of these six area illumination units B emits light in a sequential manner when viewed as a whole in the second sub-field SF2, whereas the light-emitting element 12B of each of these six area illumination units B emits light in a sequential manner when viewed as a whole in the third sub-field SF3.

Therefore, in each of the display time periods P1, P2, and P3 of each of the sub-fields SF, the single-color image of the corresponding one of three primary color components is displayed in two of the above-described six unit display areas A one of which is not adjacent to the other in the X direction nor in the Y direction in such a manner that the above-mentioned two of the unit display areas A switch over (i.e., change over) from one display time period P to another display time period P in a sequential manner. Specifically, for example, as illustrated in FIG. 16, the single-color image of the R component is displayed in the unit display areas A1*a* and A2*b* during the display time period P1 of the first sub-frame SF1. Thereafter, the single-color image of the R component is displayed in the unit display areas A1*b* and A2*c* during the display time period P2 of the first sub-frame SF1. Subsequently, the single-color image of the R component is displayed in the unit display areas A1*c* and Ata during the display time period P3 of the first sub-frame SF1. In like manner, the single-color image of the G component is displayed in the corresponding two unit display areas A during each display time period P of the second sub-frame SF2 in a sequential manner when viewed as a whole, whereas the single-color image of the B component is displayed in the corresponding two unit display areas A during each display time period P of the third sub-frame SF3 in a sequential manner when viewed as a whole. Therefore, during each frame F, the single-color images of all three primary color components are displayed in each of the unit display areas A.

In the configuration of the image display device 100 according to the present embodiment of the invention, as explained above, single-color images are displayed in the unit display areas A during the sub-fields SF in a sequential manner. With such a configuration, it is possible to effectively prevent the occurrence of the aforementioned color-breakup image problem that is attributable to a difference between the actual movement of a subject image P and the movement of a visual point of a user. For example, it is assumed here that a visual point of a user who observes the display screen thereof moves to the left during the display time period P2 in which a single-color image is displayed in the unit display area A1*b*. At this point in time, the display of a single-color image in the unit display area A1*a*, which is the "destination" of the movement of the observer's eyes in the leftward direction from the unit display area A1*b*, has already been finished. For this reason, s/he (i.e., the observer) perceives no color breakup image problem due to the movement of his/her visual point. As another example, it is assumed here that a visual point of a user who observes the display screen thereof moves downward during the display time period P2 in which a single-color image is displayed in the unit display area A1*b*. At this point in time, the display of a single-color image in the unit display area A2*b*, which is the destination of the movement of the user's eyes in the downward direction from the unit display area A1*b*, has already been finished. For this reason, they (i.e., the user) perceive no color breakup image problem due to the movement of their visual point.

Embodiment B2

In the foregoing exemplary embodiment B1 of the invention, it is explained that the single-color images of three primary color components are sequentially displayed on the basis of an input image signal S1. In contrast, in the configuration of the image display device 100 according to the present embodiment of the invention, as done in the foregoing exemplary embodiment A1 of the invention, a display color specified by the input image signal S1 is separated into a plurality of primary color components and a plurality of white components.

Figure 17:
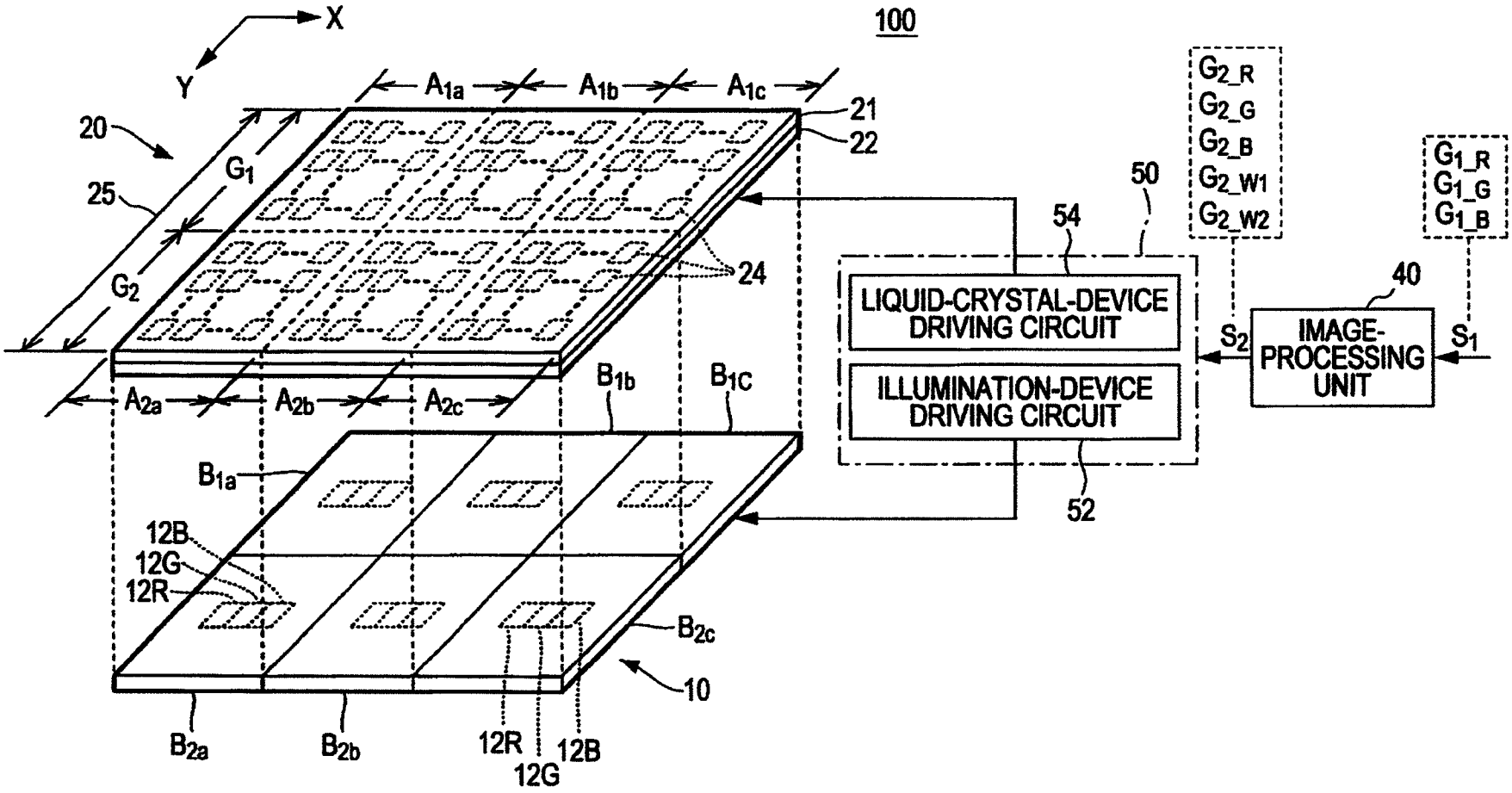
FIG. 17 is a diagram that schematically illustrates an example of the configuration of a display device according to an exemplary embodiment B2 of the invention.

FIG. 17 is a diagram that schematically illustrates an example of the configuration of a display device according to an exemplary embodiment B2 of the invention. As illustrated in FIG. 17, the image display device 100 according to the present embodiment of the invention is provided with, in addition to the same components as those of the foregoing exemplary embodiment B1 of the invention, the image-processing unit 40 as in the configuration of the image display device 100 according to the foregoing exemplary embodiment A1 of the invention. The image-processing unit 40 according to the present embodiment of the invention generates a color separation image signal S2 from an input image signal S1 that is supplied thereto from an external device that is not shown in the drawing and then outputs the generated color separation image signal S2. The color separation image signal S2 individually specifies, for each of the plurality of pixels, a gradation value for each of separated components, which are obtained in the form of a plurality of primary-color components and a plurality of white components as a result of the color separation of a display color that is specified by the input image signal S1. As illustrated in FIG. 17, the color separation image signal S2 according to the present embodiment of the invention specifies the gradation G2_W1 of the first white component W1 and the gradation G2_W2 of the second white component W2 in addition to the gradation G2_R of the R color component, the gradation G2_G of the G color component, and the gradation G2_B of the B color component. The color separation image signal S2 is generated through the same processing as that explained above while referring to FIGS. 3, 4, and 5 in the foregoing first exemplary embodiment A1 of the invention.

Figure 18:
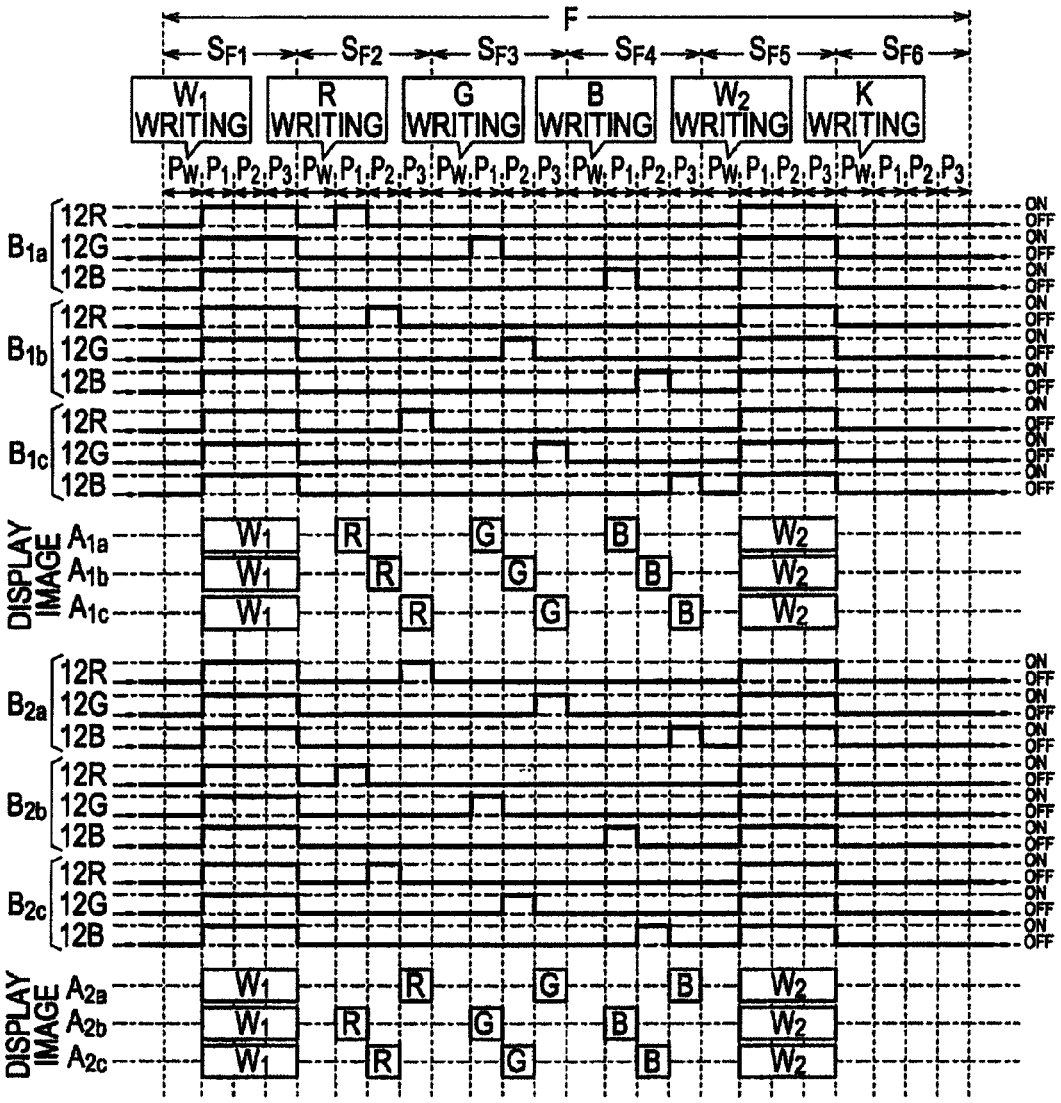
FIG. 18 is a timing chart that schematically illustrates an example of the timing operation of a display device according to the exemplary embodiment B2 of the invention.

FIG. 18 is a timing chart that schematically illustrates an example of the timing operation of the image display device 100 according to the present embodiment of the invention. As illustrated in FIG. 18, each frame F is time-divided into a plurality of sub-fields. In the illustrated embodiment of the invention, one frame F is time-divided into six sub-fields, which are denoted as SF1, SF2, SF3, SF4, SF5, and SF6. The operations of the illumination device 10 and the illumination-device driving circuit 52 during the sub-fields SF2, SF3, and SF4 in the present embodiment of the invention are the same as those during the sub-fields SF1, SF2, and SF3 in the foregoing exemplary embodiment B1 of the invention.

The illumination-device driving circuit 52 according to the present embodiment of the invention commands all three of red, green, and blue light-emitting elements 12R, 12G, and 12B provided in each of the area illumination units B to emit light during each of the first, second, and third display time periods of P1, P2, and P3 in each of the first sub-field SF1 and the fifth sub-field SF5. As a result of such light-emission control that is performed by the illumination-device driving circuit 52, white light is irradiated onto the liquid crystal device 20 during each of the first, second, and third display time periods of P1, P2, and P3 in each of the first sub-field SF1 and the fifth sub-field SF5. On the other hand, the illumination-device driving circuit 52 commands all three of the red, green, and blue light-emitting elements 12R, 12G, and 12B provided in each of the area illumination units B not to emit light during the sixth sub-field SF6. Therefore, no light is irradiated onto the liquid crystal device 20 in the sixth sub-field SF6.

As done in the foregoing exemplary embodiment B1 of the invention, the liquid-crystal-device driving circuit 54 according to the present embodiment of the invention supplies a data electric potential that is in accordance with a gradation value specified by a color separation image signal S2 for each of the pixels during the writing time period PW of each of the sub-fields SF to each of the pixel electrodes 24 corresponding to the pixel. More specifically, in the writing time period PW of each of the second, third and fourth sub-fields SF2, SF3, and SF4, the liquid-crystal-device driving circuit 54 supplies, to each of the pixel electrodes 24, a data electric potential that is in accordance with the gradation G2_R of the R component, the gradation G2_G of the G component, and the gradation G2_B of the B component that are specified in the color separation image signal S2 as the separated gradation values of three primary color components. On the other hand, in the writing time period PW of the first sub-field SF1, which is one sub-field during which white light is irradiated onto the liquid crystal device 20, the liquid-crystal-device driving circuit 54 supplies a data electric potential that corresponds to the gradation G2_W1 of the W1 component to each pixel electrode 24. This operation is called as "W1 writing". In like manner, in the writing time period PW of the fifth sub-field SF5, which is another sub-field during which white light is irradiated onto the liquid crystal device 20, the liquid-crystal-device driving circuit 54 supplies a data electric potential that corresponds to the gradation G2_W2 of the W2 component to each pixel electrode 24. This operation is called as "W2 writing". In the sixth sub-field SF6 during which the illumination device 10 switches light off so that no light should be irradiated onto the liquid crystal device 20, the liquid-crystal-device driving circuit 54 supplies, to each pixel electrode 24, a data electric potential that reduces the transmission factor of liquid crystal to the minimum value (e.g., zero). This operation is called as "K writing".

As a result of data-electric-potential control that is performed by the liquid-crystal-device driving circuit 54 as described above, a single-color image corresponding to each of a plurality of primary color components R, and B is displayed in the unit display areas A (i.e., two unit display areas A during each display time period P) in a sequential manner when viewed as a whole during the corresponding one of the second, third, and fourth sub-fields SF2, SF3, and SF4 as displayed so during the corresponding one of the first, second, and third sub-fields SF1, SF2, and SF3 in the foregoing exemplary embodiment B1 of the invention. On the other hand, a single-color image corresponding to each of a plurality of white components W1 and W2 is displayed in all of the unit display areas A in a non-sequential manner, that is, at the same time, during the corresponding one of the first sub-field SF1 and the fifth sub-field SF5. For this reason, the length of time period during which a single-color image corresponding to each of the first white component W1 and the second white component W2 is displayed in all of the unit display areas A at the same time during the corresponding one of the first sub-field SF1 (W1) and the fifth sub-field SF5 (W2) is greater than the length of time period during which a single-color image corresponding to each of three primary color components R, and B is displayed in the unit display areas A in a sequential manner when viewed as a whole during the corresponding one of the second, third, and fourth sub-fields SF2 (R), SF3 (G), and SF4 (B) because the former is displayed during all three of the display time periods P1, P2, and P3 whereas the latter is displayed during only one of these three display time periods P1, P2, and P3. It should be particularly noted that the sub-fields SF2, SF3, and SF4 during which single-color images that correspond to three primary color components of R, and B, respectively are displayed are interposed between the sub-field SF1 during which a single-color image that corresponds to the first white component W1 is displayed and the sub-field SF5 during which a single-color image that corresponds to the second white component W2 is displayed. This means that, because of the presence of a block of the R-component subfield SF2, the G-component subfield SF3, and the B-component subfield SF4 that is interposed therebetween, the W1-component subfield SF1 and the W2-component subfield SF5 are separated (i.e., distanced) from each other on a time axis. In the last sub-field SF6, a black image K is displayed in each pixel.

As explained above, in the configuration of the image display device 100 according to the present embodiment of the invention, since the first white component W1 and the second white component W2 are extracted out of a display color of each pixel, the brightness level of a single-color image of each of three primary color components of R, G, and B becomes lower in comparison with that of the foregoing exemplary embodiment B1 of the invention. No color breakup occurs in the single-color image of a white component. Therefore, in comparison with the configuration of the image display device 100 according to the foregoing exemplary embodiment B1 of the invention in which single-color images that correspond to primary color components R, G, and B only are displayed, which means that no single-color images that correspond to white components W1 and W2 are displayed, the image display device 100 according to the present embodiment of the invention makes it possible to achieve a greater reduction in the aforementioned color-breakup phenomenon in an image visually perceived by a user who observes the display screen thereof. In addition, in the configuration of the image display device 100 according to the present embodiment of the invention, the non-image-display subfield SF6 during which a black K image is displayed is allocated in each frame F in addition to the subfields SF2, SF3, and SF4 during which single-color images that correspond to three primary color components of R, and B respectively are displayed and the sub-fields SF1 and SF5 during which single-color images that correspond to the first white component W1 and the second white component W2 respectively are displayed. Therefore, in comparison with the configuration of the image display device 100 according to the foregoing exemplary embodiment B1 of the invention in which no black image K is displayed, the image display device 100 according to the present embodiment of the invention makes it possible to achieve a greater reduction in the aforementioned moving-picture blur phenomenon, that is, the visual perception of the blurred outline of a moving subject image P.

Moreover, in the configuration of the image display device 100 according to the present embodiment of the invention, as has already been explained earlier, if the combined gradation of the pre-separation "white" component (corresponding to W1+W2), or in other words, the minimum value Gmin, contained in a display color specified by the input image signal S1 is greater than the threshold value TH1, the pre-separation white component is split into the first actual white component W1 and the second actual white component W2 at the boundary of the threshold value TH1 in the white extraction process. Then, these split white components are respectively displayed in separate sub-fields SF that are "time-isolated" from each other; specifically, the first white component W1 is displayed in the first sub-field SF1 whereas the second white component W2 is displayed in the fifth sub-field SF5 in the illustrated configuration thereof according to the present embodiment of the invention. This means that a difference between the gradations of primary-color-component single-color images and the gradations of white-component single-color images is made smaller. Therefore, in comparison with, for example, the configuration of the aforementioned related art described in JP-A-2002-169515 according to which a single-color image of a white component that is extracted from a display color specified by an input image signal S1 is displayed in only one sub-field SF, the image display device 100 according to the present embodiment of the invention has an advantage in that it can reduce flickers, which is the same non-limiting advantageous effects of the invention as those offered by the image display device 100 according to the foregoing exemplary embodiment A1 of the invention. Furthermore, as is the case with the image display device 100 according to the foregoing exemplary embodiment A1 of the invention, in the configuration of the image display device 100 according to the present embodiment of the invention, it is possible to offset an increase in flickers due to the insertion of a black-image display by a decrease therein achieved by the time-separated display of split white components.

Figure 19:
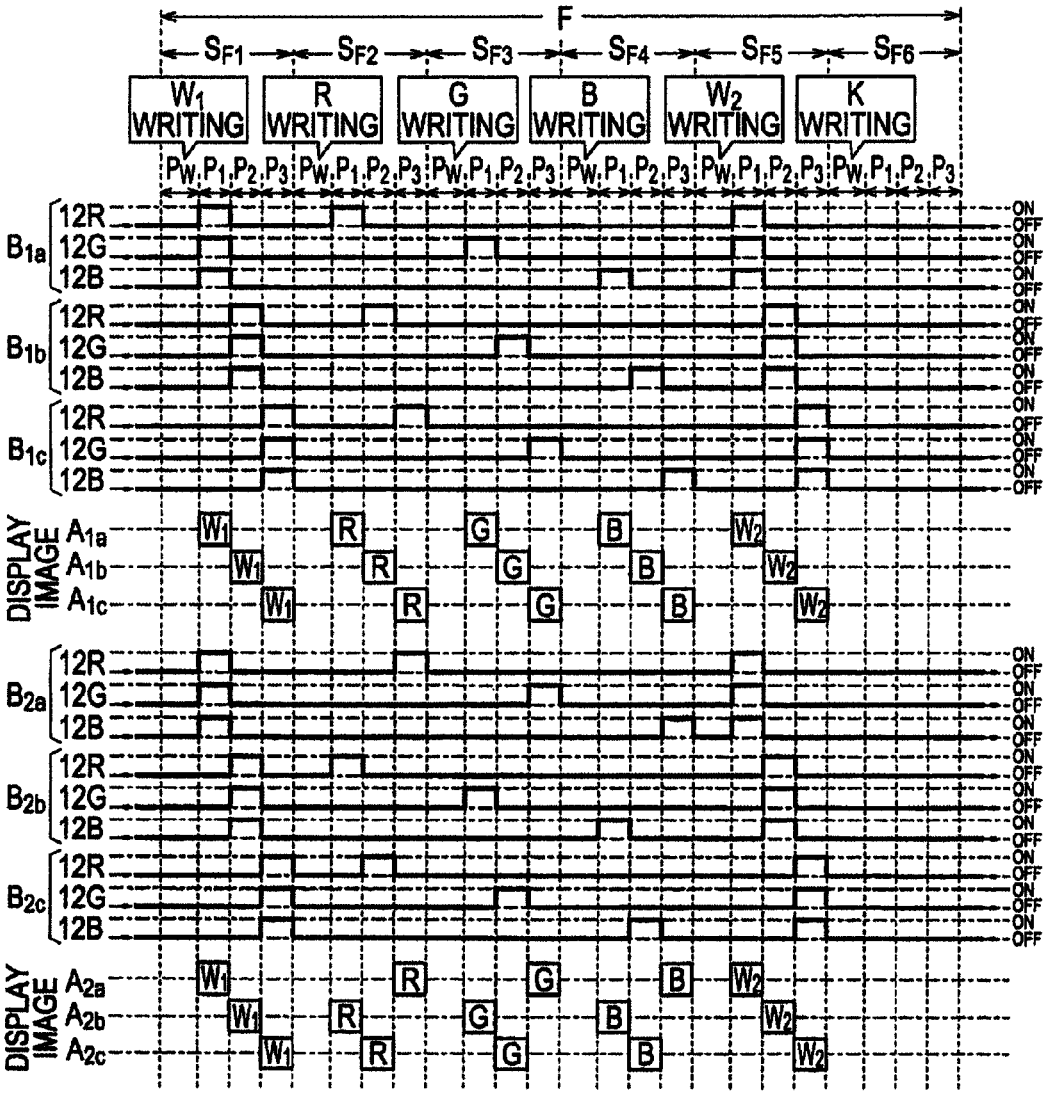
FIG. 19 is a timing chart that schematically illustrates an example of the timing operation of a display device according to a variation example of the exemplary embodiment B2 of the invention.

In the above-described example of the configuration of the image display device 100 according to the present embodiment B2 of the invention, a single-color image that corresponds to the first white component W1 is displayed during each of the first, second, and third display time periods of P1, P2, and P3 of the first sub-field SF1, whereas a single-color image that corresponds to the second white component W2 is displayed during each of the first, second, and third display time periods of P1, P2, and P3 of the fifth sub-field SF5. However, the scope of the invention is not limited to such an exemplary configuration. For example, as illustrated in FIG. 19, a single-color image corresponding to the first white component W1 may be displayed in the unit display areas A in a sequential manner when viewed as a whole. The same modified sub-field operation as described above may be applied to the second white component W2. Although it is technically possible to adopt the above-described modified configuration, since no color breakup occurs in a white component as has already been explained above, considering from the viewpoint of color-breakup reduction only, it is not necessary at all to display a single-color image of a white component in the unit display areas A in a sequential manner. In comparison with this modified sub-field configuration illustrated in FIG. 19 according to which a single-color image of a white component is not displayed during all three of the display time periods P1, P2, and P3 in a continuous manner but displayed during only one of these three display time periods P in a sequential manner, the above-described sub-field configuration illustrated in FIG. 18 according to which a single-color image of each of the white components W1 and W2 is not displayed during only one of these three display time periods P in a sequential manner but displayed during all three of the display time periods P1, P2, and P3 in a continuous manner is more advantageous in that it is possible to decrease the brightness level, that is, suppress the brightness, of the light-emitting elements 12 of each of the area illumination units B in the corresponding white-component sub-field SF1 and SF5.

Figure 20:
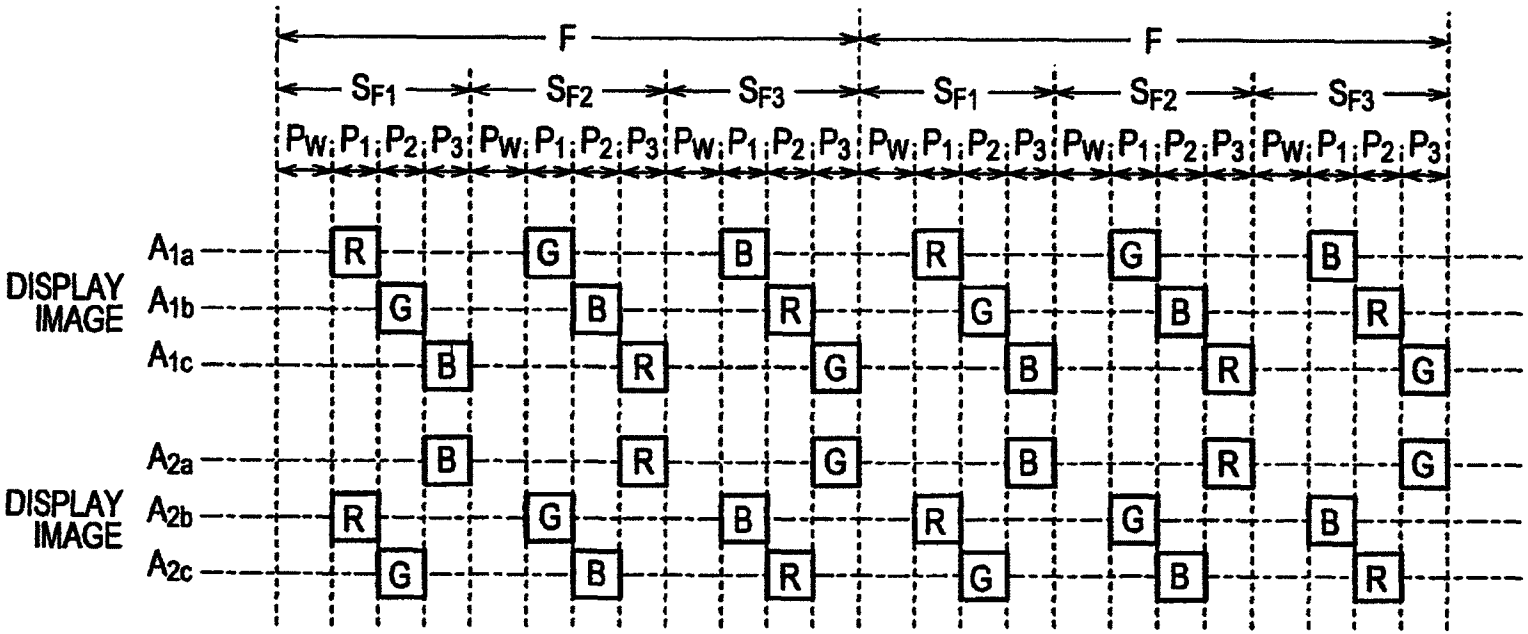
FIG. 20 is a timing chart that schematically illustrates an example of the timing operation, specifically, the sequential order of single-color images, of a display device according to a variation example of the exemplary embodiment B2 of the invention.

It should be noted that the order of displaying single-color images in the unit display areas A is not restrictively specified in the above-described exemplary embodiments B1 and B2 of the invention. That is, the display order thereof may be changed arbitrarily. Although it is explained in the foregoing exemplary embodiment B1 of the invention that a single-color image of the same color component (in the illustrated example, the same primary-color component) is displayed throughout the plurality of unit display areas A in each sub-field SF, a single-color image of different color components may be displayed throughout the plurality of unit display areas A (in a sequential manner) in each sub-field SF as shown in a non-limiting modification example illustrated in FIG. 20. However, in order to realize the different-color sequential display illustrated in FIG. 20, it is necessary to extract the gradation G1_R of the R component, the gradation G1_G of the G component, and the gradation G1_B of the B component from the input image signal S1 for each unit display area A. In contrast, such an area-by-area extraction is not required in the foregoing exemplary embodiment B1 of the invention in which a single-color image of the same color component is displayed throughout the plurality of unit display areas A in each sub-field SF. Therefore, considering from the viewpoint of reduction in the processing load of the controlling unit 50, the configuration described in the foregoing exemplary embodiment B1 of the invention is more advantageous. As has already been explained earlier while referring to FIGS. 12, 13, and 14, the number of white components split after the extraction thereof and the display order/positions (i.e., sub-field arrangement order/positions) of the single-color images of white components are not restrictively specified herein and thus may be arbitrary modified.

Embodiment C1

Figure 21:
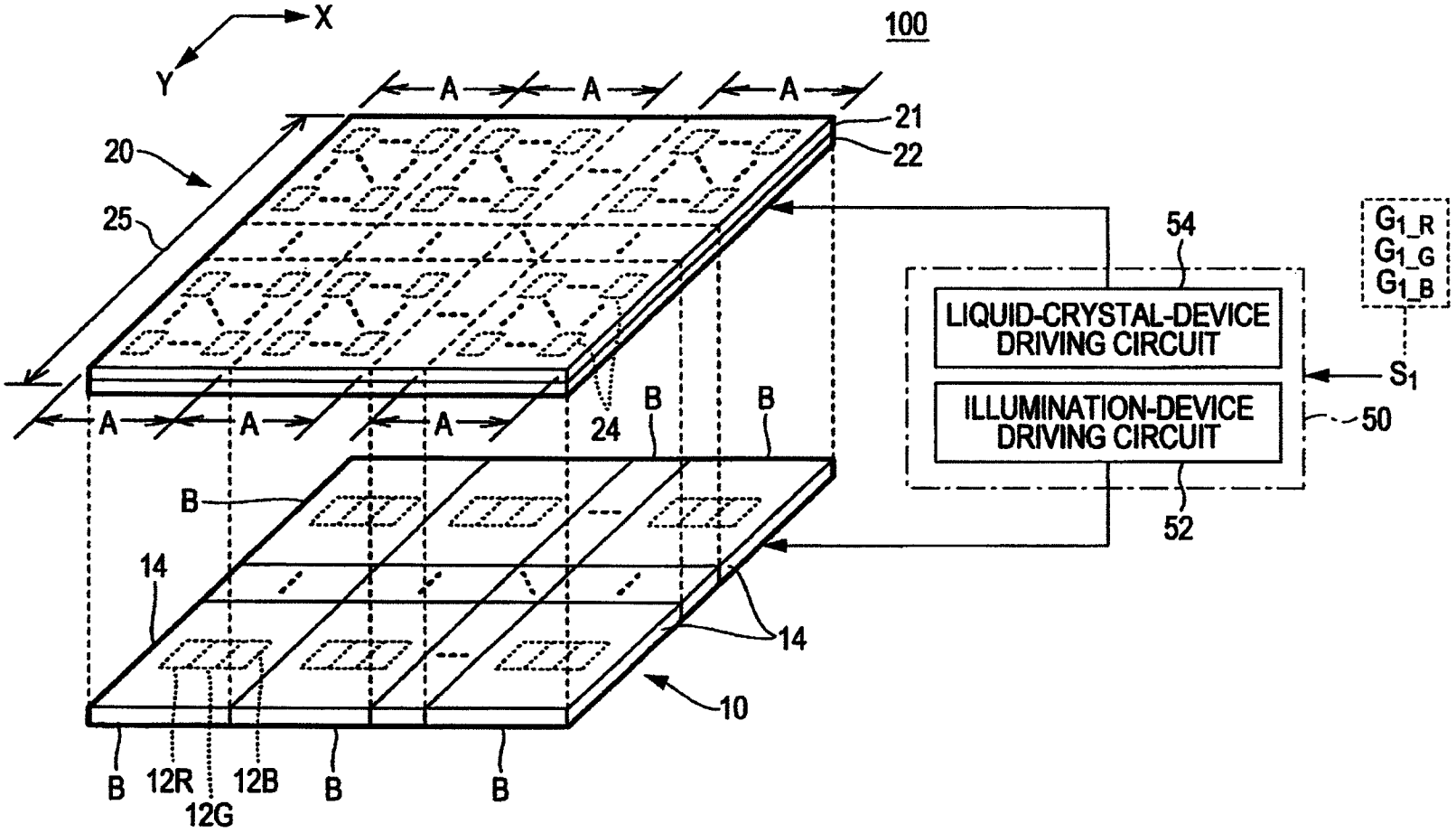
FIG. 21 is a diagram that schematically illustrates an example of the configuration of a display device according to an exemplary embodiment C1 of the invention.

FIG. 21 is a diagram that schematically illustrates an example of the configuration of a display device according to an exemplary embodiment C1 of the invention. As illustrated in FIG. 21, an image display device 100 is provided with an illumination device 10, a liquid crystal device 20, and a controlling unit 50. For the purpose of illustration, a distance is provided between the illumination device 10 and the liquid crystal device 20 in FIG. 21. However, needless to say, the illumination device 10 and the liquid crystal device 20 are provided close to each other in the actual implementation of the invention.

As shown in FIG. 21, a rectangular image display area 25 of the liquid crystal device 20 in which images are displayed is divided into a plurality of unit display areas A that are arrayed in a matrix pattern made up of rows that extend in the X direction and columns that extend in the Y direction in such a manner that these rows and columns intersect each other. A plurality of pixel electrodes 24 is arrayed in the image display area 25. Each of the unit display areas A is a rectangular region that has the same dimension as those of others. The plurality of pixel electrodes 24 is arrayed in an X-Y matrix pattern in each of the unit display areas A.

Figure 22:
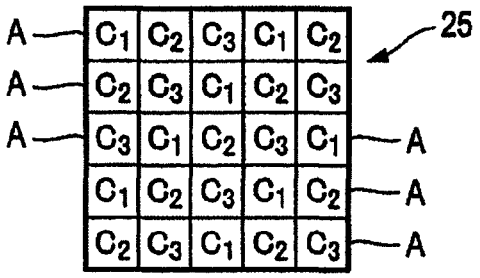
FIG. 22 is a diagram that schematically illustrates a division example of an image display area in the configuration of a display device according to the exemplary embodiment C1 of the invention, where the image display area is divided into a plurality of unit display areas.

FIG. 22 is a concept diagram that schematically illustrates a division example of the image display area 25, where the image display area 25 is divided into twenty-five unit display areas A that are arrayed in a matrix pattern made up of five rows that extend in the X direction and five columns that extend in the Y direction in such a manner that these five rows and five columns intersect each other. As illustrated in FIG. 22, the plurality of unit display areas A (in the illustrated example, twenty-five unit display areas A) that make up the image display area 25 are divided into three groups C1, C2, and C3. Each individual group C contains more than one unit display area A. As understood from the drawing, one unit display area A that belongs to a certain group C is not adjacent to another unit display area A that belongs to the same group C as viewed along the X direction nor along the Y direction.

The illumination device 10 illustrated in FIG. 21 is made up of a plurality of area illumination units (i.e., area-illuminating sections) B, which correspond to the above-mentioned plurality of unit display areas (i.e., unitary display areas) A, respectively. As illustrated in FIG. 21, each of the area-illuminating sections (i.e., area illumination units) B and the corresponding one of the unitary display areas (i.e., unit display areas) A overlap each other as viewed in a direction perpendicular to the X-Y plane of the image display area 25, that is, in a plan view. Accordingly, the plurality of area illumination units B is arrayed in an X-Y matrix pattern.

Each of the area illumination units B of the illumination device 10 has three light-emitting elements 12 and a light-guiding plate 14, the latter of which is configured as an optical waveguide board. These three light-emitting elements 12 are made up of a red light-emitting element 12R, a green light-emitting element 12G, and a blue light-emitting element 12B, which correspond to three primary colors of R, G, and B, respectively. The optical waveguide board 14 guides light that has been emitted thereto from each of the red light-emitting element 12R, the green light-emitting element 12G, and the blue light-emitting element 12B toward the unit display areas A of the liquid crystal device 20. The red light-emitting element 12R emits red light, that is, light having a wavelength that corresponds to a red color component. The green light-emitting element 12G outputs green light, that is, light having a wavelength that corresponds to a green color component. The blue light-emitting element 12R outputs blue light, which is light having a wavelength that corresponds to a blue color component. In actual implementation of the invention, a light-reflecting plate and a light-scattering plate are adhered to the light-guiding plate 14 of the image display device 100. In order to simplify explanation, however, these light-reflecting plate and light-scattering plate are omitted from the drawing.

Figure 23:
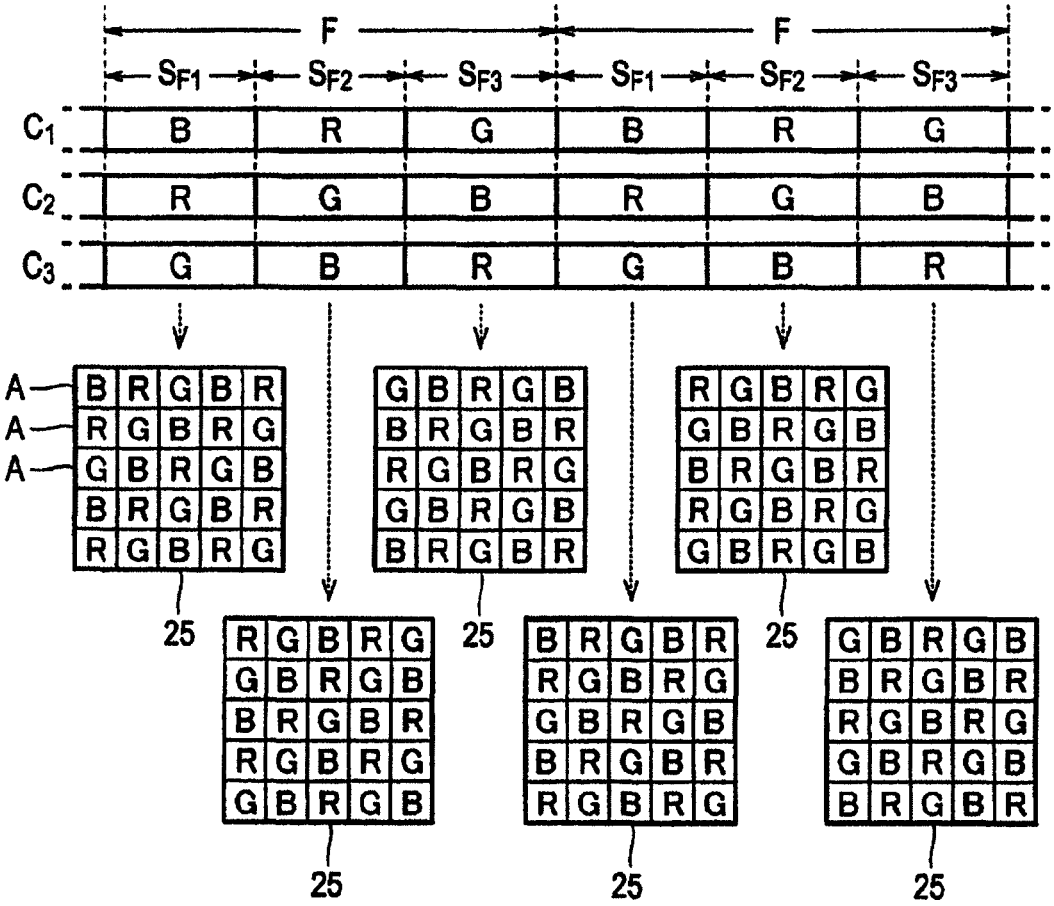
FIG. 23 is a timing chart that schematically illustrates an example of the timing operation of a display device according to the exemplary embodiment C1 of the invention.

The illumination device 10 and the liquid crystal device 20 function in cooperation with each other so as to display a color image. FIG. 23 is a timing chart that schematically illustrates an example of the timing operations of the illumination device 10 and the liquid crystal device 20 according to an exemplary embodiment of the invention. A frame F that is shown in FIG. 23 is a unit time period (i.e., unitary time period) that is used for displaying one color image (e.g., full-color image). The liquid crystal device 20 displays an image at a frame frequency of 120 Hz, which is double-speed display. Therefore, the time length of each frame F is 1/120 second.

As illustrated in FIG. 23, each frame F is time-divided into a plurality of sub-fields. In the illustrated embodiment of the invention, one frame F is time-divided into three sub-fields, which are denoted as SF1, SF2, and SF3. The illumination device 10 and the liquid crystal device 20 sequentially display a plurality of single-color images, that is, unicolor images, that correspond to primary color components in the plurality of unit display areas A in a "time-parallel and concurrent" manner (hereafter referred to as "parallel") in each of sub-fields SF. For the definition of the term "time-parallel and concurrent" or "parallel" that appears in the description of the present embodiment of the invention, refer to the operation illustrated in FIG. 23. In this way, the illumination device 10 and the liquid crystal device 20 perform so-called field sequential display. A user who observes the display screen of the image display device 100 views these single-color images displayed in the unit display areas A during the respective sub-fields SF in a sequential manner. As a result thereof, they visually perceive a color image that is formed as a mixture of these individual single color components. For this reason, it is not necessary to provide any coloration layer such as a color filter or the like in the configuration of the liquid crystal device 20.

The controlling unit 50 illustrated in FIG. 21 is a circuit that controls the operations of the image display device 10 and the liquid crystal device 20. The controlling unit 50 is provided with an illumination-device driving circuit 52, which drives the illumination device 10, and a liquid-crystal-device driving circuit 54, which drives the liquid crystal device 20. As illustrated in FIG. 21, an input image signal S1 is supplied from an external device that is not shown in the drawing to the controlling unit 50. The input image signal S1 individually specifies a gradation value for each of three primary color components, that is, R color component (i.e., R component), G color component (i.e., G component), and B color component (i.e., B component), which make up the display color of a pixel.

The controlling unit 50 controls the operations of the illumination device 10 and the liquid crystal device 20 on the basis of the input image signal S1 so that single-color images that correspond to primary color components should be sequentially displayed in the unit display areas A that make up the image display area 25. More specifically, during a set of the sub-fields SF1, SF2, and SF3 that constitutes one frame F, the controlling unit 50 commands single-color images of three primary color components to be displayed sequentially in the plurality of unit display areas A that make up the image display area 25. That is, as illustrated in FIG. 23, each of the single-color images of three primary color components R, and B are displayed once during each frame F in the sequential order of B, R, G for the unit display areas A that belong to the first group C1, in the sequential order of R, G, B for the unit display areas A that belong to the second group C2, and in the sequential order of G, B, R for the unit display areas A that belong to the third group C3.

In addition, as understood from the above explanation and the drawing, the controlling unit 50 commands single-color images to be displayed in a parallel manner in all unit display areas A in such a manner that the display color of a single-color image that appears in the unit display areas A that belong to one group C differs from the display color of another single-color image that appears in the unit display areas A that belong to another group C in each sub-field SF. Therefore, one unit display area A that displays a single-color image of a certain color component R, G, or B is not adjacent to another unit display area A that displays a single-color image of the same color component R, G, or B as viewed along the X direction nor along the Y direction. If an attention is focused on the sub-fields SF1, SF2, and SF3, such a non-adjacent arrangement can be paraphrased as a sub-field configuration in which, the sequential order of the display colors of single-color images that appear in the unit display areas A that belong to one group C differs from the sequential order of the display colors of single-color images that appear in the unit display areas A that belong to another group C.

For example, as illustrated in FIG. 23, during the first sub-field SF1, the single-color image of the B component is displayed in each of the unit display areas A that belong to the first group During the same first sub-field SF1, the single-color image of the R component is displayed in each of the unit display areas A that belong to the second group C2, whereas the single-color image of the G component is displayed in each of the unit display areas A that belong to the third group C3. During the second sub-field SF2, the single-color image of the R component is displayed in each of the unit display areas A that belong to the first group C1. During the same second sub-field SF2, the single-color image of the G component is displayed in each of the unit display areas A that belong to the second group C2, whereas the single-color image of the B component is displayed in each of the unit display areas A that belong to the third group C3. During the third sub-field SF3, the single-color image of the G component is displayed in each of the unit display areas A that belong to the first group C1. During the same third sub-field SF3, the single-color image of the B component is displayed in each of the unit display areas A that belong to the second group C2, whereas the single-color image of the R component is displayed in each of the unit display areas A that belong to the third group C3.

The liquid-crystal-device driving circuit 54 sets the electric potential (i.e., voltage) of each of the pixel electrodes 24, which are arrayed in each of the unit display areas A, at a data electric potential that is in accordance with a gradation value specified by an input image signal S1 for a certain primary color component R, G, or B that should be displayed in the unit display areas A that belong to a certain group in the writing time period PW of each sub-field SF that is allocated at the headmost timeslot portion thereof. For example, in the writing time period PW of the first sub-field SF1, the liquid-crystal-device driving circuit 54 supplies, to each of the pixel electrodes 24 that are arrayed in each of the first-group unit display areas A that belong to the group C1, a data electric potential that is in accordance with a gradation value G1_B specified by an input image signal S1 for the B component. In the same writing time period PW of the first sub-field SF1, the liquid-crystal-device driving circuit 54 supplies, to each of the pixel electrodes 24 that are arrayed in each of the second-group unit display areas A that belong to the group C2, a data electric potential that is in accordance with a gradation value G1_R specified by the input image signal S1 for the R component, whereas the liquid-crystal-device driving circuit 54 supplies, to each of the pixel electrodes 24 that are arrayed in each of the third-group unit display areas A that belong to the group C3, a data electric potential that is in accordance with a gradation value G1_G specified by the input image signal S1 for the G component. In like manner, in the writing time period PW of the second sub-field SF2, the liquid-crystal-device driving circuit 54 supplies, to each of the pixel electrodes 24 that are arrayed in each of the first-group unit display areas A that belong to the group C1, a data electric potential that is in accordance with a gradation value G1_R specified by the input image signal S1 for the R component. In the same writing time period PW of the second sub-field SF2, the liquid-crystal-device driving circuit 54 supplies, to each of the pixel electrodes 24 that are arrayed in each of the second-group unit display areas A that belong to the group C2, a data electric potential that is in accordance with a gradation value G1_G specified by the input image signal S1 for the G component, whereas the liquid-crystal-device driving circuit 54 supplies, to each of the pixel electrodes 24 that are arrayed in each of the third-group unit display areas A that belong to the group C3, a data electric potential that is in accordance with a gradation value G1_B specified by the input image signal S1 for the B component. In the writing time period PW of the third sub-field SF3, the liquid-crystal-device driving circuit 54 supplies, to each of the pixel electrodes 24 that are arrayed in each of the first-group unit display areas A that belong to the group C1, a data electric potential that is in accordance with a gradation value G1_G specified by an input image signal S1 for the G component. In the same writing time period PW of the third sub-field SF3, the liquid-crystal-device driving circuit 54 supplies, to each of the pixel electrodes 24 that are arrayed in each of the second-group unit display areas A that belong to the group C2, a data electric potential that is in accordance with a gradation value G1_B specified by the input image signal S1 for the B component, whereas the liquid-crystal-device driving circuit 54 supplies, to each of the pixel electrodes 24 that are arrayed in each of the third-group unit display areas A that belong to the group C3, a data electric potential that is in accordance with a gradation value G1_R specified by the input image signal S1 for the R component. The transmission factor of liquid crystal, that is, the gradation of a single-color image for each pixel, that is set during each of the sub-fields SF1, SF2, and SF3 is determined in accordance with the data electric potentials that are set for the pixel electrodes 24 during the writing time period PW thereof.

The illumination-device driving circuit 52 illustrated in FIG. 21 controls the ON/OFF state of each of the plurality of light-emitting elements 12, that is, the red light-emitting element 12R, the green light-emitting element 12G, and the blue light-emitting element 12B of each of the aforementioned area illumination units B in a sequential manner during the sub-fields SF. More specifically, the illumination-device driving circuit 52 controls the illumination device 10 in such a manner that, in each sub-field SF, the illumination device 10 emits light having a wavelength that corresponds to a certain primary color component from not all but some of the area illumination units B thereof, specifically, the area illumination units B that are arrayed opposite to the corresponding (i.e., not all but some of) unit display areas A at which a single-color image of the above-mentioned certain primary color component should be displayed in the above-mentioned sub-field SF. This light-emission control is performed for not one but all of three primary color components in each sub-field SF. Referring to the first sub-field SF1 shown in FIG. 23, the illumination-device driving circuit 52 controls the illumination device 10 in such a manner that the light-emitting elements 12 of not all but some of the area illumination units B thereof emit light corresponding to each primary color component. For example, in the first sub-field SF1, the illumination-device driving circuit 52 controls the illumination device 10 in such a manner that the light-emitting elements 12B of the area illumination units B thereof that are arrayed opposite to the corresponding first-group unit display areas A that belong to the group C1 emit light. Concurrently therewith, the illumination-device driving circuit 52 controls the illumination device 10 in such a manner that the light-emitting elements 12R of the area illumination units B thereof that are arrayed opposite to the corresponding second-group unit display areas A that belong to the group C2 emit light, whereas the illumination-device driving circuit 52 controls the illumination device 10 in such a manner that the light-emitting elements 12G of the area illumination units B thereof that are arrayed opposite to the corresponding third-group unit display areas A that belong to the group C3 emit light.

Since the controlling unit 50 controls the operations of the illumination device 10 and the liquid crystal device 20 as explained above, single-color images of color components different from one another are displayed in a parallel manner in the unit display areas A that belong to the first, second, and third groups C1, C2, and C3 respectively in each sub-field SF. Therefore, in comparison with the aforementioned related-art configuration described in JP-A-2005-316092 according to which a single-color image is displayed exclusively for each area divided out of the image display area 25, the configuration of the image display device 100 according to the present embodiment of the invention is more advantageous in that it is possible to ensure the enhanced color brightness (i.e., luminosity) of an output image.

In addition, since single-color images of color components different from one another are displayed in a parallel manner in the unit display areas A, which are divided portions of the image display area 25, in the configuration of the image display device 100 according to the present embodiment of the invention, it is possible to achieve a greater reduction in the aforementioned color-breakup phenomenon in an image visually perceived by a user who observes the display screen thereof in comparison with a configuration in which the single-color images of the same color component are displayed in the entire region of the image display area 25 during each sub-field SF of a frame F. It should be noted that such a same-color display configuration is referred to as a "comparative example A" in the following description. A detailed explanation as to how the image display device 100 according to the present embodiment of the invention achieves a greater reduction in the color-breakup image problem is given below.

Figure 24:
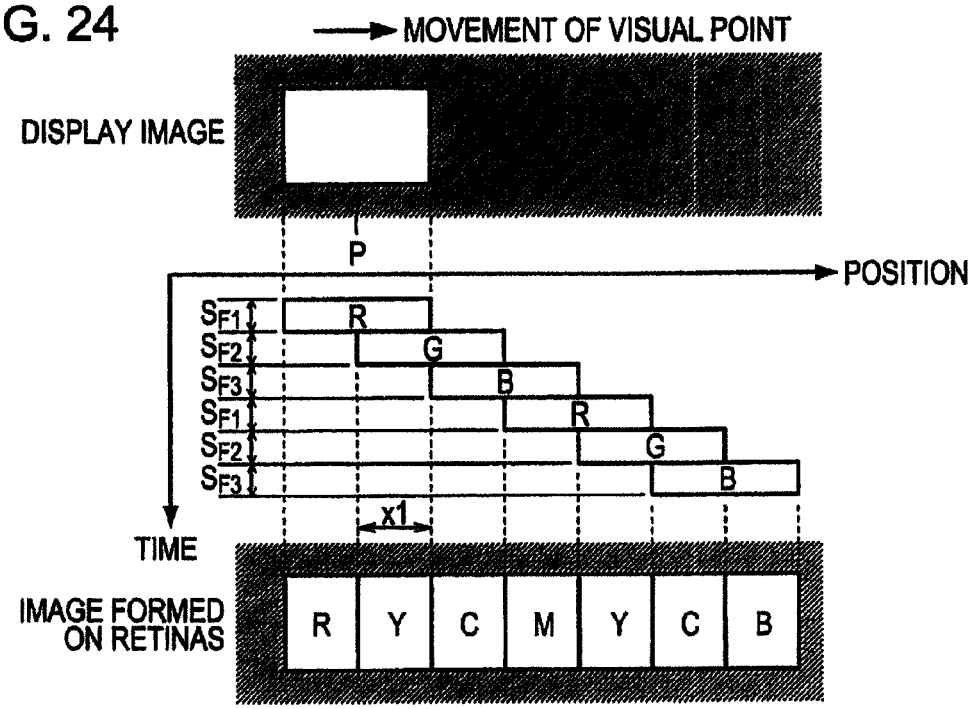
FIG. 24 is a diagram that schematically illustrates an example of a color breakup that is perceived by an observer under a comparative example A.
Figure 25:
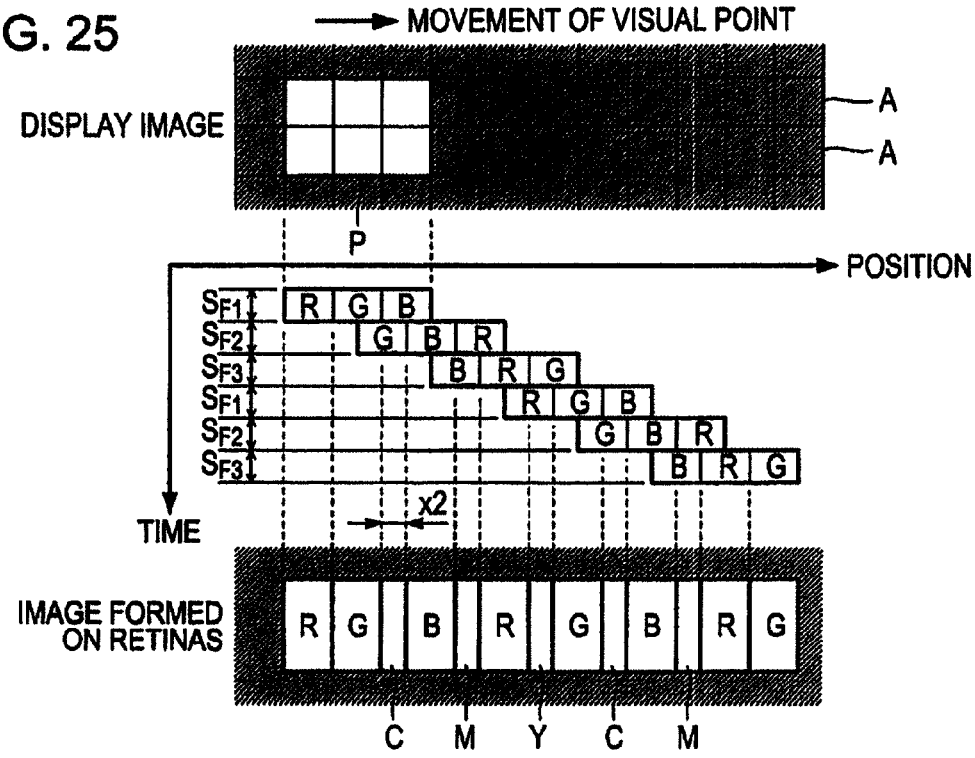
FIG. 25 is a diagram that schematically illustrates an example of advantageous effects offered by a display device according to the exemplary embodiment C1 of the invention.

Each of FIGS. 24 and 25 is a concept diagram that schematically illustrates an example of the formation of a perceived image on the retinas of an observer as a result of the displaying of a white imaging-target object (i.e., subject image) P. Note that white is the mixed color component that is formed as a result of the mixture of all three primary color components. FIG. 24 corresponds to the comparative example A, whereas FIG. 25 corresponds to the present embodiment C1 of the invention. In each of FIGS. 24 and 25, it is assumed that a visual point of a user who observes the display screen thereof moves to the right instantaneously. Such an instant movement of a visual point is called as a saccade, which can be further defined as, simply said, a fast movement of an eye (i.e., eyeball). In each of FIGS. 24 and 25, the reference numeral Y denotes a yellow color component. The reference numeral C denotes a cyan color component, whereas the reference numeral M denotes a magenta color component. It should be particularly noted that, in FIG. 25, the number of the unit display areas A that make up the image display area 25 are changed from that of FIG. 22 for the purpose of practical explanation.

If the vector amount of the movement of a visual point during the sub-field SF is smaller than the horizontal dimension of the imaging-target object (i.e., subject image) P, images displayed during the respective sub-fields SF overlap on the retinas of an observer. If the images that overlap each other on the retinas of an observer correspond to color components that differ from each other, the observer perceives a mixed display color at the overlapping portion of the images. In the comparative example A illustrated in FIG. 24 according to which the single-color images of the same color component are displayed for the entire subject image P during each sub-field SF, the observer perceives a mixed display color out of two primary color components spanning the width x1, which is an equivalent of the vector amount of the movement of a visual point during the sub-field SF. For example, the observer perceives a mixed display color of the Y component out of two primary color components of R and G spanning the width x1, which is an equivalent of the vector amount of the movement of a visual point during a time period between the first sub-field SF1 in which the R component is displayed and the second sub-field SF2 in which the G component is displayed.

On the other hand, in the configuration of the image display device 100 according to the present embodiment C1 of the invention that is illustrated in FIG. 25, since the display color of a single-color image that is displayed in the unit display areas A that belong to one group differs from a single-color image that is displayed in the unit display areas A that belong to another group, in comparison with the comparative example A illustrated in FIG. 24, the width x2 within which different-color images overlap each other on the retinas of an observer due to the instantaneous movement of a visual point becomes smaller (than the width x1 of FIG. 24) while the frequency of the overlapping of different-color images on the retinas of the observer due to the instantaneous movement of the visual point becomes greater. For this reason, with the configuration of the image display device 100 according to the present embodiment C1 of the invention that is illustrated in FIGS. 21, 22, 23, and 25, it becomes harder for an observer to perceive a visible distinction between the regions of primary color components and the regions of mixed color components in an image formed on his/her retinas thereof, which is advantageous. Thus, in comparison with the configuration of the comparative example A described herein, the image display device 100 according to the present embodiment C1 of the invention makes it possible to achieve a greater reduction in the aforementioned color-breakup phenomenon in an image visually perceived by a user who observes the display screen thereof.

Embodiment C2

In the foregoing exemplary embodiment C1 of the invention, it is explained that the single-color images of three primary color components are sequentially displayed on the basis of an input image signal S1. In contrast, in the configuration of the image display device 100 according to the present embodiment of the invention, as done in the foregoing exemplary embodiment A1 of the invention, a display color specified by the input image signal S1 is separated into a plurality of primary color components and a plurality of white components. In the following description of the image display device 100 according to the present embodiment C2 of the invention, the same reference numerals are consistently used for constituent elements thereof that have the same operation and function as those described in the foregoing exemplary embodiment C1 of the invention so as to omit any redundant explanation thereof as long as the context allows.

Figure 26:
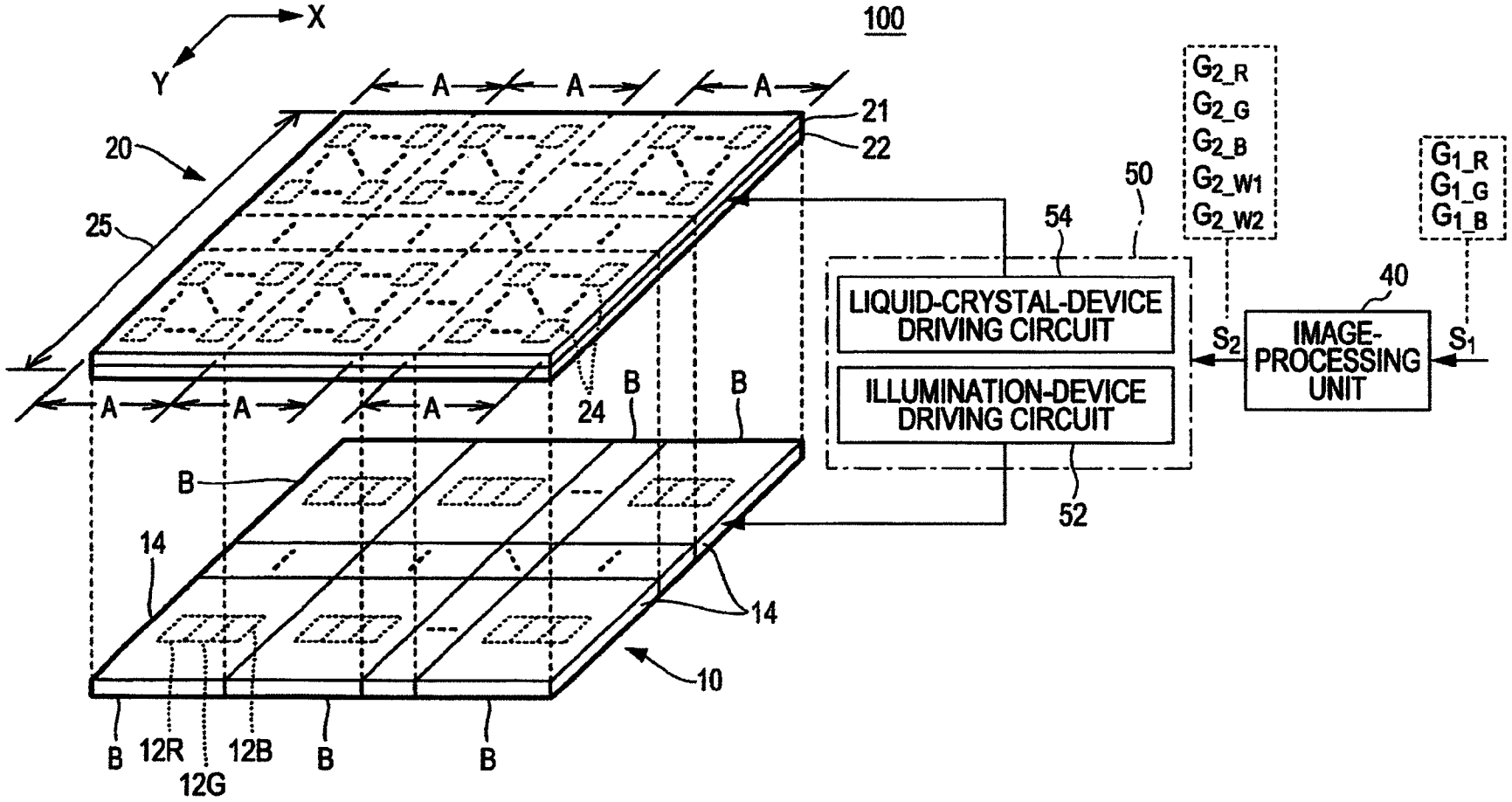
FIG. 26 is a diagram that schematically illustrates an example of the configuration of a display device according to an exemplary embodiment C2 of the invention.

FIG. 26 is a diagram that schematically illustrates an example of the configuration of a display device according to an exemplary embodiment C2 of the invention. As illustrated in FIG. 26, the image display device 100 according to the present embodiment of the invention is provided with, in addition to the same components as those of the foregoing exemplary embodiment C1 of the invention, the image-processing unit 40 as in the configuration of the image display device 100 according to the foregoing exemplary embodiment A1 of the invention. The image-processing unit 40 according to the present embodiment of the invention generates a color separation image signal S2 from an input image signal S1 that is supplied thereto from an external device that is not shown in the drawing and then outputs the generated color separation image signal S2. The color separation image signal S2 individually specifies, for each of the plurality of pixels, a gradation value for each of separated components, which are obtained in the form of a plurality of primary-color components and a plurality of white components as a result of the color separation of a display color that is specified by the input image signal S1. As illustrated in FIG. 26, the color separation image signal S2 according to the present embodiment of the invention specifies the gradation G2_W1 of the first white component W1 and the gradation G2_W2 of the second white component W2 in addition to the gradation G2_R of the R color component, the gradation G2_G of the G color component, and the gradation G2_B of the B color component. The color separation image signal S2 is generated through the same processing as that explained above while referring to FIGS. 3, 4, and 5 in the foregoing first exemplary embodiment A1 of the invention.

Figure 27:
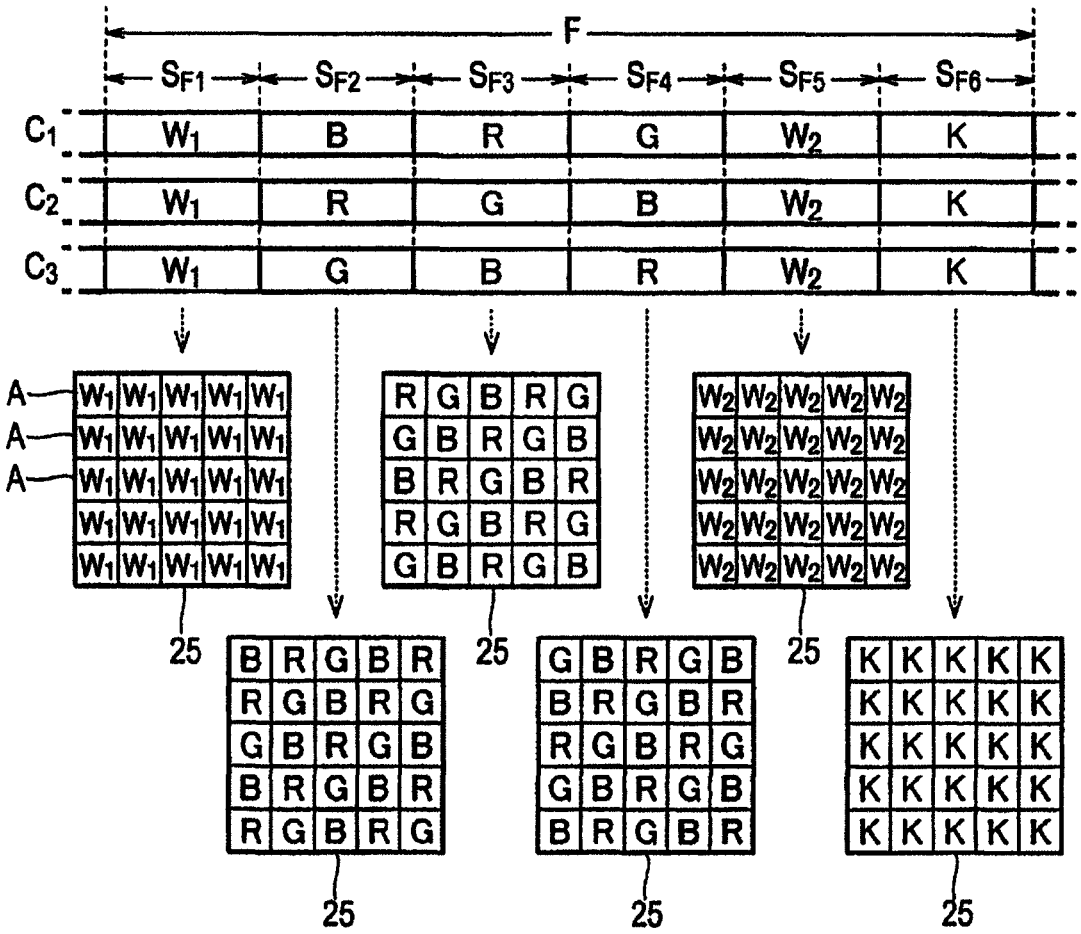
FIG. 27 is a timing chart that schematically illustrates an example of the timing operation of a display device according to the exemplary embodiment C2 of the invention.

FIG. 27 is a timing chart that schematically illustrates an example of the timing operation of the image display device 100 according to the present embodiment of the invention. As illustrated in FIG. 27, each frame F is time-divided into a plurality of sub-fields. In the illustrated embodiment of the invention, one frame F is time-divided into six sub-fields, which are denoted as SF1, SF2, SF3, SF4, SF5, and SF6. The operations of the illumination device 10 and the illumination-device driving circuit 52 during the sub-fields SF2, SF3, and SF4 in the present embodiment of the invention are the same as those during the sub-fields SF1, SF2, and SF3 in the foregoing exemplary embodiment C1 of the invention.

The illumination-device driving circuit 52 according to the present embodiment of the invention commands all three of the red, green, and blue light-emitting elements 12R, 12Q and 12B provided in each of the area illumination units B to emit light in each of the first sub-field SF1 and the fifth sub-field SF5. As a result of such light-emission control that is performed by the illumination-device driving circuit 52, white light is irradiated onto all of the unit display areas A of the liquid crystal device 20 in each of the first sub-field SF1 and the fifth sub-field SF5. On the other hand, the illumination-device driving circuit 52 commands all three of the red, green, and blue light-emitting elements 12R, 12G, and 12B provided in each of the area illumination units B not to emit light during the sixth sub-field SF6. Therefore, no light is irradiated onto the liquid crystal device 20 in the sixth sub-field SF6.

The liquid-crystal-device driving circuit 54 sets the electric potential of each of the pixel electrodes 24, which are arrayed in each of the unit display areas A, at a data electric potential that is in accordance with a gradation value specified by a color separation image signal S2 for a certain primary color component R, or B (i.e., in accordance with G2_R, G2_G, or G2_B) that should be displayed in the unit display areas A that belong to a certain group in the writing time period PW of each of the second, third, and fourth sub-field SF2, SF3, and SF4, which is similar to the operation performed in the foregoing exemplary embodiment C1. On the other hand, in the writing time period PW of the first sub-field SF1 during which white light is irradiated onto the liquid crystal device 20, the liquid-crystal-device driving circuit 54 supplies a data electric potential that corresponds to the gradation G2_W1 of the W1 component to each pixel electrode 24. In like manner, in the writing time period PW of the fifth sub-field SF5 during which white light is irradiated onto the liquid crystal device 20, the liquid-crystal-device driving circuit 54 supplies a data electric potential that corresponds to the gradation G2_W2 of the W2 component to each pixel electrode 24. In the sixth sub-field SF6 during which the illumination device 10 switches light off so that no light should be irradiated onto the liquid crystal device 20, the liquid-crystal-device driving circuit 54 supplies, to each pixel electrode 24, a data electric potential that reduces the transmission factor of liquid crystal to the minimum value (e.g., zero).

Since the controlling unit 50 controls the operations of the illumination device 10 and the liquid crystal device 20 as explained above, single-color images of primary color components different from one another are displayed in the unit display areas A that belong to the first, second, and third groups C1, C2, and C3 respectively in each of the second, third, and fourth sub-fields SF2, SF3, and SF4. In addition thereto, since the controlling unit 50 controls the operations of the illumination device 10 and the liquid crystal device 20 as explained above, a single-color image of the first white component W1 is displayed in all of the unit display areas A during the first sub-field SF1 that is allocated immediately before the primary-color-component subfields SF2, SF3, and SF4, whereas a single-color image of the second white component W2 is displayed in all of the unit display areas A during the fifth sub-field SF5 that is allocated immediately after the primary-color-component subfields SF2, SF3, and SF4. In the last sub-field SF6, a black image K is displayed in all of the unit display areas A.

As explained above, in the configuration of the image display device 100 according to the present embodiment of the invention, since the first white component W1 and the second white component W2 are extracted out of a display color of each pixel, the brightness level of a single-color image of each of three primary color components of R, G, and B becomes lower in comparison with that of the foregoing exemplary embodiment C1 of the invention. Since no color breakup occurs in the single-color image of a white component, taken in combination with the above-described decreased (i.e., suppressed) brightness level of a single-color image of each of three primary color components of R, and B, the image display device 100 according to the present embodiment of the invention makes it possible to achieve a greater reduction in the aforementioned color-breakup image problem in an image visually perceived by a user who observes the display screen thereof in comparison with the image display device 100 according to the foregoing exemplary embodiment C1 of the invention in which single-color images that correspond to primary color components R, and B only are displayed, which means that no single-color images that correspond to white components W1 and W2 are displayed. In addition, in the configuration of the image display device 100 according to the present embodiment of the invention, the non-image-display subfield SF6 during which a black K image is displayed is allocated in each frame F in addition to the sub-fields SF2, SF3, and SF4 during which single-color images that correspond to three primary color components of R, G, and B are displayed in a parallel manner and the sub-fields SF1 and SF5 during which single-color images that correspond to the first white component W1 and the second white component W2 respectively are displayed. Therefore, in comparison with the configuration of the image display device 100 according to the foregoing exemplary embodiment C1 of the invention in which no black image K is displayed, the image display device 100 according to the present embodiment of the invention makes it possible to achieve a greater reduction in the aforementioned moving-picture blur phenomenon, that is, the visual perception of the blurred outline of a moving subject image P.

Moreover, in the configuration of the image display device 100 according to the present embodiment of the invention, as has already been explained earlier, if the combined gradation of the pre-separation "white" component (corresponding to W1+W2), or in other words, the minimum value Gmin, contained in a display color specified by the input image signal S1 is greater than the threshold value TH1, the pre-separation white component is split into the first actual white component W1 and the second actual white component W2 at the boundary of the threshold value TH1 in the white extraction process. Then, these split white components are respectively displayed in separate sub-fields SF that are "time-isolated" from each other; specifically, the first white component W1 is displayed in the first sub-field SF1 whereas the second white component W2 is displayed in the fifth sub-field SF5 in the illustrated configuration thereof according to the present embodiment of the invention. This means that a difference between the gradations of primary-color-component single-color images and the gradations of white-component single-color images is made smaller. Therefore, in comparison with, for example, the configuration of the aforementioned related art described in JP-A-2002-169515 according to which a single-color image of a white component that is extracted from a display color specified by an input image signal S1 is displayed in only one sub-field SF, the image display device 100 according to the present embodiment of the invention has an advantage in that it can reduce flickers, which is the same non-limiting advantageous effects of the invention as those offered by the image display device 100 according to the foregoing exemplary embodiment A1 of the invention. Furthermore, as is the case with the image display device 100 according to the foregoing exemplary embodiment A1 of the invention, in the configuration of the image display device 100 according to the present embodiment of the invention, it is possible to offset an increase in flickers due to the insertion of a black-image display by a decrease therein achieved by the time-separated display of split white components.

Embodiment C3

Next, an exemplary embodiment C3 of the invention is explained below. In the foregoing exemplary embodiment C2 of the invention, it is explained that a single-color image of the first white component W1 is displayed in the first sub-field SF1 whereas a single-color image of the second white component W2 is displayed in the fifth sub-field SF5. This means that each of a single-color image of the first white component W1 and a single-color image of the second white component W2 is displayed in a dedicated or discreet white-component subfield (SF1 and SF5) that is isolated from primary-color-component subfields (SF2, SF3, and SF4). In contrast, in the configuration of the image display device 100 according to the present embodiment C3 of the invention, both of single-color images that correspond to three primary color components and single-color images that correspond to a plurality of white components are displayed without any isolation between primary-color-component subfields and white-component subfields in a plurality of unit display areas A in a parallel manner in each of sub-fields SF on the basis of a color separation image signal S2 that is generated by the image-processing unit 40.

Figure 28:
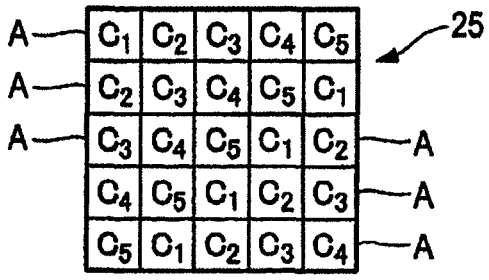
FIG. 28 is a diagram that schematically illustrates an division example of an image display area according to an exemplary embodiment C3 of the invention.

FIG. 28 is a concept diagram that schematically illustrates a division example of an image display area 25, where the image display area 25 is divided into a plurality of unit display areas A. As illustrated in FIG. 28, the plurality of unit display areas A (in the illustrated example, twenty-five unit display areas A) that make up the image display area 25 are divided into five groups C1, C2, C3, C4, and C5. As is the case with the array pattern of the unit display areas A according to the foregoing exemplary embodiment C1 of the invention, one unit display area A that belongs to a certain group C is not adjacent to another unit display area A that belongs to the same group C as viewed along the X direction nor along the Y direction.

Figure 29:
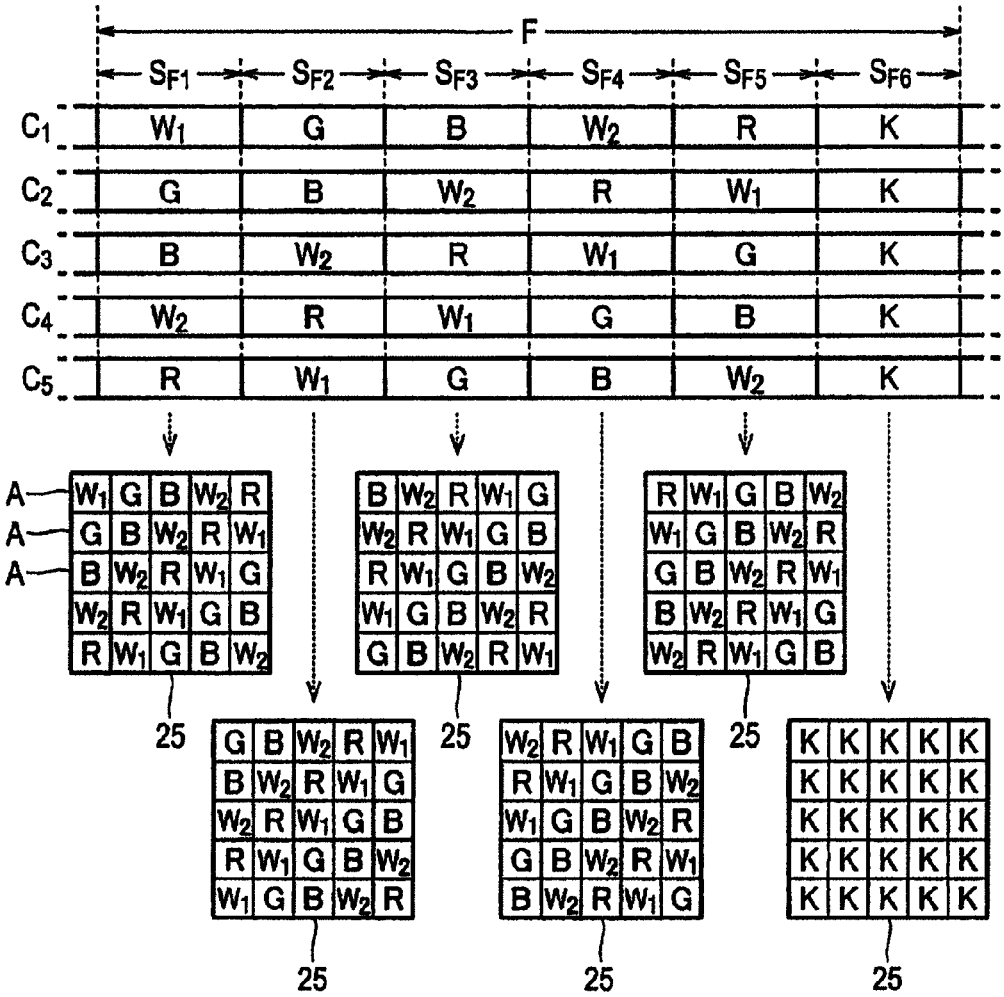
FIG. 29 is a timing chart that schematically illustrates an example of the timing operation of a display device according to the exemplary embodiment C3 of the invention.

FIG. 29 is a timing chart that schematically illustrates an example of the timing operation of the image display device 100 according to the present embodiment of the invention. As illustrated in FIG. 29, the controlling unit 50 controls the display of each unit display area A in each of the sub-fields SF1-SF5 in such a manner that a single-color image of each of a plurality of components, which is five colors in the illustrated embodiment of the invention that are made up of three primary color components of R, G, and B and two white components of W1 and W2, is displayed in the unit display areas A that belong to the corresponding group C, so as to provide sequential non-isolated display. That is, the sequential order of the display colors of single-color images that appear in the unit display areas A that belong to one group C differs from the sequential order of the display colors of single-color images that appear in the unit display areas A that belong to another group C, where, in this embodiment C3 of the invention, the display colors are made up of five colors including the above-mentioned three primary color components of R, G, and B and the above-mentioned two white components of W1 and W2. For example, in the unit display areas A that belong to the first group C1, the display colors of single-color images appear in the sequential order of the first white component W1 (SF1), the green color component G (SF2), the blue color component B (SF3), the second white component W2 (SF4), and the red color component R (SF5) (W1→G→B→W2→R). In the unit display areas A that belong to the second group C2, the display colors of single-color images appear in the sequential order of the green color component G (SF1), the blue color component B (SF2), the second white component W2 (SF3), the red color component R (SF4), and the first white component W1 (SF5) (G→B→W2→R→W1). As done in the foregoing exemplary embodiment C2 of the invention, in the last sub-field SF6, a black image K is displayed in all of the unit display areas A.

The same advantageous effects as those offered by the configuration of the image display device 100 according to the foregoing exemplary embodiment C2 of the invention are offered with the configuration of the image display device 100 according to the present embodiment C3 of the invention. In the foregoing exemplary embodiment C2 of the invention, the primary-color-component subfields SF2, SF3, and SF4 during which single-color images of primary color components are displayed are arrayed in a successive manner on a time axis. In contrast, in the sub-field configuration according to the present embodiment C3 of the invention, the display of single-color images of primary color components does not succeed in the unit display areas A of each group C because the display of at least one of single-color images of white components is interposed therebetween on the time axis. As has already been explained above, the aforementioned problem of a color breakup is conspicuous especially if the single-color images of a plurality of primary color components are displayed successively on a time axis. In this respect, with the configuration of the image display device 100 according to the present embodiment of the invention, advantageously, it becomes harder for a user who observes the display screen thereof to perceive the aforementioned color-breakup image problem in comparison with the configuration of the image display device 100 according to the foregoing exemplary embodiment C2 of the invention in which the primary-color-component subfields SF2, SF3, and SF4 during which single-color images of primary color components are displayed are arrayed in a successive manner on a time axis.

Figure 30:
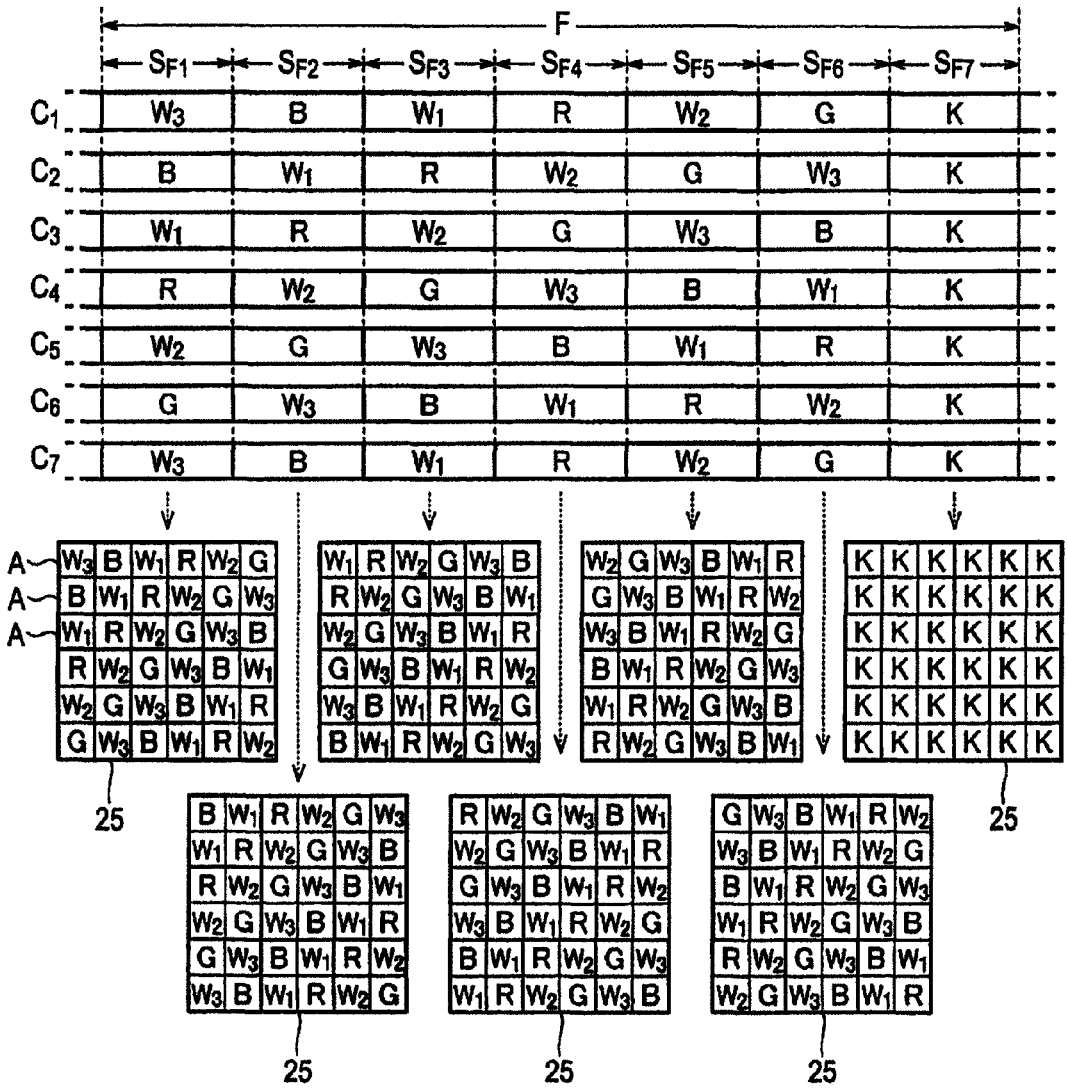
FIG. 30 is a timing chart that schematically illustrates an example of the timing operation of a display device according to a variation example of the exemplary embodiment C3 of the invention.

As has already been explained earlier while referring to FIGS. 12, 13, and 14, the number of white components split after the extraction thereof and the display order/positions (i.e., sub-field arrangement order/positions) of the single-color images of white components are not restrictively specified herein and thus may be arbitrary modified. As a non-limiting example of the modified number of white components split after the extraction thereof, in addition to the first white component W1 and the second white component W2, a third white component W3 may also be extracted from a display color specified by an input image signal S1. A plurality of the unit display areas A that makes up the image display area 25 is divided into seven groups C1, C2, C3, C4, C5, C6, and C7. As illustrated in FIG. 30, the controlling unit 50 controls the display of each unit display area A in each of the sub-fields SF1-SF6 in such a manner that a single-color image of each of a plurality of components, which is six colors in the illustrated embodiment of the invention that are made up of three primary color components of R, G, and B and three white components of W1, W2, and W3, is displayed in the unit display areas A that belong to the corresponding group C, so as to provide sequential non-isolated display. As has already been explained earlier, the gradation of a single-color image of each of a plurality of white components decreases as the number of white components split after the extraction (i.e., separation) thereof increases. Therefore, the image display device 100 having such a modified configuration has an advantage in that it can reduce flickers that are perceived by an observer.

Figure 31:
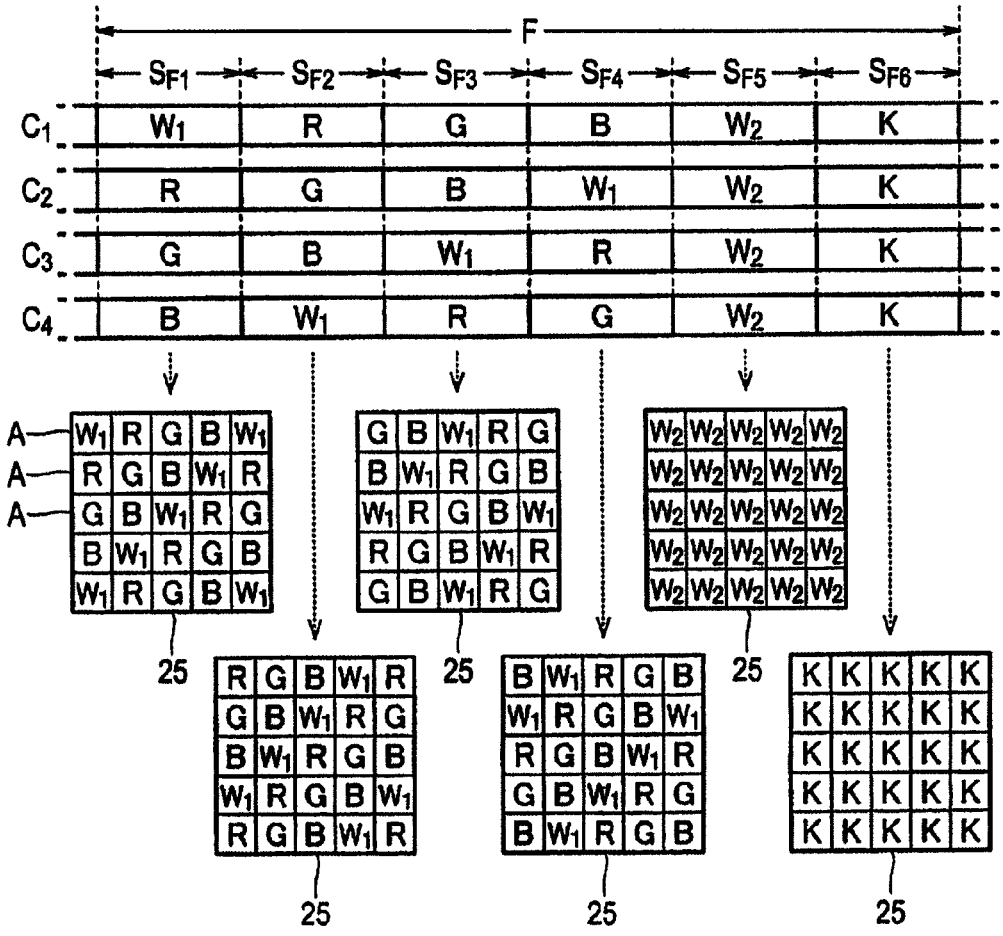
FIG. 31 is a timing chart that schematically illustrates an example of the timing operation of a display device according to a variation example of the exemplary embodiment C3 of the invention.
Figure 32:
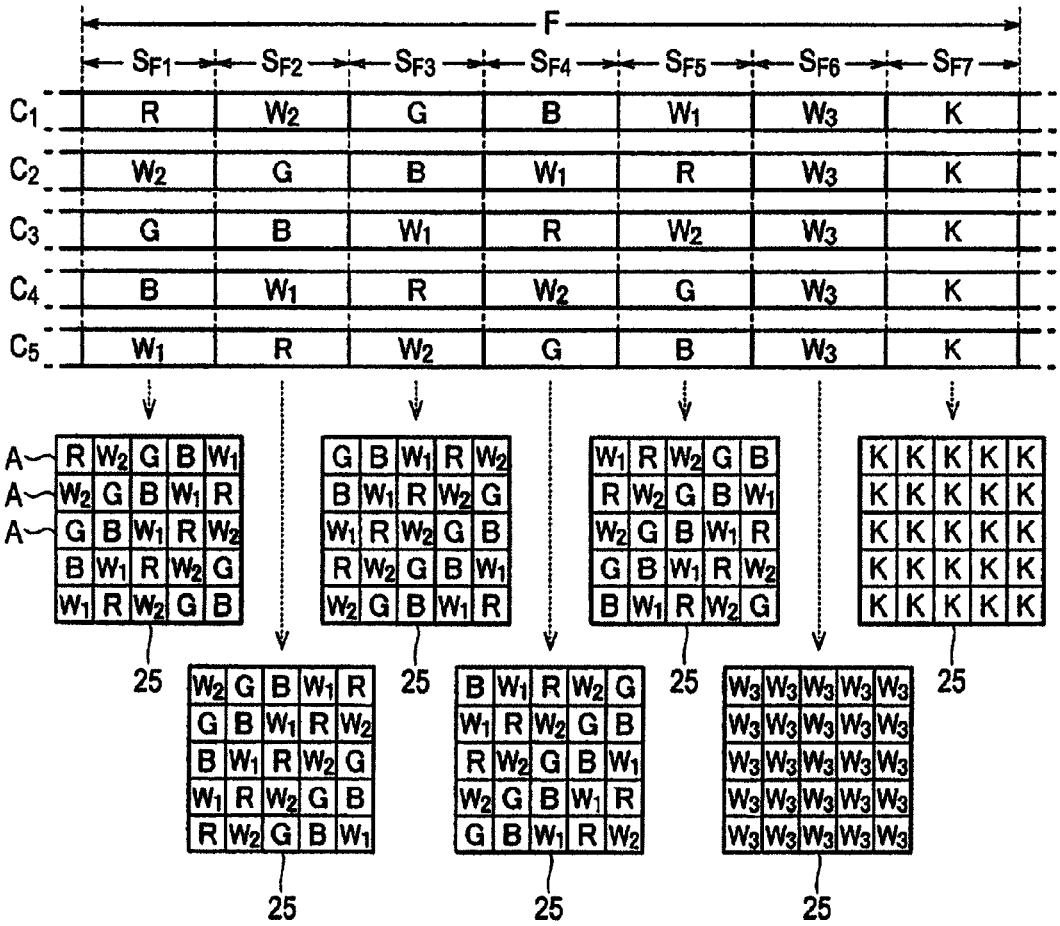
FIG. 32 is a timing chart that schematically illustrates an example of the timing operation of a display device according to a variation example of the exemplary embodiment C3 of the invention.

A judgment as to whether (A) a single-color image that corresponds to a certain white component is displayed in a dedicated or discreet white-component subfield that is isolated from primary-color-component subfields as explained in the foregoing exemplary embodiment C2 of the invention or (B) both of single-color images that correspond to three primary color components and a single-color image that corresponds to a certain white component are displayed without any isolation between primary-color-component subfields and the white-component subfield as explained in the foregoing exemplary embodiment C3 of the invention can be made on an individual-decision basis for each of a plurality of white components that are extracted from a display color specified by an input image signal S1. For example, as illustrated in FIG. 31, in the case of a configuration example in which two white components W1 and W2 are extracted from a display color specified by an input image signal S1, both of single-color images that correspond to three primary color components R, G, and B and a single-color image that corresponds to the first white component W1 are displayed without any isolation between primary-color-component subfields and the white-component subfield as explained in the foregoing exemplary embodiment C3 of the invention, whereas a single-color image that corresponds to the second white component W2 is displayed in a dedicated or discreet white-component subfield SF5 that is isolated from other (i.e., primary-color-component and the first-white-component) subfields as explained in the foregoing exemplary embodiment C2 of the invention. As another example, as illustrated in FIG. 32, in the case of a configuration example in which three white components W1, W2, and W3 are extracted from a display color specified by an input image signal S1, both of single-color images that correspond to three primary color components R, and B and single-color images that correspond to the first white component W1 and the second white component W2 are displayed without any isolation between primary-color-component subfields and the white-component subfields as explained in the foregoing exemplary embodiment C3 of the invention, whereas a single-color image that corresponds to the third white component W3 is displayed in a dedicated or discreet white-component subfield SF6 that is isolated from other (i.e., primary-color-component and the first-and-second-white-component) subfields as explained in the foregoing exemplary embodiment C2 of the invention.

Embodiment D1

Figure 33:
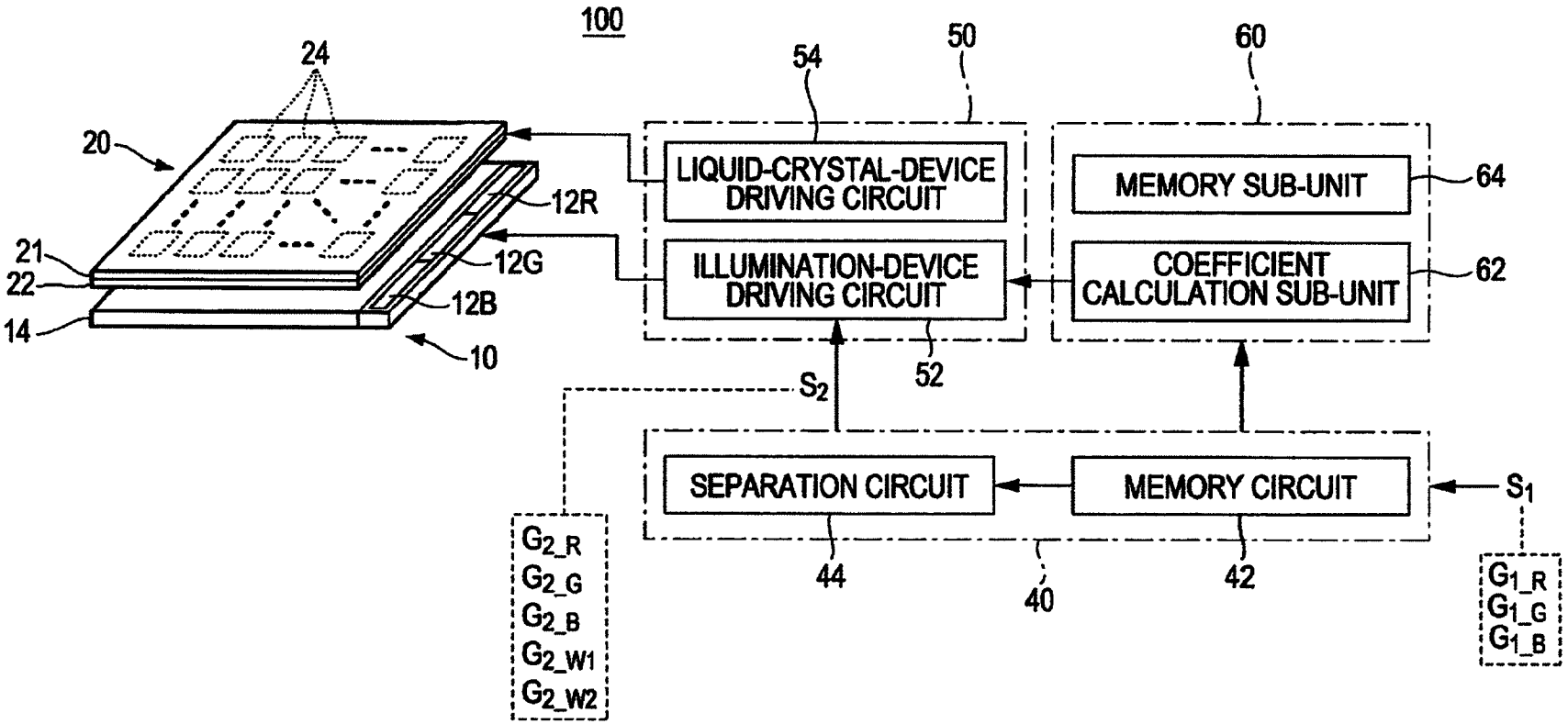
FIG. 33 is a diagram that schematically illustrates an example of the configuration of a display device according to an exemplary embodiment D1 of the invention.

FIG. 33 is a diagram that schematically illustrates an example of the configuration of a display device according to an exemplary embodiment D1 of the invention. As illustrated in FIG. 33, an image display device 100 is provided with an illumination device 10, a liquid crystal device 20, an image-processing unit 40, a controlling unit 50, and a brightness-level controlling unit (i.e., luminance controlling unit) 60. The image-processing unit 40, the controlling unit 50, and the brightness-level controlling unit 60 may be provided in a single integrated circuit. Or, these image-processing unit 40, controlling unit 50, and brightness-level controlling unit 60 may be provided in more than one integrated circuit in a discrete manner.

Figure 34:
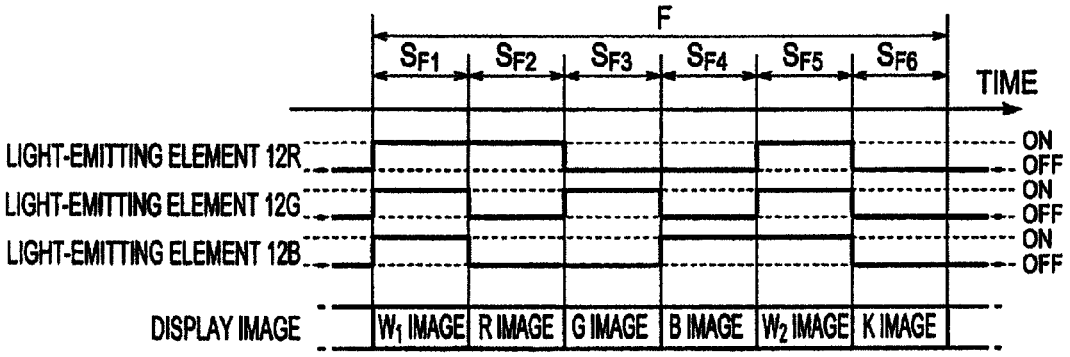
FIG. 34 is a timing chart that schematically illustrates an example of the timing operation of a display device according to the exemplary embodiment D1 of the invention.

The illumination device 10 and the liquid crystal device 20 function in cooperation with each other so as to display a color image. FIG. 34 is a timing chart that schematically illustrates an example of the timing operations of the illumination device 10 and the liquid crystal device 20 according to an exemplary embodiment of the invention. As illustrated in FIG. 34, the frame F is time-divided into a plurality of sub-fields SF. In the illustrated embodiment of the invention, one frame F is time-divided into six sub-fields, which are denoted as SF1, SF2, SF3, SF4, SF5, and SF6. The illumination device 10 and the liquid crystal device 20 sequentially display a plurality of single-color images, that is, images each of which corresponds to an individual single-color component displayed in corresponding one of sub-fields SF. That is, the illumination device 10 and the liquid crystal device 20 perform so-called field sequential display. A user who observes the display screen of the image display device 100 views these single-color images displayed in the respective sub-fields SF in a sequential manner. As a result thereof, they visually perceive a color image that is formed as a mixture of these individual single color components.

As illustrated in FIG. 33, an input image signal S1 is supplied from an external device that is not shown in the drawing to the image-processing unit 40. The input image signal 51 individually specifies a gradation value for each of three primary color components, that is, R color component (i.e., R component), G color component (i.e., G component), and B color component (i.e., B component), which make up the display color of a pixel. The image-processing unit 40 is, as in the configuration of the foregoing exemplary embodiment A1 of the invention, provided with a memory circuit 42 and a separation circuit 44. Hereafter, the term "color separation" is used with no intention to limit the scope of the invention. The memory circuit 42 stores an input image signal S1 for each frame F. The color separation circuit 44 generates a color separation image signal S2 from the input image signal S1 that has been memorized in the memory circuit 42 and then outputs the generated color separation image signal S2. As illustrated in FIG. 33, the color separation image signal S2 according to the present embodiment of the invention specifies the gradation G2_W1 of a first white component W1 and the gradation G2_W2 of a second white component W2 in addition to the gradation G2_R of the R color component, the gradation G2_G of the G color component, and the gradation G2_B of the B color component. The color separation image signal S2 is generated through the same processing as that explained above while referring to FIGS. 3, 4, and 5 in the foregoing first exemplary embodiment A1 of the invention. As has already been explained earlier while referring to FIGS. 12, 13, and 14, the number of white components split after the extraction thereof and the display order/positions (i.e., sub-field arrangement order/positions) of the single-color images of white components are not restrictively specified herein and thus may be arbitrary modified.

The controlling unit 50 illustrated in FIG. 33 is a circuit that drives (i.e., controls) the operations of the image display device 10 and the liquid crystal device 20. The controlling unit 50 is provided with an illumination-device driving circuit 52, which drives the illumination device 10, and a liquid-crystal-device driving circuit 54, which drives the liquid crystal device 20. The operations of the illumination-device driving circuit 52 and the liquid-crystal-device driving circuit 54 are the same as those explained in the foregoing exemplary embodiment A1 of the invention.

Figure 36:
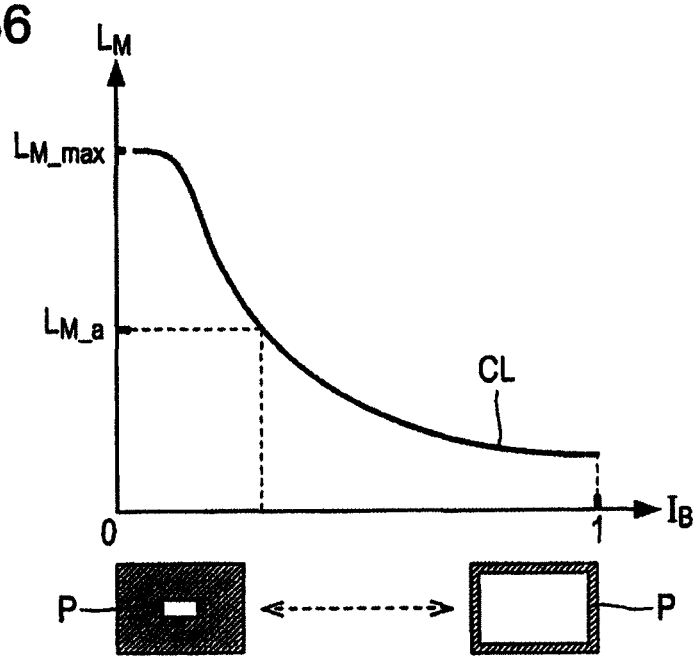
FIG. 36 is a graph that illustrates an example of a brightness curve according to the exemplary embodiment D1 of the invention.

Next, the configuration of the brightness-level controlling unit 60 and the operation thereof, which is shown in FIG. 33, are explained below. The brightness-level controlling unit 60 is a device that controls the entire brightness (i.e., luminance) of display performed by the image display device 100. In the present embodiment of the invention, the brightness-level controlling unit 60 controls the brightness (level) of the illumination device 10. The brightness-level controlling unit 60 is provided with a coefficient calculation sub-unit 62 and a memory sub-unit 64. The coefficient calculation sub-unit 62 of the brightness-level controlling unit 60 calculates a correction coefficient (i.e., correction factor) K on the basis of the input image signal S1 that is stored in the memory circuit 42 of the image-processing unit 40. The memory sub-unit 64 of the brightness-level controlling unit 60 pre-stores a brightness curve (i.e., luminance curve) CL, which is used for the computation of the correction coefficient K performed by the coefficient calculation sub-unit 62 thereof. An example of the brightness curve CL is illustrated in FIG. 36. The brightness-level controlling unit 60 controls the operation of the illumination-device driving circuit 52 so that the illumination device 10 should emit light at a brightness level in accordance with the correction coefficient K in each sub-field SF.

Figure 35:
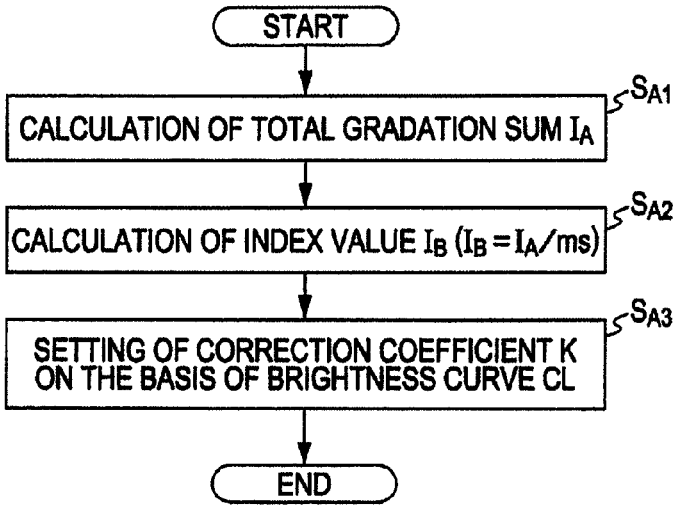
FIG. 35 is a flowchart that illustrates an example of the operation of a coefficient calculation sub-unit according to the exemplary embodiment D1 of the invention.

FIG. 35 is a flowchart that illustrates an example of the operation of the coefficient calculation sub-unit 62 according to the present embodiment of the invention. The processing flow illustrated in FIG. 35 is executed at each time when an input image signal S1 is memorized in the memory circuit 42 for one frame F. FIG. 36 is a graph that shows an example of the brightness curve CL that is stored in the memory sub-unit 64.

As illustrated in the flowchart of FIG. 35, as a first step thereof, the coefficient calculation sub-unit 62 calculates the total sum IA of gradation values G0 of all pixels of a display image (step SA1). The gradation value G0 of each pixel is a value that depends on the gradation G1_R of the R component, the gradation G1_G of the G component, and the gradation G1_B of the B component. For example, the weighted sum of these three gradations G1_R, G1_G, and G1_B is computed as the gradation value G0.

In the next step, the coefficient calculation sub-unit 62 calculates an index value IB on the basis of the total sum IA calculated in the preceding step SA1 (step SA2). The index value IB is a value that indicates the degrees of lightness and darkness of an image in a frame F. The ratio of the total sum (IA) to a predetermined value (mS), which is mathematically expressed as IA/mS, is preferably adopted as the index value IB. For example, the predetermined value mS is a total sum value IS that is obtained under an assumption that the maximum value of the gradation (G0) is specified for all pixels of a display image. The maximum gradation value is a gradation that corresponds to white display. That is, the total sum value (IS) is calculated as the result of multiplying the total number of pixels by the maximum value of the gradation G0. As illustrated in FIG. 36, assuming an imaging condition in which a white rectangular subject image (e.g., window) P is displayed against a low-gradation background such as a black background, as the size of the subject image P increases, so does the index value IB. Therefore, rephrasing the above, the index value IB can also be defined as a value that indicates the area-occupation percentage of a high-gradation subject image P in the entire region of an image display area, that is, a value that indicates the relative size of the subject image P.

Referring back to FIG. 35, the coefficient calculation sub-unit 62 sets the aforementioned correction coefficient K in such a manner that the index value IB that was calculated in the preceding step SA2 and an actual brightness of the illumination device 10 satisfy a predetermined relationship that is expressed as the brightness curve CL (step SA3). As shown in FIG. 36, the brightness curve CL defines the relation between the index value IB and a brightness level (i.e., luminosity) LM in such a manner that the brightness LM of the illumination device 10 decreases as the index value IB increases. The coefficient calculation sub-unit 62 finds a value of the brightness LM that corresponds to the calculated index value IB on the basis of the brightness curve CL. Then, the coefficient calculation sub-unit 62 sets the correction coefficient K on the basis of the identified brightness LM. As illustrated in FIG. 36, it is assumed here that the value of the brightness LM corresponding to the minimum value of the index IB is LM_max. It is further assumed that the value of the brightness LM corresponding to the calculated index value IB is LM_a. In such a case, the correction coefficient K is set at a value that is mathematically expressed as LM_a/LM_max, that is, the ratio of the found brightness value LM_a to the maximum brightness value LM_max.

The illumination-device driving circuit 52 illustrated in FIG. 33 controls the operation of the light-emitting element 12 (i.e., 12R, 12Q and 12B) in such a manner that the brightness of the illumination device 10 increases as the correction coefficient K calculated by the brightness-level controlling unit 60 increases. That is, the brightness of the illumination device 10 increases as the number of pixels for which high gradation is specified decreases in a display image. If this is paraphrased, the brightness of the illumination device 10 decreases as the number of pixels for which high gradation is specified increases in a display image. For example, the index IB takes a small value for an image in which minute high-gradation picture elements such as white dots are interspersed against a low-gradation background. Since the brightness of the illumination device 10 is high for such a small index value IB, each of the minute picture elements is displayed in a clear manner. On the other hand, the index IB takes a large value for an image that has high gradation as a whole (i.e., an image having a small number of low-gradation picture elements). Since the brightness of the illumination device 10 is low for such a large index value IB, the power consumption of the illumination device 10 is reduced. That is, the image display device 100 according to the present embodiment of the invention makes it possible to achieve high-contrast display while reducing power consumption thereof.

Figure 37:
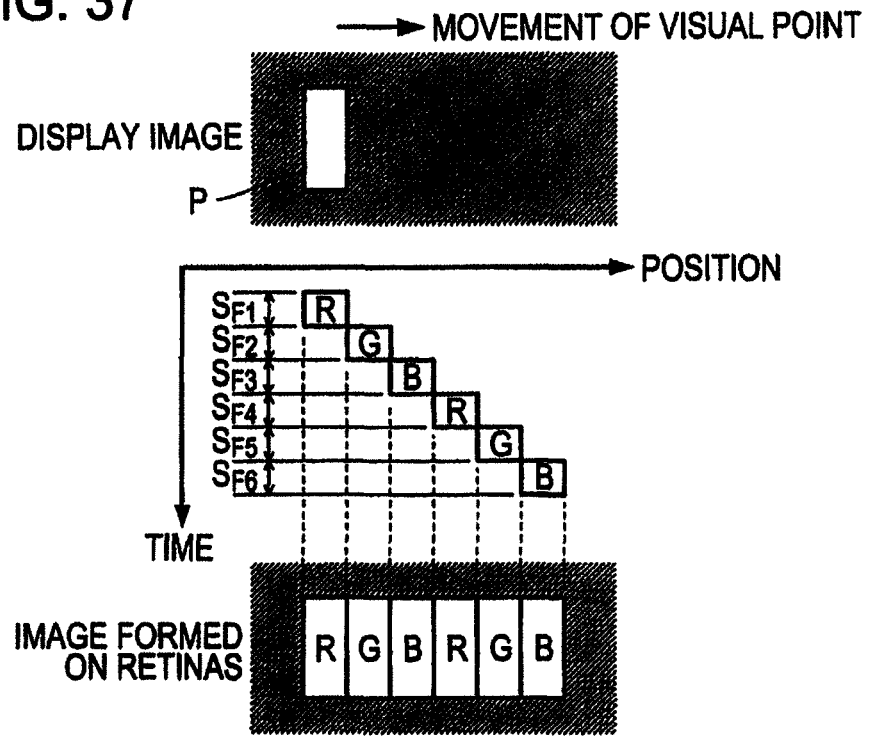
FIG. 37 is a diagram that schematically illustrates the principle of color-breakup perception (comparative example B).
Figure 38:
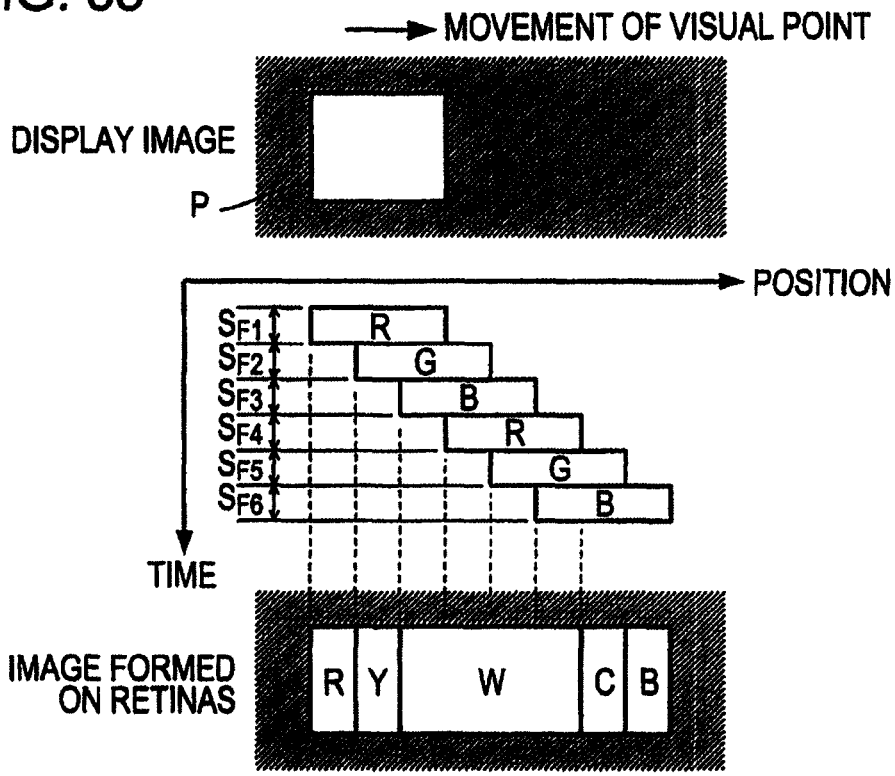
FIG. 38 is a diagram that schematically illustrates the principle of color-breakup perception (comparative example B).

In the following description, a comparative study on the occurrence of the aforementioned color breakup image problem is conducted between the configuration of the image display device 100 according to the present embodiment D1 of the invention and a configuration in which the single-color images of primary color components only are displayed in each sub-field SF without extracting white components from an input display color. It should be noted that such a primary-color-only-display configuration is referred to as a "comparative example B" in the following description. Each of FIGS. 37 and 38 is a concept diagram that schematically illustrates an example of the formation of a perceived image on the retinas of an observer as a result of the displaying of a white imaging-target object (i.e., subject image) P in the configuration of the comparative example B. Note that white is the mixed color component that is formed as a result of the mixture of all three primary color components. In each of FIGS. 37 and 38, it is assumed that a visual point of a user who observes the display screen thereof moves to the right instantaneously. Such an instant movement of a visual point is called as a saccade, which can be further defined as, simply said, a fast movement of an eye (i.e., eyeball). The horizontal dimension of the displayed subject image P shown in FIG. 37 (which shows the comparative example B) is smaller than that of the displayed subject image P shown in FIG. 38 (which also shows the comparative example B).

If the vector amount of the movement of a visual point during the sub-field SF is substantially equal to or smaller than the horizontal dimension of the imaging-target object (i.e., subject image) P, as illustrated in FIG. 37, the single-color images of primary color components displayed during the respective sub-fields SF do not overlap on the retinas of an observer. Therefore, the observer perceives a color breakup, that is, an array of a plurality of primary color components, in a conspicuous manner. On the other hand, referring to FIG. 38, if a visual point of a user who observes the display screen thereof moves at the substantially same speed as that of FIG. 37, since the horizontal dimension of the displayed subject image P shown in FIG. 38 is larger than that of the displayed subject image P shown in FIG. 37, the single-color images of primary color components displayed during the respective sub-fields SF overlap on the retinas of the user. Therefore, the observer perceives a mixed display color out of two primary color components where two of the single-color images of primary color components overlap each other. In addition, the observer perceives mixed white out of three primary color components where three of the single-color images of primary color components overlap one another. Therefore, a color breakup perceived by the observer becomes less conspicuous in comparison with that perceived under the condition illustrated in FIG. 37. As explained above, generally speaking, a color breakup that is caused by field-sequential display becomes more conspicuous as the size of the subject image P becomes smaller.

The brightness curve CL shown in FIG. 36 is prepared in such a manner that the brightness LM of the illumination device 10 (i.e., display brightness) increases as the size of the subject image P that is displayed in an image display area decreases. Therefore, if a small subject image P is displayed in the configuration of the comparative example B while controlling display brightness so as to satisfy the relationship expressed as the brightness curve CL shown in FIG. 36, a color breakup that is perceived by the observer becomes very conspicuous because of a combination of two unfavorable reasons: that is, firstly, there is no or little, if any, overlap of the single-color images of primary color components displayed during the respective sub-fields SF on the retinas of the user because of the small horizontal dimension of the displayed subject image P; and, secondly, each of the single-color images of primary color components is displayed at a high brightness level. In contrast, in the configuration of the image display device 100 according to the present embodiment D1 of the invention, a color breakup is reduced thanks to the display of, in each frame F, the single-color images of white components that are extracted from a display color specified by an input image signal S1. Therefore, as a non-limiting advantage thereof, despite the fact that the controlling of the brightness of the illumination device 10 on the basis of the brightness curve CL could be a cause for making a color breakup more conspicuous, the image display device 100 according to the present embodiment D1 of the invention is still capable of achieving a quite satisfactory reduction in the aforementioned color-breakup phenomenon in an image visually perceived by a user who observes the display screen thereof.

In a configuration such as that of the aforementioned related art described in JP-A-2002-169515 according to which a single-color image of a white component that is extracted from a display color specified by an input image signal S1 is displayed in only one sub-field SF unlike the present embodiment of the invention, the gradation of the single-color image of the white component is significantly higher than that of the single-color images of other color components especially if the display color of an image is close to white. In addition, the brightness of the illumination device 10 is relatively high when a white subject image P having a relatively small size is displayed. Therefore, the gradation of the single-color image of the white component becomes very high for these reasons. Consequently, in the aforementioned related art described in JP-A-2002-169515, an observer perceives conspicuous flickers because single-color images of primary color components each having a low gradation and a single-color image of a white component having a high gradation are displayed in a field-sequential manner. In the configuration of the image display device 100 according to the present embodiment of the invention, as has already been explained earlier, if the combined gradation of the pre-separation "white" component (corresponding to W1+W2), or in other words, the minimum value Gmin, contained in a display color specified by the input image signal S1 is greater than the threshold value TH1, the pre-separation white component is split into the first actual white component W1 and the second actual white component W2 at the boundary of the threshold value TH1 in the white extraction process. Then, these split white components are respectively displayed in separate sub-fields SF that are "time-isolated" from each other; specifically, the first white component W1 is displayed in the first sub-field SF1 whereas the second white component W2 is displayed in the fifth sub-field SF5 in the illustrated configuration thereof according to the present embodiment of the invention. This means that a difference between the gradations of primary-color-component single-color images and the gradations of white-component single-color images is made smaller. Therefore, in comparison with the configuration of the aforementioned related art described in JP-A-2002-169515, the image display device 100 according to the present embodiment of the invention has an advantage in that it can reduce flickers, which is the same non-limiting advantageous effects of the invention as those offered by the image display device 100 according to the foregoing exemplary embodiment A1 of the invention. Furthermore, as is the case with the image display device 100 according to the foregoing exemplary embodiment A1 of the invention, in the configuration of the image display device 100 according to the present embodiment of the invention, it is possible to offset an increase in flickers due to the insertion of a black-image display by a decrease therein achieved by the time-separated display of split white components.

Embodiment D2

Next, an exemplary embodiment D2 of the invention is explained below. In the configuration of the image display device 100 according to the present embodiment D2 of the invention, as done in the foregoing exemplary embodiment B1 of the invention, a single-color image of the same color component is displayed sequentially in the plurality of unit display areas A in each sub-field SF, or as a modification thereof, a single-color image of different color components is displayed sequentially therein. With such a configuration, it is possible to effectively prevent the occurrence of the aforementioned color-breakup image problem that is attributable to a difference between the actual movement of a subject image P and the movement of a visual point of a user.

The brightness-level controlling unit 60 controls the display brightness of each of the plurality of unit display areas A in the same manner as done in the preceding embodiment D1 of the invention. More specifically, the coefficient calculation sub-unit 62 sets, for each of the plurality of unit display areas A, a correction coefficient K in such a manner that an index value IB that was calculated on the basis of the gradation value G0 of each of pixels arrayed in the unit display area A and the actual brightness LM of an area illumination unit B of the illumination device 10 that corresponds to (i.e., is provided opposite to) the unit display area A satisfy a predetermined relationship that is expressed as a brightness curve CL.

The illumination-device driving circuit 52 controls the operation of the light-emitting element 12 (i.e., 12R, 12G, and 12B) of each of the area illumination units B in such a manner that the brightness of the area illumination unit B corresponding to the unit display area A increases as the correction coefficient K calculated for the unit display area A by the brightness-level controlling unit 60 increases. That is, the brightness of the area illumination unit B of the illumination device 10 increases as the number of pixels for which high gradation is specified decreases in an image displayed in the unit display area A corresponding to the area illumination unit B. With the above-described configuration, the image display device 100 according to the present embodiment D2 of the invention makes it possible to achieve high-contrast display while reducing power consumption thereof.

Despite the fact that the controlling of the brightness of each of the area illumination units B of the illumination device 10 on the basis of the brightness curve CL could be a cause for making a color breakup more conspicuous, the image display device 100 according to the present embodiment D2 of the invention is still capable of effectively suppressing the aforementioned color-breakup phenomenon in an image visually perceived by a user who observes the display screen thereof thanks to the sequential displaying of a single-color image of the same color component in the plurality of unit display areas A in each sub-field SF, or as a modification thereof, thanks to the sequential displaying of a single-color image of different color components therein, which is the same non-limiting advantageous effects of the present embodiment of the invention as those offered by the image display device 100 according to the foregoing exemplary embodiment B1 of the invention. Moreover, since display brightness is controlled for each of the unit display areas A in the configuration of the image display device 100 according to the present embodiment D2 of the invention, it is possible to satisfy both of a reduction in power consumption and a reduction in the occurrence of the color-breakup image problem in a compatible manner depending on the content of an image that is displayed in each of the unit display areas A.

Embodiment D3

Next, an exemplary embodiment D3 of the invention is explained below. In the configuration of the image display device 100 according to the present embodiment D3 of the invention, as done in the foregoing exemplary embodiment C1 of the invention, single-color images of color components different from one another are displayed in the unit display areas A, which are divided portions of the image display area 25. Therefore, the image display device 100 according to the present embodiment D3 of the invention makes it possible to achieve a greater reduction in the aforementioned color-breakup phenomenon in an image visually perceived by a user who observes the display screen thereof in comparison with a configuration in which the single-color images of the same color component are displayed in the entire region of the image display area 25 during each sub-field SF of a frame F.

The brightness-level controlling unit 60 controls the display brightness of each of the plurality of unit display areas A, that is, the brightness of each of the plurality of area illumination units B, in the same manner as done in the preceding embodiment D2 of the invention. That is, the brightness of the area illumination unit B of the illumination device 10 increases as the number of pixels for which high gradation is specified decreases in an image displayed in the unit display area A corresponding to the area illumination unit B. With the above-described configuration, the image display device 100 according to the present embodiment D3 of the invention makes it possible to achieve high-contrast display while reducing power consumption thereof. Despite the fact that the controlling of the brightness of each of the area illumination units B of the illumination device 10 on the basis of the brightness curve CL could be a cause for making a color breakup more conspicuous, the image display device 100 according to the present embodiment D3 of the invention is still capable of effectively suppressing the aforementioned color-breakup phenomenon in an image visually perceived by a user who observes the display screen thereof thanks to the parallel displaying of single-color images of color components different from one another in the unit display areas A, which is the same non-limiting advantageous effects of the present embodiment of the invention as those offered by the image display device 100 according to the foregoing exemplary embodiment C1 of the invention. Moreover, since display brightness is controlled for each of the unit display areas A in the configuration of the image display device 100 according to the present embodiment D3 of the invention, it is possible to satisfy both of a reduction in power consumption and a reduction in the occurrence of the color-breakup image problem in a compatible manner depending on the content of an image that is displayed in each of the unit display areas A.

Size of Unit Display Area A

Next, the determination of an appropriate size of each unit display area A in the foregoing exemplary embodiments B1, B2, C1, C2, D2, and D3 of the invention is explained below.

Figure 39:
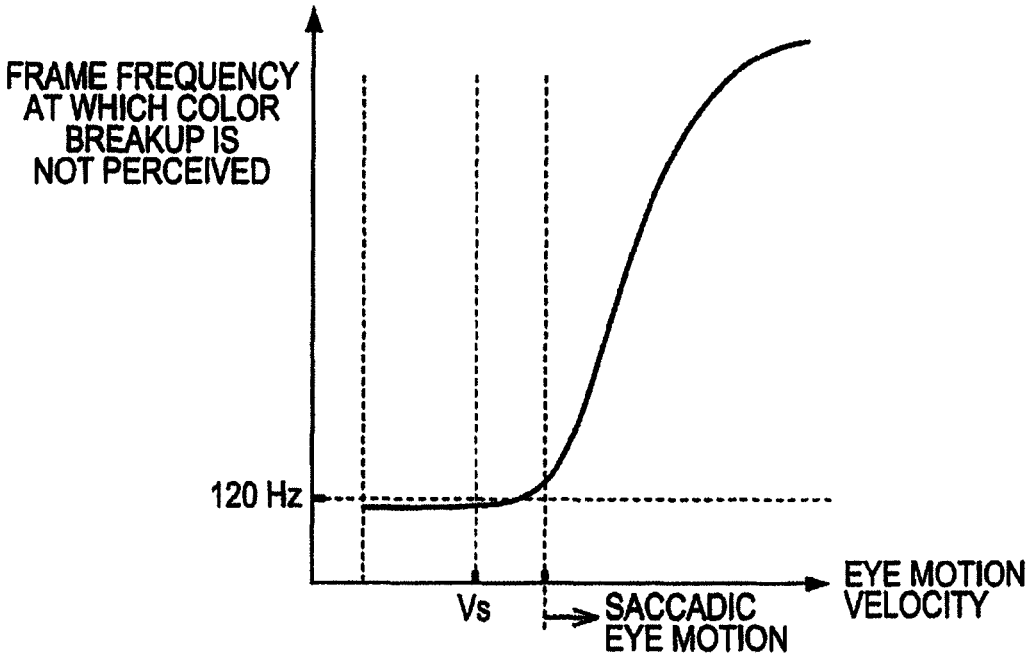
FIG. 39 is a graph that shows a relationship between the motion velocity of the eyes of an observer and a frame frequency at which a color breakup is not perceived by the observer.

FIG. 39 is a graph that shows a relationship between the motion velocity of the eyes of an observer and a frame frequency at which a color breakup is not perceived by the observer. As shown in the graph of FIG. 39, when the eyes of an observer move at a high speed, for example, in the case of saccadic eye motion, a color breakup image problem arises unless a frame frequency is set at a sufficiently high value. On the other hand, if the eyes of an observer move at a low speed such as a motion velocity value Vs or so shown in FIG. 39, the observer does not perceive any substantial color breakup even at a not-so-high frame frequency of 120 Hz, which is double-speed display.

Figure 40:
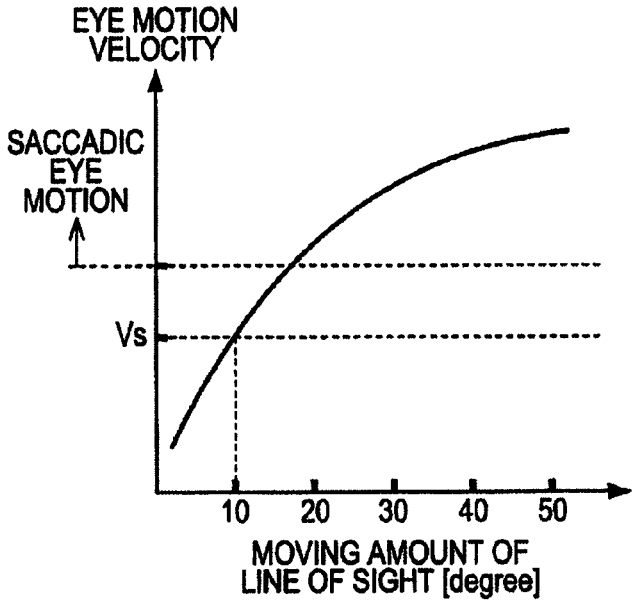
FIG. 40 is a graph that shows a relationship between the moving amount of a line of sight and the motion velocity of the eyes of an observer.

FIG. 40 is a graph that shows a relationship between the moving amount of a line of sight and the motion velocity of the eyes of an observer. In this graph, the moving amount of a line of vision is shown in the unit of an angular distance, that is, degrees. As shown in the graph of FIG. 40, the motion velocity of the eyes of an observer increases as the moving amount of a line of sight increases. For example, as shown therein, if the moving amount of a line of sight of an observer is approximately 10°, the motion velocity of the eyes of the observer takes the above-described value Vs at which the observer does not perceive a color breakup even at a double-speed (i.e., low) frame frequency of 120 Hz. That is, if the moving amount of a line of sight is ten degrees or less, an observer perceives almost no color breakup. Therefore, in the present embodiment of the invention, the dimension of each of the unit display areas A is determined while ensuring that the moving amount of a line of sight of an observer in each thereof is ten degrees or less.

Figure 41:
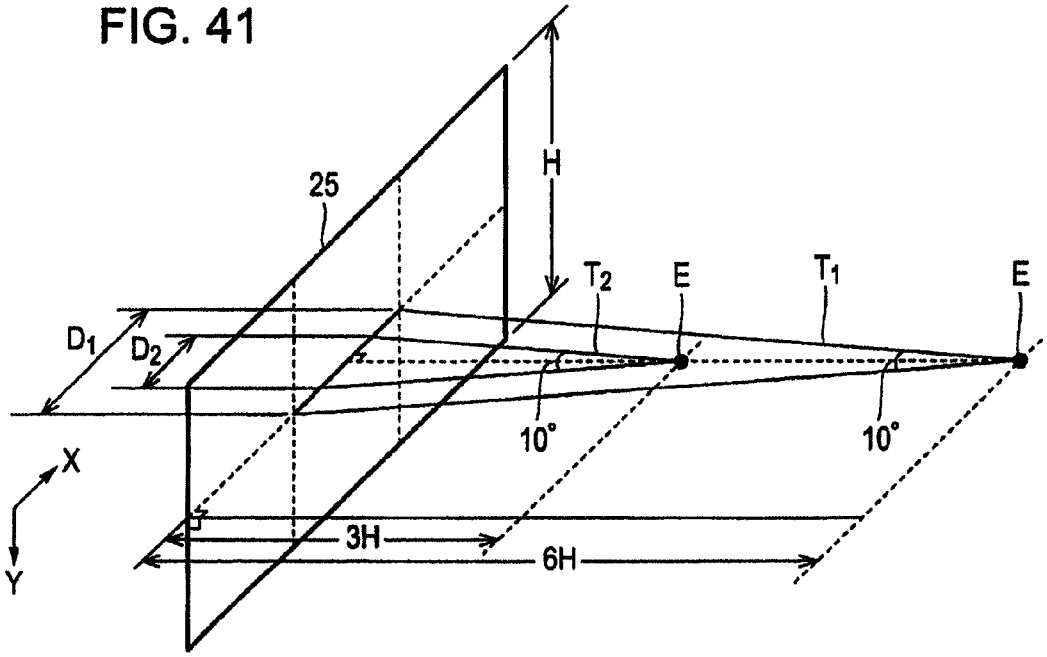
FIG. 41 is a diagram that schematically illustrates a method for determining the size of a unit display area according to an exemplary embodiment of the invention.

FIG. 41 is a diagram that schematically illustrates an example of a positional relationship between the image display area 25 and the eye E of an observer. A normal distance between the image display area 25 and the eye E of an observer does not exceed a value that is obtained as the result of multiplying the dimension of a short side, which is typically a height, of the image display area 25 by approximately six. That is, if the short side (e.g., height) of the image display area 25 is denoted as H as shown therein, a normal distance between the image display area 25 and the eye E of an observer does not exceed 6H. Therefore, the X-axis dimension (or Y-axis dimension) of the unit display area A is defined as, as illustrated in FIG. 41, the dimension (i.e., length) D1 of the base of an isosceles triangle T1 that has the vertex angle of 10° and the height of 6H. Preferably, the vertex angle of the isosceles triangle T1 should be 5°. Assuming a case where the eye E of an observer can sometimes approach the image display area 25 in such a manner that the distance between the image display area 25 and the eye E of an observer becomes as close as three times of the short side H of the image display area 25, the X-axis dimension (or Y-axis dimension) of the unit display area A should be defined as, as illustrated in FIG. 41, the length D2 of the base of an isosceles triangle T2 that has the vertex angle of 10° and the height of 3H. Preferably, the vertex angle of the isosceles triangle T2 should be 5°. To sum up, at least one of the X-axis dimension and the Y-axis dimension of the unit display area A should be set at a value that is not greater than the length D1 of the base of the isosceles triangle T1 that has the height of 6H illustrated in FIG. 41. More preferably, at least one of the X-axis dimension and the Y-axis dimension of the unit display area A should be set at a value that is not greater than the length D2 of the base of the isosceles triangle T2 that has the height of 3H illustrated in FIG. 41.

If the dimension of each of the unit display areas A having the same size as those of others is determined as described above, the moving amount of a line of sight of an observer never exceeds 10° in each one of the unit display areas A. Therefore, advantageously, it is possible to effectively prevent the occurrence of the aforementioned color-breakup image problem while avoiding any excessive heightening of a frame frequency. Rephrasing the above, with such a size determination, if the moving amount of a line of sight of an observer exceeds 10°, it follows that a visual point of the observer moves to another unit display area A. Therefore, in combination with the above-described configuration of the invention according to which single-color images are displayed in the unit display areas A during the respective sub-fields SF in a sequential manner, the unit-display-area size determination described herein makes it possible to suppress the aforementioned color-breakup image problem in each image visually perceived by a user who observes the display screen thereof.

It should be noted that a method for determining the size of the unit display area A is not limited to a specific example described above. For example, the number M of the unit display areas A that belong to each of the afore-mentioned first image display sub-area G1 and the afore-mentioned second image display sub-area G2 may be determined from the viewpoint of a color breakup reduction. As shown in FIG. 39, it is necessary to heighten a frame frequency in order to overcome a color breakup image problem when the motion velocity of the eyes of an observer is high. It is assumed here for the purpose of explanation that an NP-speed display is required for overcoming a color breakup image problem. The time length of a frame F at a standard frame frequency of 60 Hz is denoted as T (T=16.6 ms). In order to simplify explanation, the writing time period PW of each sub-field SF is ignored. Then, the time length of each of the display time periods P1, P2, and P3 thereof is expressed as approximately T/3 NP.

On the other hand, it is assumed here that the image display area 25 is divided into the M number of the unit display areas A as viewed along the X direction. It is further assumed that an N-speed display is performed. In order to simplify explanation, the writing time period PW of each sub-field SF is ignored. Then, the time length of each of the display time periods P1, P2, and P3 thereof is expressed as approximately T/3 NM. Therefore, if T/3 NP takes the same value as T/3 NM, it is possible to make the time length of each of the display time periods P1, P2, and P3 thereof equal to the time length thereof under the NP-speed display as a result of the division of the image display area 25 into the M number of the unit display areas A as viewed along the X direction. Thus, the number of divisions M that makes it possible to overcome a color breakup image problem is calculated by means of the following mathematical formula: M=NP/N. That is, the X-dimension of the unit display area A is mathematically expressed as 1/M of the X-dimension of the image display area 25. As explained above, it is possible to effectively prevent the occurrence of a color-breakup image problem by calculating the number of divisions (and thus the size of each thereof) of the unit display areas A in such a manner that the cycle of single-color image display in the unit display area A equals a cycle corresponding to the NP-speed display (i.e., a cycle corresponding to a predetermined frame frequency), which constitutes a non-limiting alternative method of the unit-display-area size determination described herein.

VARIATION EXAMPLES

Various kinds of changes, modifications, adaptations, variations, improvements, or the like may be made on the specific examples of the exemplary embodiments of the invention described above. Non-limiting variation examples thereof are described below. Note that any two or more of the following variation examples/modes can be combined with each other or one another.

(1) Variation Example 1

In each of the foregoing exemplary embodiments of the invention, it is assumed that each of the sub-fields SF that make up a frame F has the same time length as that of others. However, the scope of the invention is not limited to such an exemplary configuration. That is, the time length of each sub-field SF may be changed arbitrarily. For example, the time length of a black sub-field SF during which a black (K) image is displayed may be set at a value greater than the time length of other sub-fields SF, which is explained below as a first variation mode 1. As another variation example thereof, the time length of a first white sub-field SF during which a single-color image corresponding to a first white component W1 is displayed and/or the time length of a second white sub-field SF during which a single-color image corresponding to a second white component W2 is displayed may be set at a value greater than the time length of other sub-fields SF, which is explained below as a second variation mode 2. These variation modes are explained in detail below.

(a) Variation Mode 1

Figure 42:
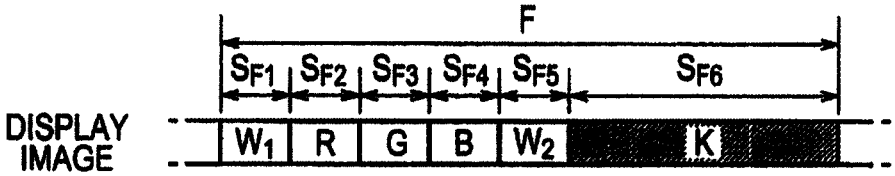
FIG. 42 is a timing chart that schematically illustrates an example of the timing operation of a display device according to a variation example of the invention.

FIG. 42 is a timing chart that schematically illustrates an example of sub-fields SF according to the first variation mode 1. As shown in FIG. 42, in the sub-field configuration of each frame F, the black sub-field SF6 during which a black image K is displayed is longer than the primary-color-component sub-fields SF2, SF3, and SF4 during which single-color images of primary color components are displayed and the white-component sub-fields SF1 and SF5 during which single-color images of white components are displayed.

Figure 43:
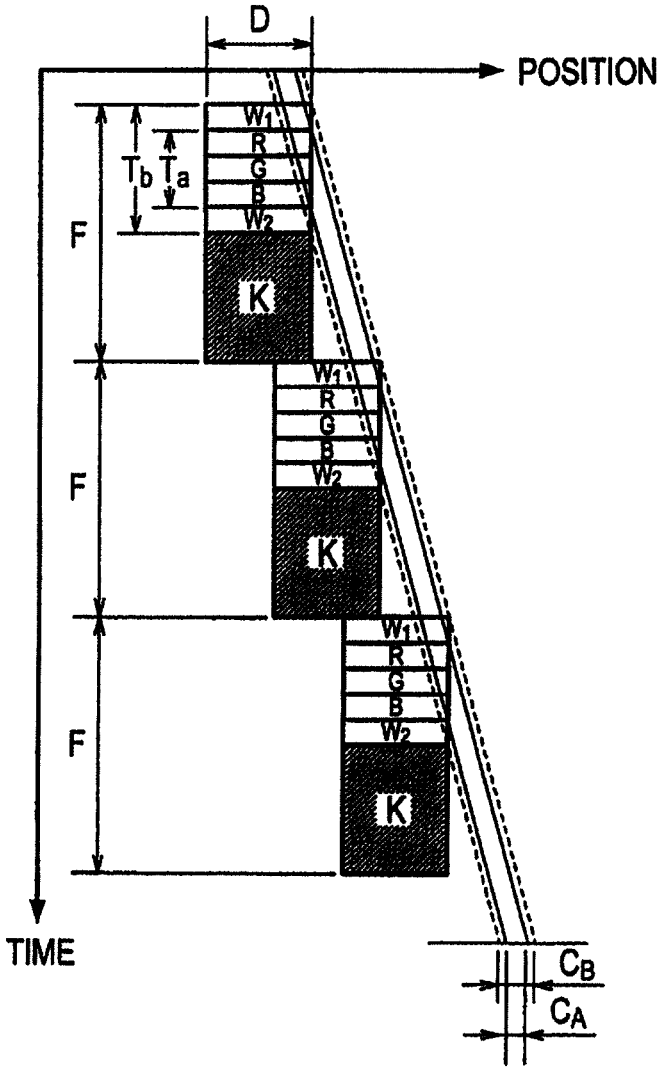
FIG. 43 is a diagram that schematically illustrates an example of the widths of a color breakup and a moving-picture blur that occur when a display device according to a variation example of the invention is adopted.

FIG. 43 is a concept diagram that schematically illustrates an example of a change in display color that occurs as time elapses with the sub-field time-length configuration of the first variation mode 1 when the movement of a subject image P illustrated in FIG. 6 is monitored as illustrated in FIGS. 7 and 8. As shown in FIG. 43, in comparison with a sub-field configuration in which an equal time length is allocated for each of sub-fields SF1-SF6, a time length Ta during which single-color images of primary color components are displayed under the sub-field configuration of the first variation mode 1 is shorter. For this reason, if the sub-field configuration of the first variation mode 1 is adopted, as illustrated in FIG. 43, the aforementioned color breakup width CA, which indicates a range in which a user perceives a color breakup, becomes smaller in comparison with that illustrated in FIG. 8. Moreover, in comparison with the sub-field configuration in which an equal time length is allocated for each of sub-fields SF1-SF6, a time length Tb during which single-color images of primary color components and single-color images of white components are displayed under the sub-field configuration of the first variation mode 1 is shorter by an increase in the time length of the black sub-field SF6. For this reason, if the sub-field configuration of the first variation mode 1 is adopted, as illustrated in FIG. 43, the aforementioned moving-picture blur width CB, which indicates a range in which a moving-picture blur is perceived, becomes smaller in comparison with that illustrated in FIG. 8.

Disadvantageously, however, flickers become more conspicuous to the eyes of an observer if the time length of the black sub-field SF6 during which a black image K is displayed is set at an excessively great value. For this reason, the time length of the black sub-field SF6 should be set at a time-percentage value smaller than 50% of each frame F. More preferably, the time length of the black sub-field SF6 should be set at a time-percentage value smaller than 30% thereof. On the contrary, if a higher priority should be given to a reduction in flickers due to the display of a black (K) image, it is preferable to adopt a configuration in which the time length of the black sub-field SF6 is equal to that of other sub-fields SF1-SF5. Or, in order to reduce flickers, the black sub-field SF6 can be omitted. In the explanation of the first variation mode 1 given above, the lengthening of the black K sub-field SF is applied to the foregoing exemplary embodiment A1 illustrated in FIG. 1. Notwithstanding the above, the same modification, that is, the lengthening of the black K sub-field SF, may be applied to any other foregoing exemplary embodiment of the invention.

(b) Variation Mode 2

Figure 44:
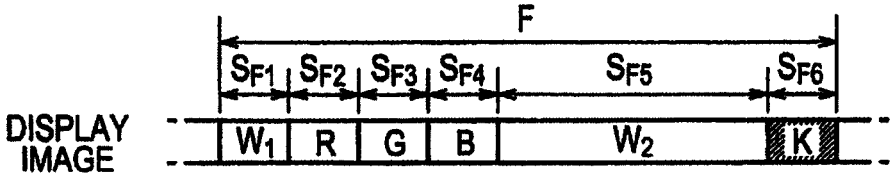
FIG. 44 is a timing chart that schematically illustrates an example of the timing operation of a display device according to a variation example of the invention.

FIG. 44 is a timing chart that schematically illustrates an example of sub-fields SF according to the second variation mode 2. As shown in FIG. 44, the fifth sub-field SF5 during which a single-color image of the second white component W2 is displayed has a time length greater than that of other sub-fields SF1, SF2, SF3, SF4, and SF6.

Figure 45:
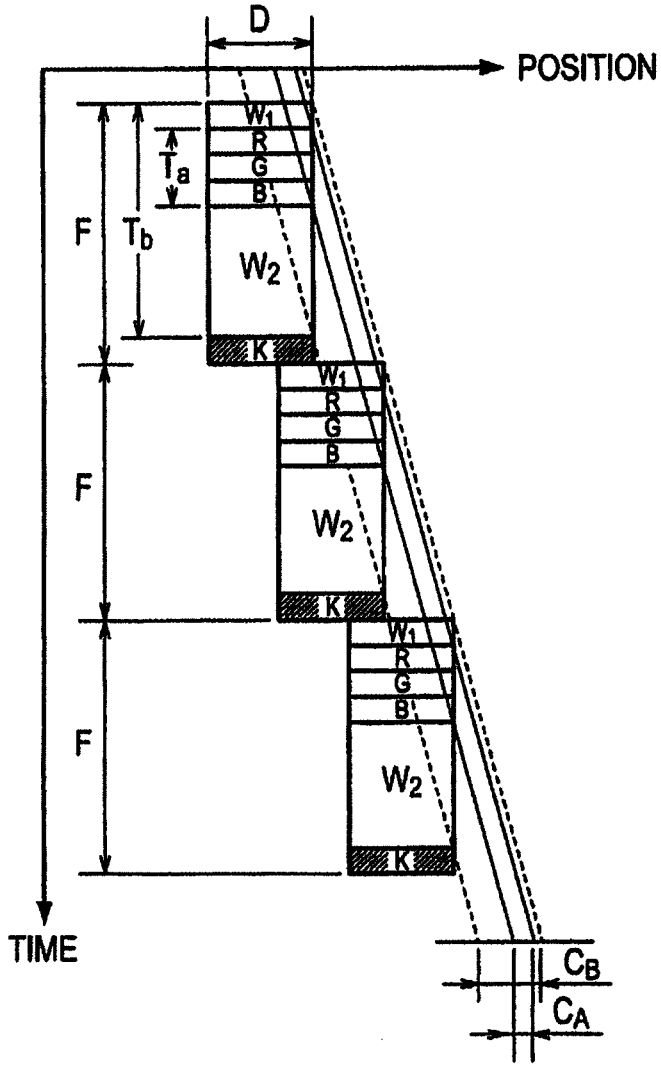
FIG. 45 is a diagram that schematically illustrates an example of the widths of a color breakup and a moving-picture blur that occur when a display device according to a variation example of the invention is adopted.

FIG. 45 is a concept diagram that schematically illustrates an example of a change in display color that occurs as time elapses with the sub-field time-length configuration of the second variation mode 2 when the movement of a subject image P illustrated in FIG. 6 is monitored as illustrated in FIGS. 7 and 8. As shown in FIG. 45, in comparison with a sub-field configuration in which an equal time length is allocated for each of sub-fields SF1-SF6, the time length Ta during which single-color images of primary color components are displayed under the sub-field configuration of the second variation mode 2 is shorter as is the case with the first variation mode 1 described above. For this reason, if the sub-field configuration of the second variation mode 2 is adopted, the color breakup width CA becomes smaller in comparison with that illustrated in FIG. 8. On the other hand, since the time length of the black sub-field SF6 during which a black image K is displayed under the second variation mode 2 is shorter than that of the first variation mode 1. Therefore, considering from the viewpoint of a reduction in the moving-picture blur width CB only, the first variation mode 1 is advantageous over the second variation mode 2. However, the lengthening of the second white sub-field SF5 for the second white component W2, which means or requires a shorter black sub-field SF6, is equivalent to the increasing of a light-emission duty. Therefore, the second variation mode 2 is advantageous over the first variation mode 1 in that it can offer a greater reduction in flickers.

In the explanation of the second variation mode 2 given above while referring to FIGS. 44 and 45, the time length of the second sub-field SF5 during which a single-color image corresponding to the second white component W2 is displayed is set at a greater value. Notwithstanding the above, the time length of the first sub-field SF1 during which a single-color image corresponding to the first white component W1 is displayed may be set at a greater value either in place of or in addition to the lengthening of the second white sub-field SF5 for the second white component W2. In the explanation of the second variation mode 2 given above, the lengthening of the white-component sub-field SF is applied to the foregoing exemplary embodiment A1 illustrated in FIG. 1. Notwithstanding the above, the same modification, that is, the lengthening of the white-component sub-field SF, may be applied to any other foregoing exemplary embodiment of the invention.

(2) Variation Example 2

In each of the foregoing exemplary embodiments of the invention (especially, in the embodiments B1, B2, C1, C2, D1, D2, and D3), the display color of each of the pixels may be separated into a plurality of color components and a plurality of white components, where the color components include a mixed color component (cyan, magenta, or yellow), as done in the foregoing exemplary embodiment A2 of the invention.

(3) Variation Example 3

Figure 46:
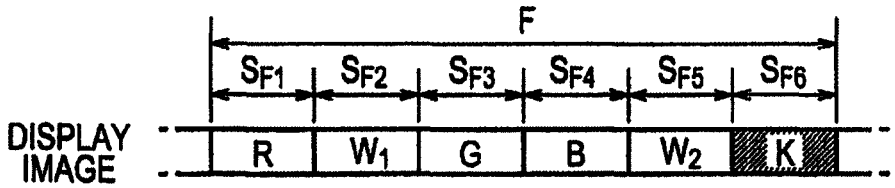
FIG. 46 is a timing chart that schematically illustrates an example of the timing operation of a display device according to a variation example of the invention.
Figure 47:
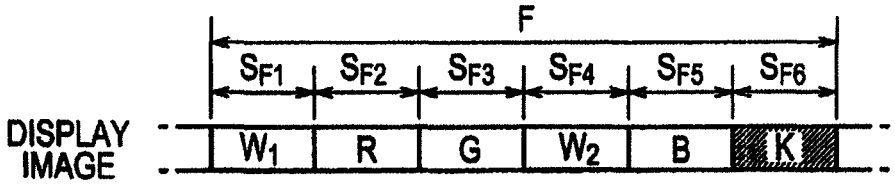
FIG. 47 is a timing chart that schematically illustrates an example of the timing operation of a display device according to a variation example of the invention.
Figure 48:
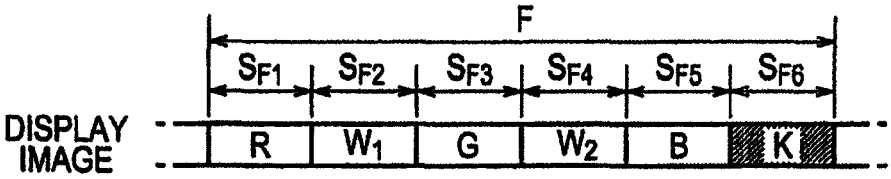
FIG. 48 is a timing chart that schematically illustrates an example of the timing operation of a display device according to a variation example of the invention.

In each of the foregoing exemplary embodiments of the invention (especially, in the embodiments A1, A2, B2, and C2), it is explained that the single-color images of white components W1 and W2 are displayed in white sub-fields SF allocated immediately before and after color sub-fields SF during which single-color images of color components, which means either primary color components or a combination of primary color components and mixed color components, are displayed. Notwithstanding the foregoing, the sequential order of these white sub-fields SF and color sub-fields SF may be arbitrarily modified. As a non-limiting modification example thereof, as illustrated in FIG. 46, the first white sub-field (SF2) during which the single-color image of the first white component W1 is displayed may be interposed between the red sub-field (SF1) during which the single-color image of the red component R is displayed and the green sub-field (SF3) during which the single-color image of the green component G is displayed. As another non-limiting modification example thereof, as illustrated in FIG. 47, the second white sub-field (SF4) during which the single-color image of the second white component W2 is displayed may be interposed between the green sub-field (SF3) during which the single-color image of the green component G is displayed and the blue sub-field (SF5) during which the single-color image of the blue component B is displayed. As still another non-limiting modification example thereof, as illustrated in FIG. 48, it is preferable to adopt a combination of the above-described modification examples illustrated in FIGS. 46 and 47 in which each of the first white sub-field and the second white sub-field is interposed between two primary-color sub-fields. With a modified configuration illustrated in any of FIGS. 46, 47, and 48, primary-color-component subfields during which single-color images of primary color components are displayed are distanced from each other or one another on a time axis with at least one white-component subfield being interposed therebetween. Therefore, in comparison with a sub-field configuration in which the primary-color subfields are allocated in a successive manner on the time axis, it becomes harder for a user who observes the display screen thereof to perceive the aforementioned color-breakup image problem.

(4) Variation Example 4

In each of the foregoing exemplary embodiments of the invention, it is explained that the illumination-device driving circuit 52 controls the illumination device 10 so as not to emit light in the last sub-field SF of each frame F. In addition thereto, in this last sub-field SF, the liquid-crystal-device driving circuit 54 supplies, to each pixel electrode 24, a data electric potential that reduces the transmission factor of liquid crystal to the minimum value. The aforementioned black (K) image is displayed, or in other words, display is suspended, as a result of the combination thereof. However, the scope of the invention is not limited to such an exemplary configuration. For example, either one of these may be performed in the last black sub-field SF. The black image K may be displayed at the first sub-field SF of each frame F. It should be noted that, in the above-described preferable exemplary configurations of the invention, the position of black sub-field allocated in each frame F and the display method of a black image K are not restrictively specified as long as display is suspended during a certain time period in the frame. As the word "preferable" suggests, such a black sub-field during which a black image K is displayed may be omitted.

(5) Variation Example 5

In each of the foregoing exemplary embodiments of the invention, it is explained that the light-emitting elements 12 (12R, 12G, and 12B) corresponding to respective primary color components are driven (i.e., operated) in combination of any two thereof so as to emit mixed-color light and/or in combination of all three thereof so as to emit white light onto the liquid crystal device 20. However, the scope of the invention is not limited to such an exemplary configuration. For example, the illumination device 10 may be provided with, in addition to primary-color-component light-emitting elements, mixed-color-component light-emitting elements and a white-component light-emitting element.

Applications

Next, an explanation is given below of a few non-limiting examples of a variety of electronic apparatuses to which an image display device according to an exemplary embodiment of the invention is applicable. Each of FIGS. 49, 50, and 51 shows an electronic apparatus that adopts the image display device 100 according to any of the exemplary embodiments of the invention described above, including variation examples and modifications thereof.

Figure 49:
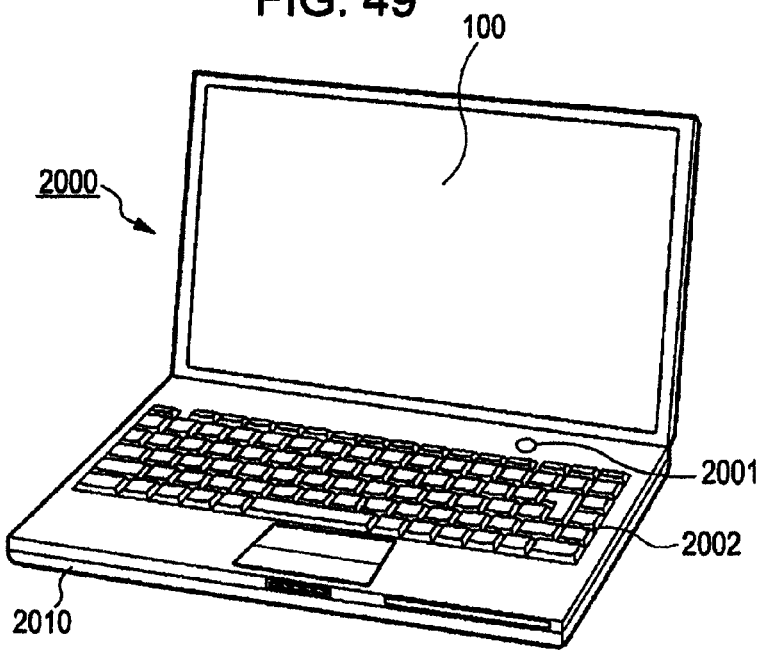
FIG. 49 is a perspective view that schematically illustrates an example of an electronic apparatus (a personal computer) to which a display device according to an exemplary embodiment of the invention is applied.

FIG. 49 is a perspective view that schematically illustrates an example of the configuration of a mobile personal computer that adopts the image display device 100 according to an exemplary embodiment of the invention. As illustrated in the drawing, a personal computer 2000 is made up of, though not limited thereto, a display unit that displays a variety of images to which the image display device 100 according to the foregoing exemplary embodiments of the invention is applied and a computer main assembly 2010 that is provided with a power switch 2001 and a keyboard 2002.

Figure 50:
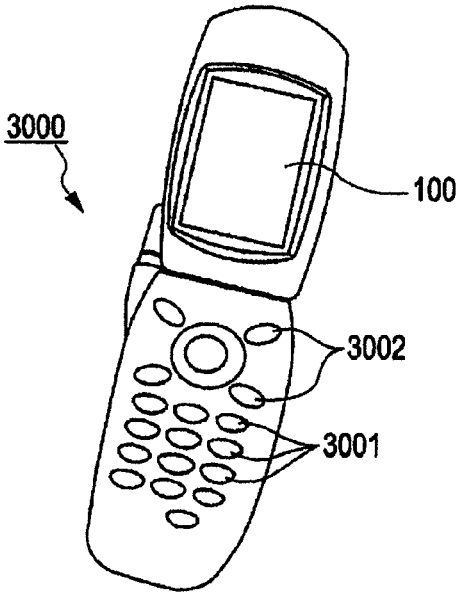
FIG. 50 is a perspective view that schematically illustrates an example of an electronic apparatus (a mobile phone) to which a display device according to an exemplary embodiment of the invention is applied.

FIG. 50 is a perspective view that schematically illustrates an example of the configuration of a mobile phone to which the image display device 100 according to an exemplary embodiment of the invention is applied. As illustrated in the drawing, a mobile phone 3000 is provided with, though not limited thereto, a display unit that displays a variety of images to which the image display device 100 according to the foregoing exemplary embodiments of the invention is applied as well as a plurality of manual operation buttons 3001 and scroll buttons 3002. As a user manipulates the scroll buttons 3002, content displayed on the screen of the image display device 100 is scrolled.

Figure 51:
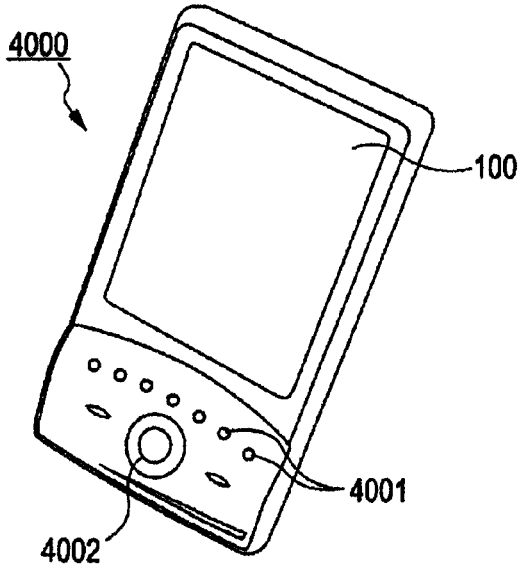
FIG. 51 is a perspective view that schematically illustrates an example of an electronic apparatus (a personal digital assistant) to which a display device according to an exemplary embodiment of the invention is applied.

FIG. 51 is a perspective view that schematically illustrates an example of the configuration of a personal digital assistant (PDA) that adopts the image display device 100 according to an exemplary embodiment of the invention. As illustrated in the drawing, a personal digital assistant 4000 is provided with, though not limited thereto, a display unit that displays a variety of images to which the image display device 100 according to the foregoing exemplary embodiments of the invention is applied as well as a plurality of manual operation buttons 4001 and a power switch 4002. As a user manipulates the power switch 4002, various kinds of information including but not limited to an address list or a schedule table is displayed on the image display device 100.

Among a variety of electronic apparatuses to which the display device according to the present invention is applicable are, other than the specific examples illustrated in FIGS. 49-51, a digital still camera, a television, a video camera, a car navigation device, a pager, an electronic personal organizer, an electronic paper, an electronic calculator, a word processor, a workstation, a videophone, a POS terminal, a printer, a scanner, a copier, a video player, a touch-panel device, and so forth.

The entire disclosure of Japanese Patent Application Nos: 2007-107798, filed Apr. 17, 2007, 2007-107799, filed Apr. 17, 2007, 2007-107800, filed Apr. 17, 2007 and 2007-107801, filed Apr. 17, 2007 are expressly incorporated by reference herein.

What is claimed is:

1. A display device, comprising:

an illumination unit that delivers a first light, a second light and a third light; and a driving circuit that supplies a pixel with a first data signal for displaying a first image by illuminating the first light, the driving circuit supplying the pixel with a second data signal for displaying a second image by illuminating the second light, the driving circuit supplying the pixel with a third data signal for displaying a third image by illuminating the third light, the first light having a first color, the first color being white, the second light having a second color other than white, the third light having a third color, the third color being white, and at least two of: i) a first period in which the first light is delivered by the illumination unit, ii) a second period in which the second light is delivered by the illumination unit, and iii) a third period in which the third light is delivered by the illumination unit, having lengths that are mutually different.

2. The display device according to claim 1, the illumination unit further delivering a fourth light, the fourth light having a fourth color, and the fourth color being a color other than the first color, the second color and the third color.

3. The display device according to claim 2, the first period being longer than a fourth period in which the fourth light is delivered by the illumination unit.

4. The display device according to claim 1, the first period being longer than the second period.

5. The display device according to claim 1, the first light being illuminated during an entirety of the first period, the second light being illuminated during an entirety of the second period, and the third light being illuminated during an entirety of the third period.

6. A display device, comprising:

an illumination unit that delivers a plurality of lights, the display device being configured such that:

the display device display an image during a frame by using the plurality of lights;

a first light of the plurality of lights being delivered during a first period included in the frame;

a second light of the plurality of lights being delivered during a second period included in the frame;

a third light of the plurality of lights being delivered during a third period included in the frame;

at least two of: i) the first period, ii) the second period, and iii) the third period, having lengths that are mutually different;

the first light having a first color, the first color being white;

the second light having a second color other than white; and the third light being a light having a third color, the third color being white.

7. The display device according to claim 6, the first period being one sub-field included in the frame, the second period being one sub-field included in the frame, and the third period being one sub-field included in the frame.

8. The display device according to claim 6, the first period being longer than the second period.

9. The display device according to claim 6,
the first light being delivered during an entirety of the first period,
the second light being delivered during an entirety of the second period, and
the third light being delivered during an entirety of the third period.

10. The display device according to claim 6,
a length of the first period being different from a length of the third period.

11. The display device according to claim 6,
the second color being any one of a red, a green, a blue, a cyan, a magenta and a yellow.

12. An electronic apparatus comprising the display device according to claim 6.

13. The display device according to claim 6,
a length of the second period being equal to a length of the third period.

14. The display device according to claim 6,
the second period coming after the third period and before the first period.

15. The display device according to claim 6,
the plurality of lights including a fourth light,
the fourth light having a fourth color, and
the fourth color being other than the first color, the second color and the third color.

16. The display device according to claim 15,
the plurality of lights including a fifth light,
the fifth light being a light having a fifth color, and
the fifth color being other than the first color, the second color, the third color, and the fourth color.

17. The display device according to claim 16,
the fourth period and the fifth period coming after the third period and before the first period.

18. The display device according to claim 15,
the fourth period coming after the third period and before the first period.

19. A display device, comprising:
an illumination unit that delivers a first light, a second light and a third light; and
a driving circuit that supplies a pixel with a first data signal for displaying a first image by illuminating the first light, the driving circuit supplying the pixel with a second data signal for displaying a second image by illuminating the second light, the driving circuit supplying the pixel with a third data signal for displaying a third image by illuminating the third light,
the first light having a first color, the first color being white,
the second light having a second color other than white,
the third light having a third color, the third color being a color other than the second color, and
at least two of: i) a first period in which the first light is delivered by the illumination unit, ii) a second period in which the second light is delivered by the illumination unit, and iii) a third period in which the third light is delivered by the illumination unit, having lengths that are mutually different.

* * * * *